US006709563B2

(12) United States Patent
Nagai et al.

(10) Patent No.: US 6,709,563 B2
(45) Date of Patent: Mar. 23, 2004

(54) COPPER-PLATING LIQUID, PLATING METHOD AND PLATING APPARATUS

(75) Inventors: Mizuki Nagai, Fujisawa (JP); Shuichi Okuyama, Yokohama (JP); Ryoichi Kimizuka, Tokyo (JP); Takeshi Kobayashi, Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/893,624

(22) Filed: Jun. 29, 2001

(65) Prior Publication Data

US 2002/0027081 A1 Mar. 7, 2002

(30) Foreign Application Priority Data

Jun. 30, 2000 (JP) ..... 2000-199924

(51) Int. Cl.[7] ..... C25D 5/02; H01L 21/288; H01L 21/445

(52) U.S. Cl. ..... 205/123; 205/296; 205/157; 205/220; 204/224 R; 106/1.18; 106/1.26; 427/443.1

(58) Field of Search ..... 427/443.1; 106/1.18, 106/1.26; 204/224 R, DIG. 7, 242; 205/220, 102, 103, 123, 125, 170, 182, 224, 291, 296, 297, 298, 157

(56) References Cited

U.S. PATENT DOCUMENTS

| | | | | |
|---|---|---|---|---|
| 5,695,810 A | | 12/1997 | Dubin et al. | |
| 6,110,011 A | | 8/2000 | Somekh et al. | |
| 6,197,181 B1 | | 3/2001 | Chen | |
| 6,251,235 B1 | * | 6/2001 | Talieh et al. | 204/220 |
| 6,267,853 B1 | | 7/2001 | Dordi et al. | |
| 6,319,387 B1 | * | 11/2001 | Krishnamoorthy et al. | 205/240 |
| 6,350,364 B1 | * | 2/2002 | Jang | 205/118 |
| 6,413,436 B1 | | 7/2002 | Aegerter et al. | |
| 2002/0004301 A1 | | 1/2002 | Chen et al. | |
| 2002/0033340 A1 | * | 3/2002 | Cheung et al. | 205/101 |

FOREIGN PATENT DOCUMENTS

WO 00/32835 6/2000

OTHER PUBLICATIONS

By Shinji Matsushita, editorial staff, "Copper Electroplating Apparatus "PARAGON" of Semitool, Loaded with Seed Layer Measuring Function", Seed Layer Strengthening/ Repair Function, and, "Process Single Wafer Measuring Function", Semiconductor FPD World, vol. 19, No. 10, pp. 122–124, Pressjournal, Sep. 20, 2000.

Akihisa Hongo et al., "Wafer Cleaning Apparatus", U.S. patent application Ser. No. 09/572,432, filed May 17, 2000.

* cited by examiner

*Primary Examiner*—Roy King
*Assistant Examiner*—Wesley Nicolas
(74) *Attorney, Agent, or Firm*—Wenderoth, Lind & Ponack, L.L.P.

(57) ABSTRACT

There is provided a copper-plating liquid free from an alkali metal and a cyanide which, when used in plating of a substrate having an outer seed layer and fine recesses of a high aspect ratio, can reinforce the thin portion of the seed layer and can embed copper completely into the depth of the fine recesses.

The plating liquid contains divalent copper ions and a completing agent, and an optional pH adjusting agent.

57 Claims, 36 Drawing Sheets

CATHODE POLARIZATION CURVES

COPPER-PLATING LIQUID, PLATING METHOD AND PLATING APPARATUS

BACKGROUND OF THE INVENTION

1. Field of the Invention

This invention relates a copper-plating liquid, a plating method and a plating apparatus, and more particularly to a copper-plating liquid, a plating method and a plating apparatus useful for forming copper interconnects by plating a semiconductor substrate with copper to fill copper in fine recesses for interconnects formed in the surface of the substrate.

2. Description of the Related Art

In recent years, instead of using aluminum or aluminum alloys as a material for forming interconnection circuits on a semiconductor substrate, there is an eminent movement towards using copper (Cu) which has a low electric resistance and high electromigration resistance. Copper interconnects are generally formed by embedding copper into fine recesses formed in the surface of a substrate. There are known various techniques for producing such copper interconnects, including CVD, sputtering, and plating. According to any such technique, a copper is deposited on the substantially entire surface of a substrate, followed by removal of unnecessary copper by chemical mechanical polishing (CMP).

FIGS. 39A through 39C illustrate, in a sequence of process steps, an example of producing such a substrate W having copper interconnects. As shown in FIG. 39A, an oxide film 2 of $SiO_2$ is deposited on a conductive layer 1*a* formed on a semiconductor base 1 on which semiconductor devices are formed. A contact hole 3 and a trench 4 for interconnects are formed in the oxide film 2 by the lithography/etching technique. Thereafter, a barrier layer 5 of TaN or the like is formed on the entire surface, and a seed layer 7 as an electric supply layer for electroplating is formed on the barrier layer 5.

Then, as shown in FIG. 39B, copper plating is performed onto the surface of the substrate W to fill the contact hole 3 and the trench 4 with copper and, at the same time, deposit a copper film 6 on the oxide film 2. Thereafter, the copper film 6 on the oxide film 2 is removed by chemical mechanical polishing (CMP) so as to make the surface of the copper film 6 filled in the contact hole 3 and the trench 4 for interconnects and the surface of the oxide film 2 lie substantially on the same plane. An interconnect composed of the copper film 6, as shown in FIG. 39C is thus formed.

The seed layer 7 is generally formed by means of sputtering or CVD. In the case where the copper film 6 is formed by electroplating with copper, a copper sulfate plating liquid, which contains copper sulfate and sulfuric acid, has generally been used as a plating liquid.

With the recent trend towards finer interconnects, the trenches for interconnects or plugs are becoming to have a higher aspect ratio. This poses the problem that a seed layer cannot be sufficiently formed by, e.g. sputtering, in the bottom portion of the trench, thus failing to form a uniform seed layer Thus, as shown in FIG. 40A, there is a likelihood that the thickness $t_1$ of the seed layer 7 formed on the side wall of the trench near the bottom portion thereof becomes 1/10 or less of the thickness $t_2$ of the seed layer 7 formed on the side wall of the trench near the surface of the substrate. When electroplating with copper is carried out to fill with copper into such a trench by using a copper sulfate plating liquid, an electric current hardly passes through the extremely thin portion in the seed layer 7, causing to the formation of an undeposited portion (void) 8 shown in FIG. 40B. An attempt to overcome this drawback by increasing the overall thickness of the seed layer 7 so as to thicken the extremely thin portion would not be successful, since in electroplating with copper for filling such trench, copper would deposit thick around the opening of the trench to close it, resulting in the formation of a void.

On the other hand, a copper-plating liquid, which comprises a base such as copper sulfate and, as additives, a complexing agent and a pH adjusting agent for maintaining the liquid pH within a neutral range, has been developed. Such a copper-plating liquid, however, is generally too unstable for practical use. Moreover, the pH adjusting agent generally contains an alkali metal such as sodium and potassium. A plating liquid containing an alkali metal, when applied to a semiconductor substrate, causes electromigration to deteriorate the semiconductor. There is also known a copper-plating liquid comprising a copper cyanide. However, since cyanides are harmful to human health, it is required to avoid using such a plating liquid from operational and environmental viewpoints.

SUMMARY OF THE INVENTION

The present invention has been made in view of the above drawbacks in the prior art. It is therefore an object of the present invention to provide a copper-plating liquid which is free from alkali metals and cyanides, and which can reinforce the thin portion of a seed layer and ensures complete filling with copper in fine recesses having a high aspect ratio formed in the surface of a substrate, and also to provide a plating method and a plating apparatus which utilize the copper-plating liquid.

Tn order to achieve the above object, the present invention provides a copper-plating liquid free from an alkali metal and a cyanide, comprising divalent copper ions and a complexing agent. The inclusion of a completing agent in the copper-plating liquid can enhance the polarization as a plating bath and improve the uniform electrodeposition property. This enables reinforcement of the thin portion of a seed layer and uniform filling with copper into the depths of fine recesses, such as trenches and holes, having a high aspect ratio. Further, the deposited plating is dense, and is freed from microvoids formation therein. Furthermore, the copper-plating liquid of the present invention, which does not contain any alkali metal nor cyanide, does not cause deterioration of a semiconductor which would otherwise be caused by electromigration due to the presence of an alkali metal and, in addition, does meet the demand for avoiding the use of a cyanide.

Preferably, the plating liquid further contain a pH adjusting agent selected from agents not containing an alkali metal nor a cyanide, such as sulfuric acid, hydrochloric acid, phosphoric acid, choline, ammonia and tetramethyl ammonium hydroxide. By using such a pH adjusting agent according to necessity, the plating liquid may be maintained within a pH range of 7–14, preferably at a pH range of about 8–11, more preferably at a pH range of 8–9.

The concentration of divalent copper ions in the plating liquid should preferably be in the range of 0.1–100 g/l, more preferably in the rage of 1–10 g/l. A copper ion concentration below the above range lowers the current efficiency, thereby lowering the precipitation efficiency of copper. A copper ion concentration exceeding the above range worsens the electrodeposition property of the liquid. The concentration of the complexing agent should preferably be in the range of 0.1–500 g/l, more preferably in the range of 0.1–200 g/l, furthermore preferably in the range of 20–200 g/l. When the concentration is lower than the above range, an adequate complexing with copper can hardly be made whereby sediments are likely to produce. When the concentration is higher than the above range, on the other hand, the plating can take on the so-called "burnt deposit" state and thus the appearance is worsened and, in addition, the treatment of waste liquid becomes different. Further, when the pH of the plating liquid is too low, the complexing agent cannot effectively combine with copper, thus failing to provide a complete complex. On the other hand, too high a pH of the plating liquid can bring about the formation of a variant form of complex which makes a sediment. The above described preferred pH range can obviate these drawbacks.

The plating liquid may also contain at least one additive selected from organic acids, amides, glycerin, gelatin, heavy metal ions, thiazoles, triazoles, thiadiazoles, imidazoles, pyrimidines, sulfonic acids, and gultamic acids.

Specific examples of the complexing agent may include ethylenediamine tetracetic acid, ethylenediamine, N, N', N", N'"-ethylene-di-nitro-tetrapropane-2-ol, pyrophosphoric acid, iminodiacetic acid, diethylenetriamine pentacetic acid, diethylenetriamine, triethylenetetramine, tetraethylenepentamine, diamino butane, hydroxyethyl ethylenediamine, ethylediamine tetrapropionic acid, ethylenediamine tetramethylene phosphonic acid, diethylenetriamine tetramethylene phosphonic acid, diethylenetriamine pentamethylene phosphonic acid, and their derivatives.

The present invention provides a method for plating a substrate having fine recesses, in a surface of the substrate thereof, covered with a barrier layer and/or a seed layer to fill the fine recesses with a metal, comprising: plating the surface of the substrate in a first-stage by contacting the substrate in a first plating liquid; and plating the surface of the substrate in a second-stage by contacting the substrate in a second plating liquid, wherein the first plating liquid has a higher polarization than the second plating liquid.

According to this method, when there is a thin portion in the seed layer, the thin portion can be reinforced by the first-stage plating to provide a complete seed layer, and the complete seed layer effectively serves as an electric supply layer in the second-stage plating. The method can thus fill a metal such as copper fully with the fine recesses and form a plated film having a flat surface.

The present invention, in another aspect thereof, provides a method for plating a substrate having fine recesses, in a surface of the substrate thereof, covered with a barrier layer and/or a seed layer to fill the fine recesses with a metal, comprising: plating the surface of the substrate by contacting the substrate in a plating liquid having an excellent uniform electrodeposition property.

The present invention also provide a plating apparatus comprising: a first plating section for plating a surface of a substrate having fine recesses formed in the surface thereof and covered with a barrier layer and/or a seed layer in a first-stage; a first plating liquid feed section for feeding a first liquid into a plating chamber in the first plating section; a second plating section for plating the surface of the substrate which has undergone the first-stage plating in a second-stage; a second plating liquid feed section for feeding a second plating liquid into a plating chamber in the second plating section; and a transport section for transporting the substrate from the first plating section to the second plating section, wherein the first plating liquid has a higher polarization than the second plating liquid.

The present invention provide a plating apparatus comprising: a loading/unloading section for loading and unloading a semiconductor substrate; a first metal plating unit for forming a first plated metal film on a surface of the semiconductor substrate; a second metal plating unit for forming a second plated metal film on the first plated metal film; a bevel-etching unit for etching away a metal film formed on the edge portion of the semiconductor substrate which has the second plated metal film on the surface thereof; an annealing unit for annealing the semiconductor substrate; and a transporting device for transporting the semiconductor substrate, wherein the first metal plating liquid for forming the first plated metal film has a higher polarization than the second metal plating liquid for forming the second plated metal film.

The present invention provide a plating method, comprising: forming a first plated metal film on a surface of a semiconductor substrate; forming a second plated metal film on the first plated metal film; etching away a metal film formed on the edge portion of the semiconductor substrate which has the second plated metal film on the surface thereof; and annealing the bevel-etched semiconductor substrate, wherein the first metal plating liquid for forming the first plated metal film has a higher polarization than the second metal plating liquid for forming the second plated metal film.

The above and other objects, features, and advantages of the present invention will be apparent from the following description when taken in conjunction with the accompanying drawings which illustrates preferred embodiments of the present invention by way of example.

BRIEF DESCRIPTION OF THE DRAWINGS

FIG. 18A is a perspective view showing a device, FIG. 18B is a plan view of a robot hand, and FIG. 18C is a cross-sectional view of the robot hand;

FIG. 31A is a plan view and FIG. 31B is a side sectional view;

FIG. 31A is a plan view and FIG. 31B is a side sectional view;

FIG. 33A is a plan view and FIG. 33B is a side sectional view;

DETAILED DESCRIPTION OF THE PREFERRED EMBODIMENTS

Preferred embodiments of the present invention will now be described with reference to the drawings.

Figure 1:
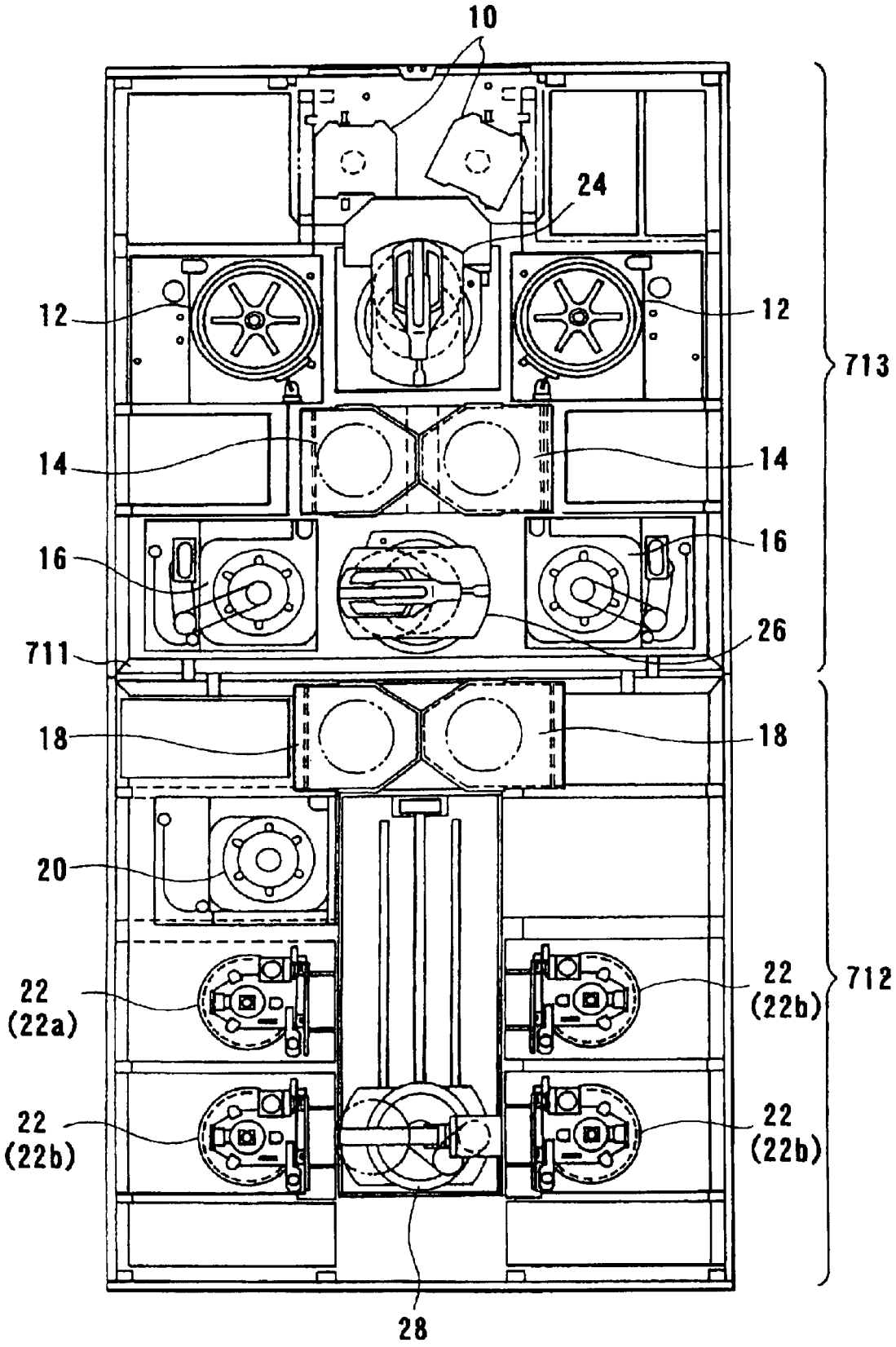
FIG. 1 is a plan view showing a layout of a plating apparatus according to an embodiment of the present invention.

FIG. 1 is a plan view of a plating apparatus in accordance with the present invention. The plating apparatus comprises loading/unloading sections 10, each pair of cleaning/drying sections 12, first substrate stages 14, bevel-etching/chemical cleaning sections 16 and second substrate stages 18, a washing section 20 provided with a mechanism for reversing the substrate through 180°, and four plating sections 22. The plating apparatus is also provided with a first transporting device 24 for transporting a substrate between the loading/unloading sections 10, the cleaning/drying sections 12 and the first substrate stages 14, a second transporting device 26 for transporting a substrate between the first substrate stages 14, the bevel-etching/chemical cleaning sections 16 and the second substrate stages 18, and a third transporting device 28 for transporting the substrate between the second substrate stages 18, the washing section 20 and the plating sections 22.

The plating apparatus has a partition wall 711 for dividing the plating apparatus into a plating space 712 and a clean space 713. Air can individually be supplied into and exhausted from each of the plating space 712 and the clean space 713. The partition wall 711 has a shutter (not shown) capable of opening and closing. The pressure of the clean space 713 is lower than the atmospheric pressure and higher than the pressure of the plating space 712. This can prevent the air in the clean space 713 from flowing out of the plating apparatus and can prevent the air in the plating space 712 from flowing into the clean space 713.

Figure 2:
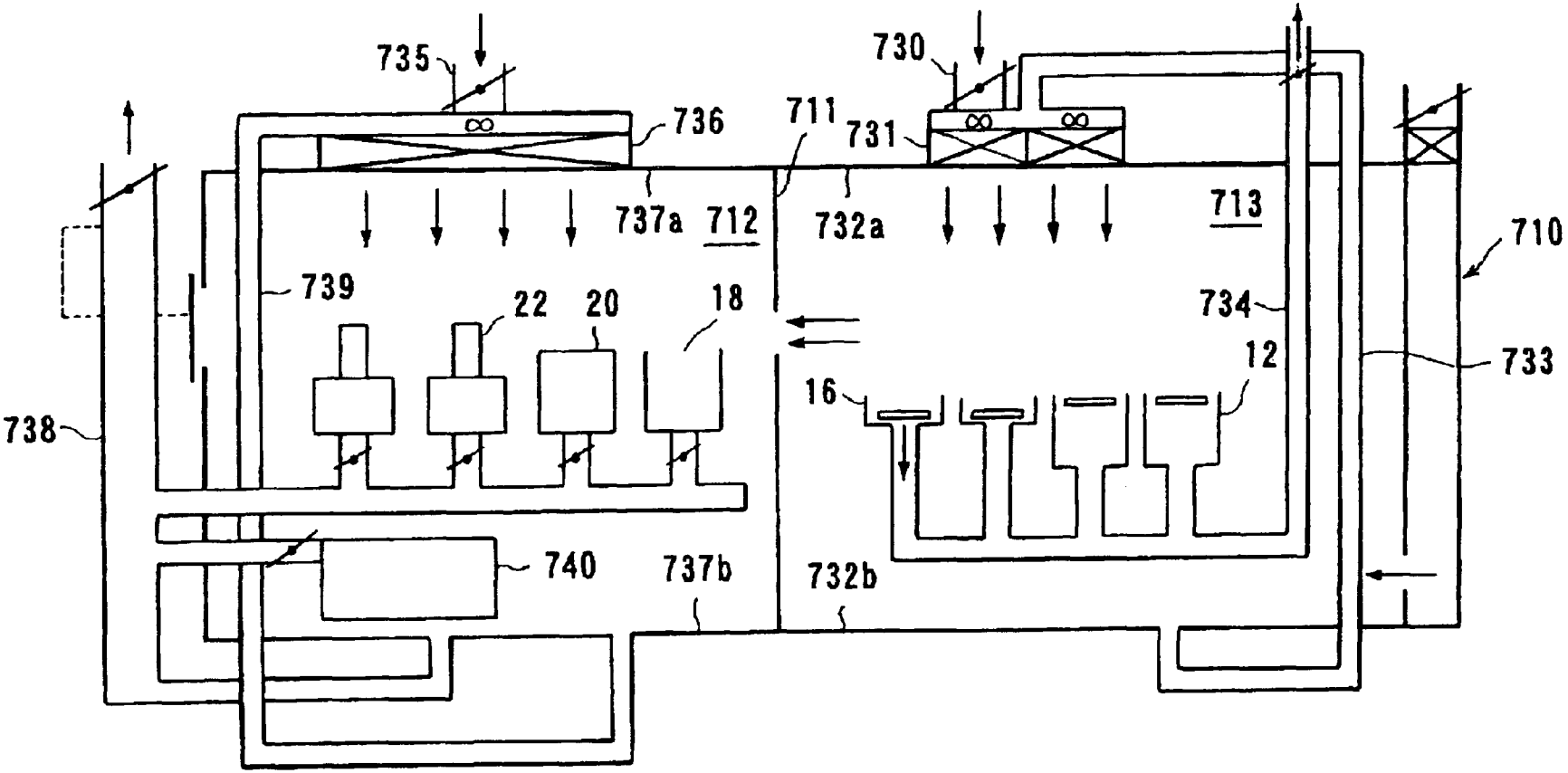
FIG. 2 is an explanatory view showing an air current in the plating apparatus shown in FIG. 1.

FIG. 2 is a schematic view showing an air current in the plating apparatus. In the clean space 713, a fresh external air is introduced through a pipe 730 and pushed into the clean space 713 through a high-performance filter 731 by a fan. Hence, a downflow clean air is supplied from a ceiling 732*a* to positions around the cleaning/drying sections 12 and the bevel-etching/chemical cleaning sections 16. A large part of the supplied clean air is returned from a floor 732*b* through a circulation pipe 733 to the ceiling 732*a*, and pushed again into the clean space 713 through the high-performance filter 731 by the fan, to thus circulate in the clean space 713. A part of the air is discharged from the cleaning/drying sections 12 and the bevel-etching/chemical cleaning sections 16 through a pipe 734 to the exterior, so that the pressure of the clean space 713 is set to be lower than the atmospheric pressure.

The plating space 712 having the washing sections 20 and the plating sections 22 therein is not a clean space (but a contamination zone). However, it is not acceptable to attach particles to the surface of the substrate. Therefore, in the plating space 712, a fresh external air is introduced through a pipe 735, and a downflow clean air is pushed into the plating space 712 through a high-performance filter 736 by a fan, for thereby preventing particles from being attached to the surface of the substrate. However, if the whole flow rate of the downflow clean air is supplied by only an external air supply and exhaust, then enormous air supply and exhaust are required. Therefore, the air is discharged through a pipe 738 to the exterior, and a large part of the downflow is supplied by a circulating air through a circulation pipe 739 extended from a floor 737*b,* in such a state that the pressure of the plating space 712 is maintained to be lower than the pressure of the clean space 713.

Thus, the air returned to a ceiling 737*a* through the circulation pipe 739 is pushed again into the plating space 712 through the high-performance filter 736 by the fan. Hence, a clean air is supplied into the plating space 712 to thus circulate in the plating space 712. In this case, air containing chemical mist or gas emitted from the washing sections 20, the plating sections 22, the third transporting device 28, and a plating liquid regulating tank 740 is discharged through the pipe 738 to the exterior. Thus, the pressure of the plating space 712 is controlled so as to be lower than the pressure of the clean space 713.

Figure 3:
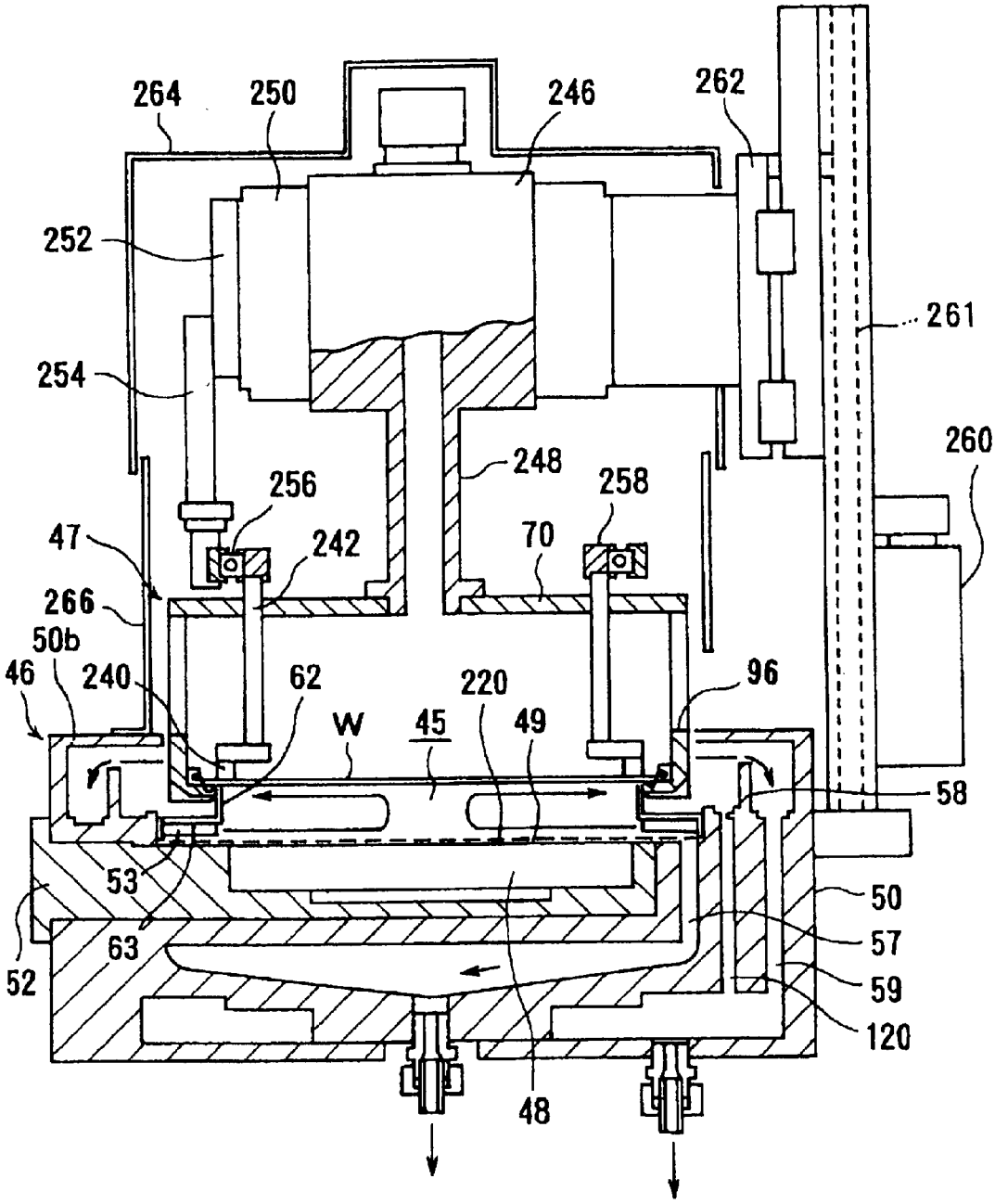
FIG. 3 is a cross-sectional view showing a whole structure of a plating section at the time of plating process.

FIG. 3 shows a main part of the plating section 22. The plating section 22 mainly comprises a plating process container 46 in the substantially cylindrical form for holding a plating liquid 45 therein, and a head 47 disposed above the plating process container 46 for holding a substrate. In FIG. 3, the head 47 is located in a plating position in which a substrate W held by the head 47 is lowered and the liquid level of the plating liquid 45 is raised.

The plating process container 46 comprises a plating container 50 which has a plating chamber 49 which is open upward and has an anode 48 at the bottom thereof, and contains the plating liquid 45 therein. Plating liquid supply nozzles 53, which project horizontally toward the center of the plating chamber 49, are disposed at circumferentially equal intervals on the inner circumferential wall of the plating container 50. The plating liquid supply nozzles 53 communicate with plating liquid supply passages extending vertically within the plating container 50.

Figure 4:
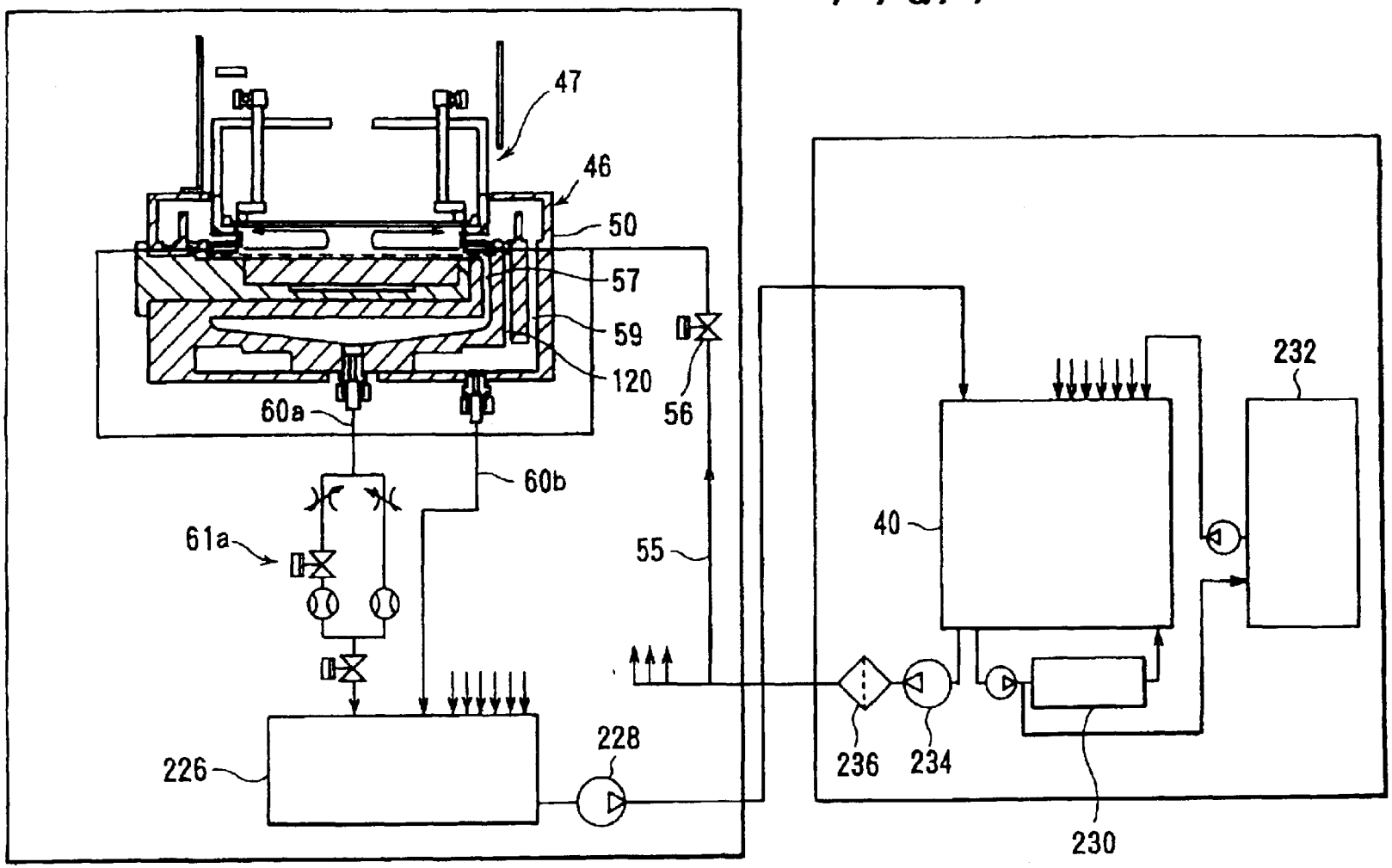
FIG. 4 is a schematic diagram showing a flow of a plating liquid in a plating section.
Figure 5:
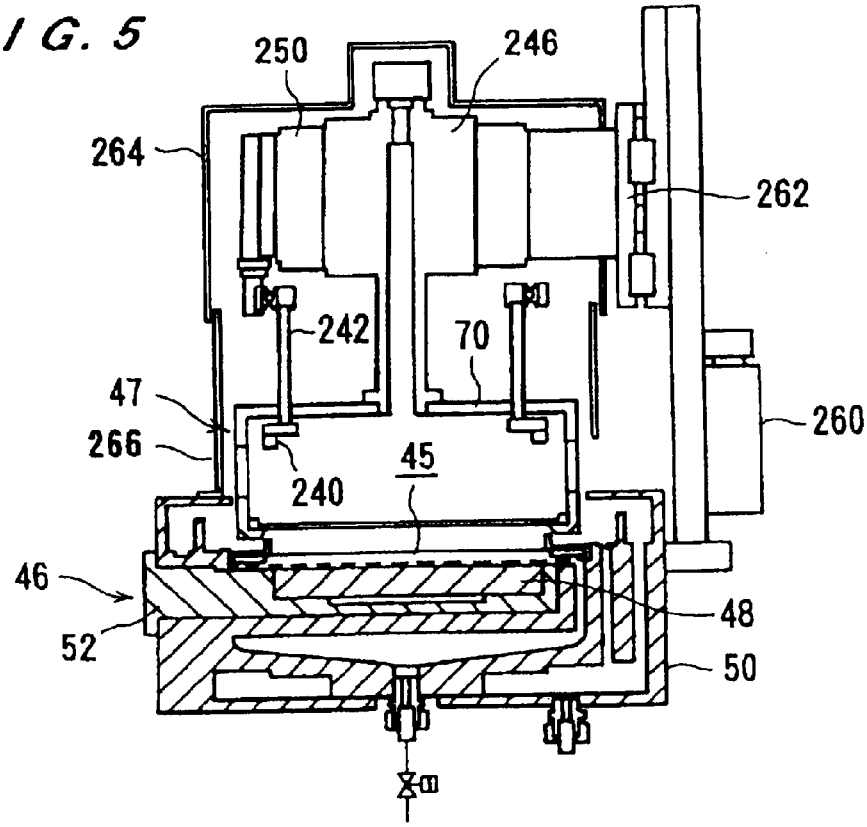
FIG. 5 is a cross-sectional view showing a whole structure of the plating section at the time of non-plating process (at the time of transfer of a substrate)

The plating liquid supply passages are connected to the plating liquid regulating tank 40 shown in FIG. 4 through the plating liquid supply pipes 55. Control valves 56 for controlling the back pressure so as to be constant are disposed on each of the plating liquid supply pipes 55.

Further, according to this embodiment, a punch plate 220 having a large number of holes with a size of, for example, about 3 mm is disposed at a position above the anode 48 within the plating chamber 49. The punch plate 220 prevents a black film formed on the surface of the anode 48 from curling up by the plating liquid 45 and consequently being flowed out.

Figure 9C:
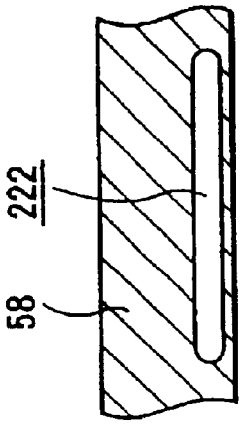
FIGS. 9A through 9D are schematic views explanatory of the flow of a plating liquid at the time of plating process and at the time of non-plating process.
Figure 9D:
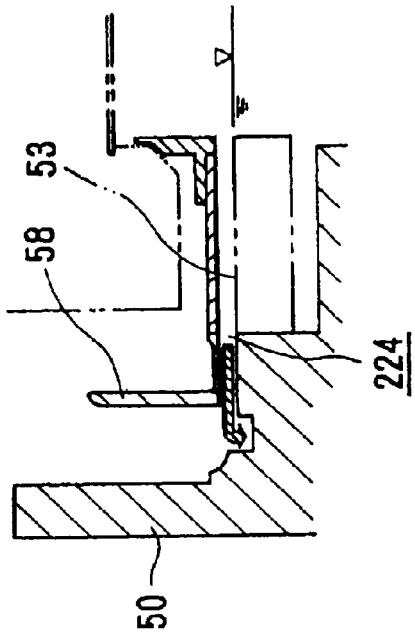

The plating container 50 has first plating liquid discharge ports 57 for withdrawing the plating liquid 45 contained in the plating chamber 49 from the peripheral portion of the bottom in the plating chamber 49, and second plating liquid discharge ports 59 for discharging the plating liquid 45 which has overflowed a weir member 58 provided at the upper end of the plating container 50. Further, the plating container 50 has third plating liquid discharge ports 120 for discharging the plating liquid before overflowing the weir member 58. The plating liquid which has flowed through the second plating liquid discharge ports 59 and the third plating liquid discharge ports 120 joins at the lower end of the plating container 50, and then is discharged from the plating container 50. Instead of providing the third plating liquid discharge ports 120, as shown in FIGS. 9A through 9C, the weir member 58 may have, in its lower part, openings 222 having a predetermined width at predetermined intervals so that the plating liquid 45 passes through the openings 222 and is then discharged to the second plating liquid discharge ports 59.

Figure 9A:
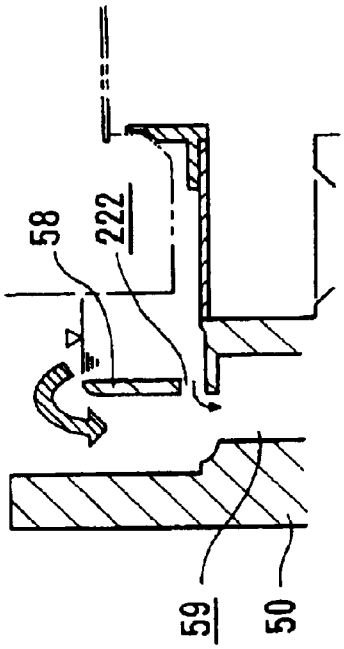
Figure 9B:
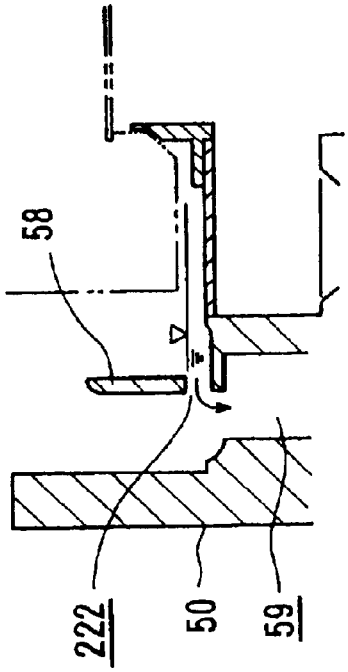

With this arrangement, when the amount of plating liquid supplied is large during plating, the plating liquid is discharged to the exterior through the third plating liquid discharge ports 120 or is passed through the openings 222 and discharged to the exterior through the second plating liquid discharge ports 59 and, in addition, as shown in FIG. 9A, the plating liquid overflows the weir member 58 is discharged to the exterior through the second plating liquid discharge ports 59. On the other hand, during plating, when the amount of plating liquid supplied is small, the plating liquid is discharged to the exterior through the third plating liquid discharge ports 120, or alternatively as shown in FIG. 9B, the plating liquid is passed through the openings 222 and discharged to the exterior through the second plating liquid discharge ports 59. In this manner, this construction can easily cope with the case where the amount of plating liquid supplied is large or small.

Further, as shown in FIG. 9D, through holes 224 for controlling the liquid level, which are located above the plating liquid supply nozzles 53, and communicate with the plating chamber 49 and the second plating liquid discharge ports 59, are provided at circumferentially predetermined pitches. Thus, when plating is not performed, the plating liquid is passed through the through holes 224, and is discharged to the exterior through the second plating liquid discharge ports 59, thereby controlling the liquid level of the plating liquid. During plating, the through holes 224 serve as an orifice for restricting the amount of the plating liquid flowing therethrough.

As shown in FIG. 4, the first plating liquid discharge ports 57 are connected to the reservoir 226 through the plating liquid discharge pipe 60*a*, and a flow controller 61*a* is provided in the plating liquid discharge pipe 60*a*. The second plating liquid discharge ports 59 and the third plating liquid discharge ports 120 join with each other within the plating container 50, and the joined passage is then connected directly to the reservoir 226 through the plating liquid discharge pipe 60*b*.

The plating liquid which has flowed into the reservoir 226 is introduced by a pump 228 into the plating liquid regulating tank 40. This plating liquid regulating tank 40 is provided with a temperature controller 230, and a plating liquid analyzing unit 232 for sampling the plating liquid and analyzing the sample liquid. When a pump 234 is operated, the plating liquid is supplied from the plating liquid regulating tank 40 through the filter 236 to the plating liquid supply nozzles 53. A control valve 56 is provided in the plating liquid supply pipe 55 extending from the plating liquid regulating tank 40 to each of the plating sections 22 to make the pressure on the secondary side constant.

Returning to FIG. 3 a vertical stream regulating ring 62 and a horizontal stream regulating ring 63 are disposed within the plating chamber 49 at a position near the internal circumference of the plating chamber 49, so that the central portion of the liquid surface is pushed up by an upward stream out of two divided upward and downward streams of the plating liquid 45 within the plating chamber 49, whereby the downward flow is smoothened and the distribution of the current density is further uniformized. The horizontal stream regulating ring 63 has a peripheral portion which is fixed to the plating container 50, and the vertical stream regulating ring 62 is connected to the horizontal stream regulating ring 63.

Figure 8:
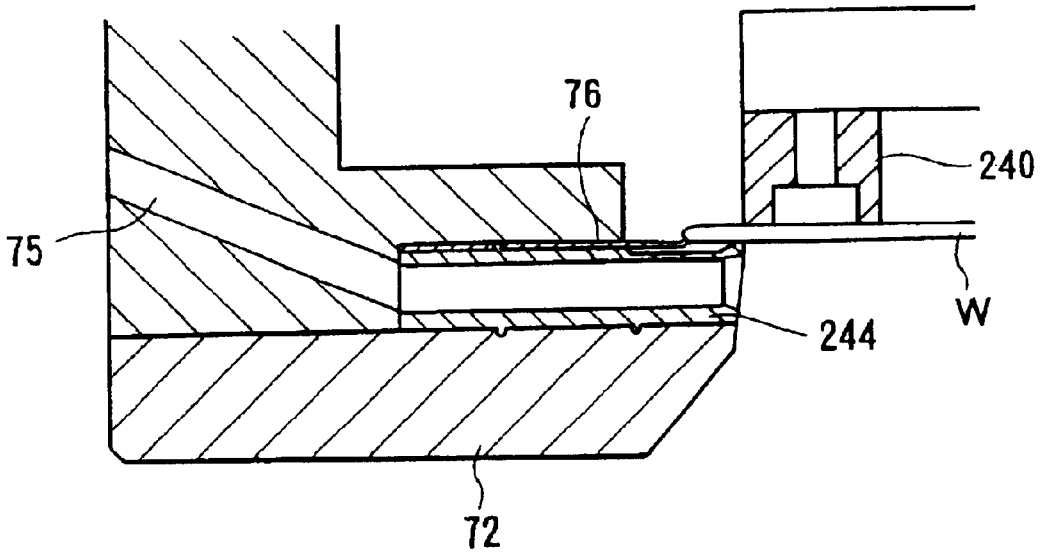
FIG. 8 is an enlarged view showing a part of FIG. 7.

On the other hand, the head 47 comprises a housing 70 which is a rotatable and cylindrical receptacle having a downwardly open end and has openings 96 on the circumferential wall, and vertically movable pressing rods 242 having, in its lower end, a pressing ring 240. As shown in FIG. 8, an inwardly projecting ring-shaped substrate holding member 72 is provided at the lower end of the housing 70. A ring-shaped sealing member 244 is mounted on the substrate holding member 72. The ring-shaped sealing member 244 projects inward, and the front end of the top surface in the ring-shaped sealing member 244 projects upward in an annular tapered form. Further, contacts 76 for a cathode electrode are disposed above the sealing member 244. Air vent holes 75, which extend outwardly in the horizontal direction and further extend outwardly in an upwardly inclined state, are provided in the substrate holding member 72 at circumferentially equal intervals.

Figure 6:
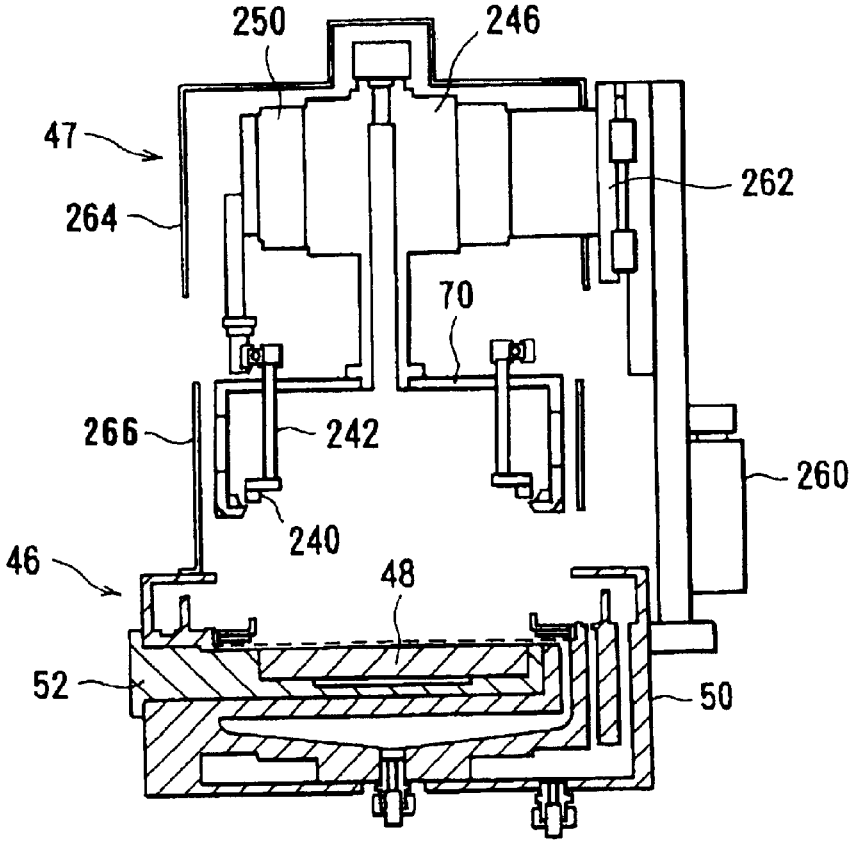
FIG. 6 is a cross-sectional view showing a whole structure of the plating section at the time of maintenance.
Figure 7:
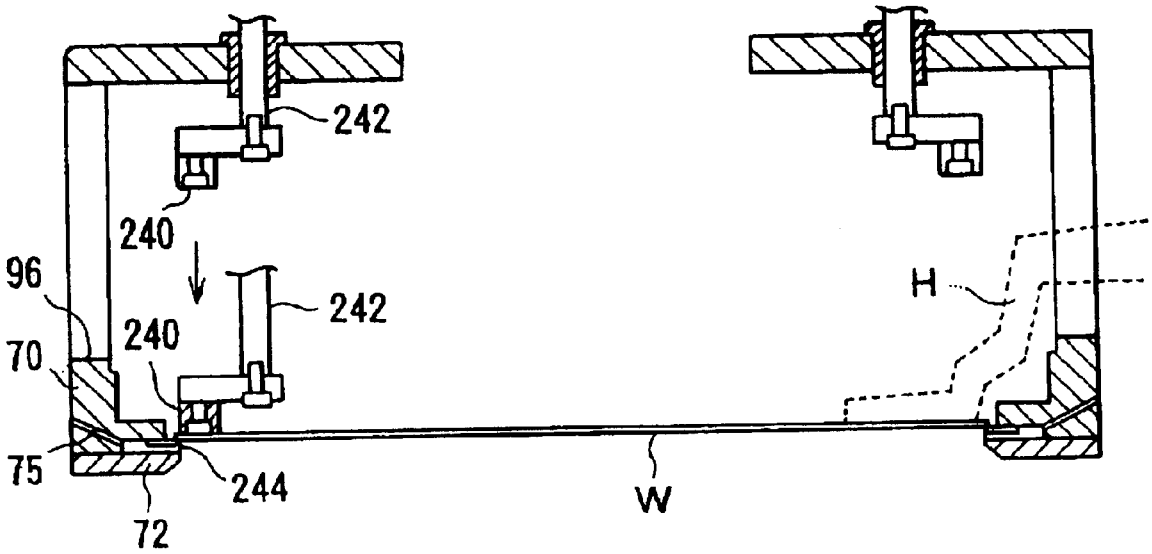
FIG. 7 is a cross-sectional view explanatory of a relationship among a housing, a pressing ring, and a substrate at the time of transfer of a substrate.

With this arrangement, as shown in FIG. 6, the liquid level of the plating liquid is lowered, and as shown in FIGS. 7 and 8, the substrate W is held by a robot hand H or the like, and inserted into the housing 70 where the substrate W is placed on the upper surface of the sealing member 244 of the substrate holding member 72. Thereafter, the robot hand H is withdrawn from the housing 70, and the pressing ring 240 is then lowered to sandwich the peripheral portion of the substrate W between the sealing member 244 and the lower surface of the pressing ring 240, thereby holding the substrate W. In addition, upon holding of the substrate W, the lower surface of the substrate W is brought into pressure contact with the sealing member 244 to seal this contact portion positively. At the same time, current flows between the substrate W and the contacts 76 for a cathode electrode.

Returning to FIG. 3, the housing 70 is connected to an output shaft 248 of a motor 246, and rotated by energization of the motor 246. The pressing rods 242 are vertically provided at predetermined positions along the circumferential direction of a ring-shaped support frame 258 rotatably mounted through a bearing 256 on the lower end of a slider 254. The slider 254 is vertically movable by actuation of a cylinder 252, with a guide, fixed to a support 250 surrounding the motor 246. With this construction, the pressing rods 242 are vertically movable by the actuation of the cylinder 252, and, in addition, upon the holding of the substrate W, the pressing rods 242 are rotated integrally with the housing 70.

The support 250 is mounted on a slide base 262 which is vertically movable with a rotation of a ball screw 261 rotated by energization of the motor 260. The support 250 is surrounded by an upper housing 264, and is vertically movable together with the upper housing 264 by energization of the motor 260. Further, a lower housing 266 for surrounding the housing 70 during plating is mounted on the upper surface of the plating container 50.

With this construction, as shown in FIG. 6, maintenance can be performed in such a state that the support 250 and the upper housing 264 are raised. A crystal of the plating liquid is likely to deposit on the inner circumferential surface of the weir member 58. However, the support 250 and the upper housing 264 are raised, a large amount of the plating liquid is flowed and overflows the weir member 58, and hence the crystal of the plating liquid is prevented from being deposited on the inner circumferential surface of the weir member 58. A cover 50*b* for preventing the splash of the plating liquid is integrally provided in the plating container 50 to cover a portion above the plating liquid which overflows during plating process. By coating an ultra-water-repellent material such as HIREC (manufactured by NTT Advance Technology) on the inner surface of the cover 50*b* for preventing the splash of the plating liquid, the crystal of the plating liquid can be prevented from being deposited on the cover 50*b*.

Figure 10:
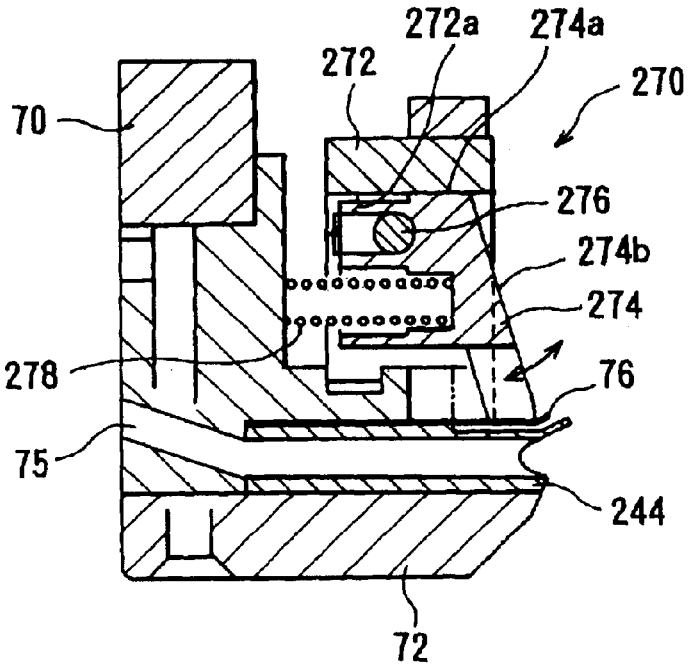
FIG. 10 is an enlarged cross-sectional view showing a centering mechanism in the plating section.

Substrate centering mechanisms 270 located above the substrate holding member 72 of the housing 70 for performing centering of the substrate W are provided at four places along the circumferential direction in this embodiment. FIG. 10 shows the substrate centering mechanism 270 in detail. The substrate centering mechanism 270 comprises a gate-like bracket 272 fixed to the housing 70, and a positioning block 274 disposed within the bracket 272. This positioning block 274 is swingably mounted through a support shaft 276 horizontally fixed to the bracket 272. Further, a helical compression spring 278 is interposed between the housing 70 and the positioning block 274. Thus, the positioning block 274 is urged by the helical compression spring 278 so that the positioning block 274 rotates about the support shaft 276. and the lower portion of the positioning block 274 projects inwardly. The upper surface 274*a* of the positioning block 274 serves as a stopper, and is brought into connect with the lower surface 272*a* of the bracket 272 to restrict the movement of the positioning block 274. Further, the positioning block 274 has a tapered inner surface 274*b* which is widened outward in the upward direction.

With this construction, a substrate is held by the hand of a transfer robot or the like, is carried into the housing 70, and is placed on the substrate holding member 72. In this case, when the center of the substrate deviates from the center of the substrate holding member 72, the positioning block 274 is rotated outwardly against the urging force of the helical compression spring 278 and, upon the release of holding of the substrate from the hand of the transfer robot or the like, the positioning block 274 is returned to the original position by the urging force of the helical compression spring 278. Thus, the centering of the substrate can be carried out.

Figure 11:
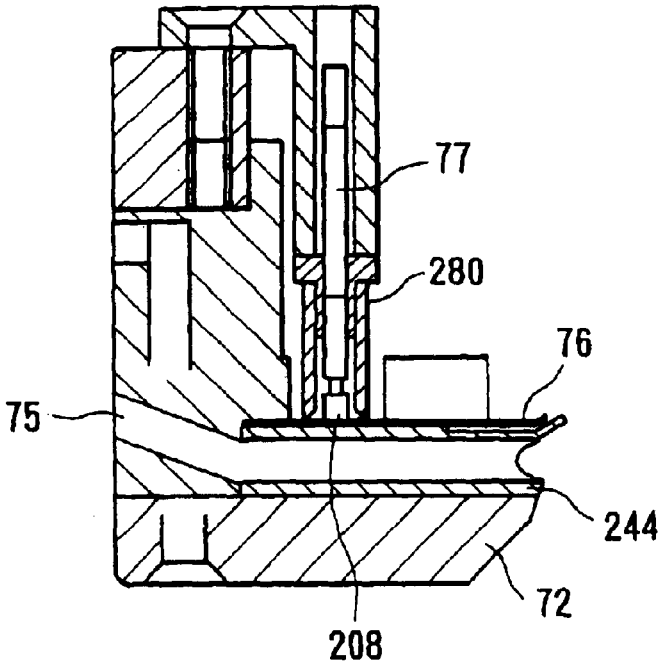
FIG. 11 is a cross-sectional view showing a feeding contact (probe) in the plating section.

FIG. 11 shows a feeding contact (a probe) 77 for feeding power to a cathode electrode plate 208 having contacts 76 for a cathode electrode. This feeding contact 77 is composed of a plunger and is surrounded by a cylindrical protective member 280 extending to the cathode electrode plate 208, whereby the feeding contact 77 is protected against the plating liquid.

The operation of the plating section 22 will now be described.

First, in transporting the substrate to the plating section 22, the attracting hand of the third transporting device 28 shown in FIG. 1, and the substrate W attracted and held with its front face downward by the attracting hand are inserted into the housing 70 through an opening 96, and the attracting hand is then moved downward. Thereafter, the vacuum attraction is released to place the substrate W on the substrate holding member 72 of the housing 70. The attracting hand is then moved upward and withdrawn from the housing 70. Thereafter, the pressing ring 240 is lowered down to the peripheral portion of the substrate W so as to hold the substrate W between the substrate holding member 72 and the lower surface of the pressing ring 240.

The plating liquid 45 is then spurted from the plating supply nozzles 53 while, at the same time, the housing 70 and the substrate W held by it are allowed to rotate. When the plating chamber is charged with a predetermined amount of the plating liquid 45, and further after an elapse of several seconds, the rotational speed of the housing 70 is decreased to a slow rotation (e.g. 100 $min^{-1}$). Then, electroplating is carried out by passing an electric current between the anode 48 and the plating surface of the substrate W as a cathode.

After the supply of the electric current, as shown in FIG. 9D, the feed of the plating liquid is decreased so that the liquid is allowed to flow out only through the through holes 224 for liquid level control positioned above the plating liquid injection nozzle 53, thereby exposing the housing 70, together with the substrate held by it, above the surface of the plating liquid. The housing 70 and the substrate, positioned above the liquid surface, are allowed to rotate at a high speed (e.g. 500–800 $min^{-1}$) to drain away the plating liquid by the action of centrifugal force. After the completion of draining, the rotation of the housing 70 is stopped so that the housing 70 stops at a predetermined position.

After the housing 70 comes to a complete stop, the pressing ring 240 is moved upward. Thereafter, the attracting hand of the third transporting device 28 is inserted, with its attracting face downward, into the housing 70 through the opening 96 and is then lowered to a position at which the attracting hand can attract the substrate. After attracting the substrate by vacuum attraction, the attracting hand is moved upward to the position of the opening 96 of the housing 70, and is withdrawn, together with the substrate held by the attracting hand, through the opening 96.

According to the plating section 22, the head 47 can be designed to be compact and structurally simple. Further, the plating can be carried out when the surface of the plating liquid in the plating process container 46 lies at the plating level, and the draining and the transport of the substrate can be carried out when the surface of the plating liquid lies at the substrate-transporting level. Moreover, the black film formed on the surface of the anode 48 can be prevented from being dried and oxidized.

Figure 12:
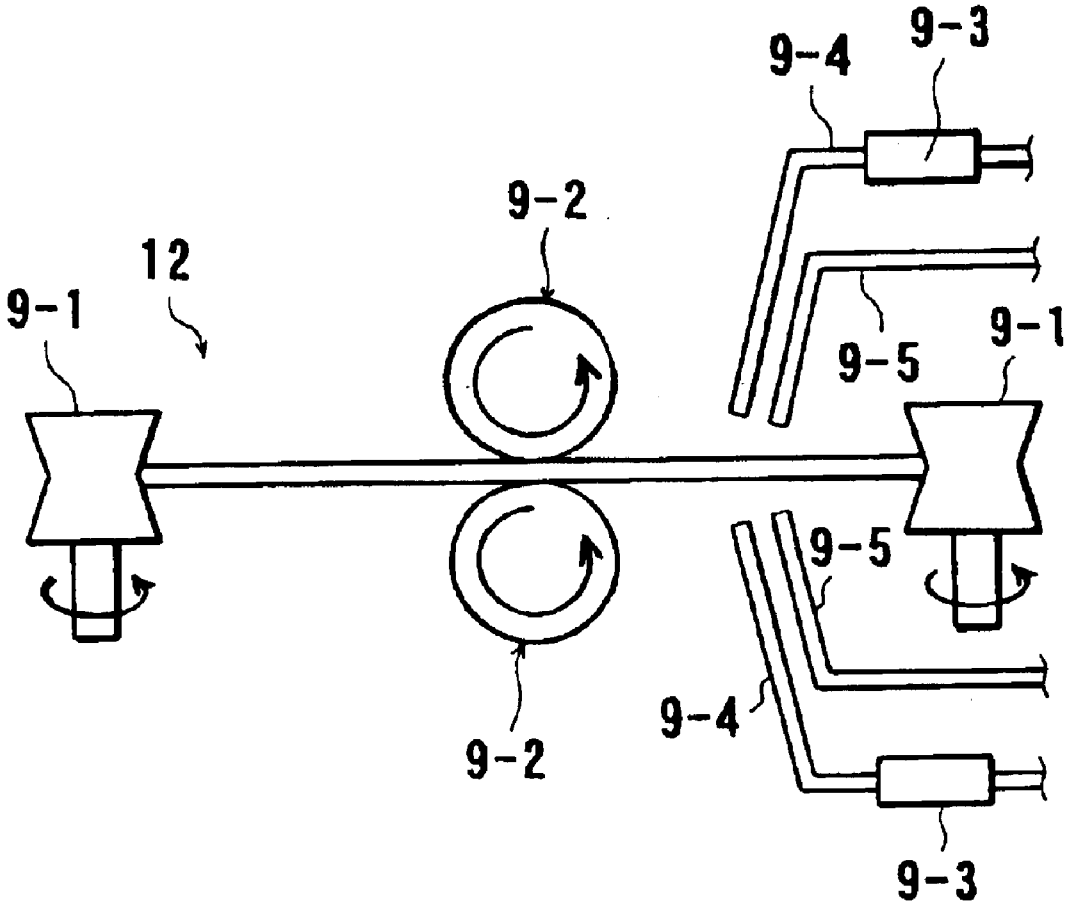
FIG. 12 is a schematic view showing a cleaning/drying section.

FIG. 12 is a schematic view showing the cleaning/drying section 12. In the cleaning/drying section 12, the surface and the backside of the semiconductor substrate W are scrubbed with PVA sponge rolls 9-2, 9-2. As cleaning water ejected from nozzles 9-4, pure water is mainly used, but there may be used a surface active agent, or a chelating agent, or a mixture of both which has been adjusted in pH and conformed to the zeta potential of copper oxide. The nozzle 9-4 may also be provided with an ultrasonic vibration element 9-3 for applying ultrasonic vibrations to the cleaning water to be ejected. The reference numeral 9-1 is a rotating roller for rotating the semiconductor substrate W in a horizontal plane.

Figure 13:
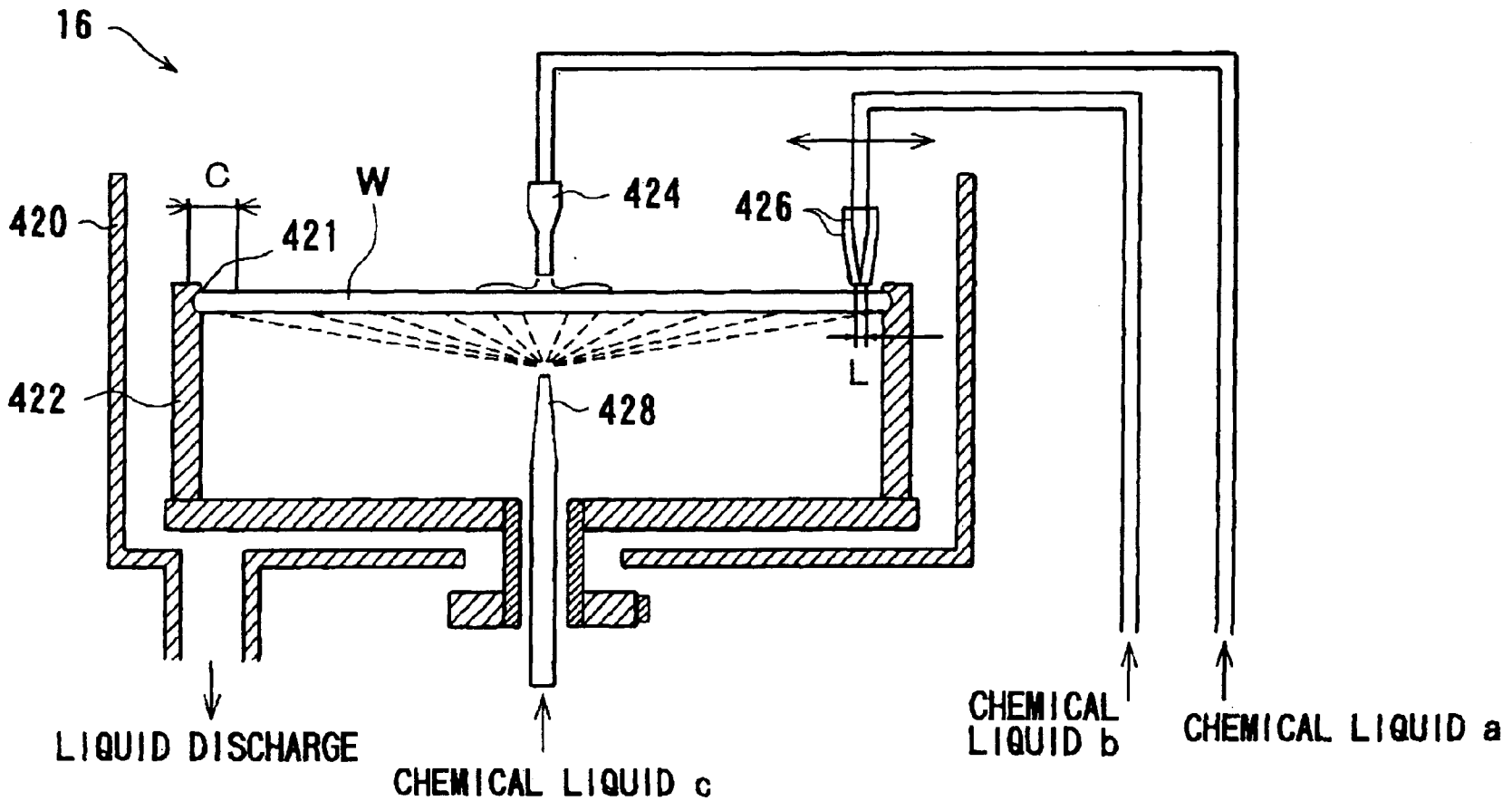
FIG. 13 is a schematic view showing a bevel-etching/chemical cleaning section.

The bevel-etching/chemical cleaning section 16 can perform an edge (bevel) Cu etching and a backside cleaning at the same time, and can suppress growth of a natural oxide film of copper at the circuit formation portion on the surface of the substrate. FIG. 13 shows a schematic view of the bevel-etching/chemical cleaning section 16. As shown in FIG. 13, the bevel-etching/chemical cleaning section 16 comprises a substrate holding portion 422 positioned inside a bottomed cylindrical waterproof cover 420 and adapted to rotate a substrate W at a high speed, in such a state that the face of the substrate W faces upwardly, while holding the substrate W horizontally by spin chucks 421 at a plurality of locations along a circumferential direction of a peripheral edge portion of the substrate; a center nozzle 424 placed above a nearly central portion of the surface of the substrate W held by the substrate holding portion 422; and an edge nozzle 426 placed above the peripheral edge portion of the substrate W. The center nozzle 424 and the edge nozzle 426 are directed downward. A back nozzle 428 is positioned below a nearly central portion of the backside of the substrate W, and directed upward. The edge nozzle 426 is adapted to be movable in a diametrical direction and a height direction of the substrate W.

The width of movement L of the edge nozzle 426 is set Such that the edge nozzle 426 can be arbitrarily positioned in a direction toward the center from the outer peripheral end surface of the substrate, and a set value for L is inputted according to the size, usage, or the like of the substrate W. Normally, an edge cut width C is set in the range of 2 mm to 5 mm. In the case where a rotational speed of the substrate is a certain value or higher at which the amount of liquid migration from the backside to the surface is not problematic, the copper film within the edge cut width C can be removed.

Next, the method of cleaning with this bevel-etching/chemical cleaning section 16 will be described. First, the semiconductor substrate W is horizontally rotated integrally with the substrate holding portion 422, with the substrate being held horizontally by the spin chucks 421 of the substrate holding portion 422. In this state, an acid solution is supplied from the center nozzle 424 to the central portion of the surface of the substrate W. The acid solution may be a non-oxidizing acid, and hydrofluoric acid, hydrochloric acid, sulfuric acid, citric acid, oxalic acid, or the like is used. On the other hand, an oxidizing agent solution is supplied continuously or intermittently from the edge nozzle 426 to the peripheral edge portion of the substrate W. AS the oxidizing agent solution, one of an aqueous solution of ozone, an aqueous solution of hydrogen peroxide, an aqueous solution of nitric acid, and an aqueous solution of sodium hypochlorite is used, or a combination of these is used.

In this manner, the copper film, or the like formed on the upper surface and end surface in the region of the peripheral edge portion C of the semiconductor substrate W is rapidly oxidized with the oxidizing agent solution, and is simultaneously etched with the acid solution supplied from the center nozzle 424 and spreaded on the entire surface of the substrate, whereby it is dissolved and removed. By mixing the acid solution and the oxidizing agent solution at the peripheral edge portion of the substrate, a steep etching profile can be obtained, in comparison with a mixture of them which is produced in advance being supplied. At this time, the copper etching rate is determined by their concentrations. If a natural oxide film of copper is formed in the circuit-formed portion on the surface of the substrate, this natural oxide film is immediately removed by the acid solution spreading on the entire surface of the substrate according to rotation of the substrate, and does not grow any more.

Specifically, the copper oxide film, which was formed on the surface of the substrate in the plating, can thus be removed by flowing HF over the substrate surface. Further, a copper oxide film is not newly formed during the etching. When a copper oxide film remains on the surface of the substrate, only the copper oxide portion is preferentially polished away in a later CMP processing, which adversely affects the flatness of the processed surface. This can be avoided by the removal of the copper oxide film in the above manner.

After the supply of the acid solution from the center nozzle 424 is stopped, the supply of the oxidizing agent solution from the edge nozzle 426 is stopped. As a result, silicon exposed on the surface is oxidized, and deposition of copper can be suppressed Thus, the activated surface such as Si exposed on the surface of the substrate, for example, can be oxidized and thereby inactivated by later stopping the supply of $H_2O_2$. This prevents adsorption of large particles onto the surface of the substrate which can cause scratching in a later CMP processing. The oxidation of copper by $H_2O_2$ and the removal of the oxidized copper by HF, carried out repeatedly in the above manner, can enhance the rate of copper removal as compared with the case where the oxidation of copper and its removal are simultaneously effected by using a mixture liquid of $H_2O_2$ and HF.

On the other hand, an oxidizing agent solution and a silicon oxide film etching agent are supplied simultaneously or alternately from the back nozzle 428 to the central portion of the backside of the substrate. Therefore, copper or the like adhering in a metal form to the backside of the semiconductor substrate W can be oxidized with the oxidizing agent solution, together with silicon of the substrate, and can be etched and removed with the silicon oxide film etching agent. This oxidizing agent solution ifs preferably the same as the oxidizing agent solution supplied to the surface, because the types of chemicals are decreased in number. Hydrofluoric acid can be used as the silicon oxide film etching agent, and if hydrofluoric acid is used as the acid solution on the surface of the substrate, the types of chemicals can be decreased in number.

Thus, if the supply of the oxidizing agent is stopped first, a hydrophobic surface is obtained. If the etching agent solution is stopped first, a water-saturated surface (a hydrophilic surface) is obtained, and thus the backside surface can be adjusted to a condition which will satisfy the requirements of a subsequent process. In this manner, the acid solution, i.e., etching solution is supplied to the substrate to remove metal ions remaining on the surface of the substrate W. Then, pure water is supplied to replace the etching solution with pure water and remove the etching solution, and then the substrate is dried by spin-drying. In this way, removal of the copper film in the edge cut width C at the peripheral edge portion on the surface of the semiconductor substrate, and removal of copper contaminants on the backside are performed simultaneously to thus allow this treatment to be completed, for example, within 80 seconds. The etching cut width of the edge can be set arbitrarily (to 2 mm to 5 mm), but the time required for etching does not depend on the cut width.

Figure 14:
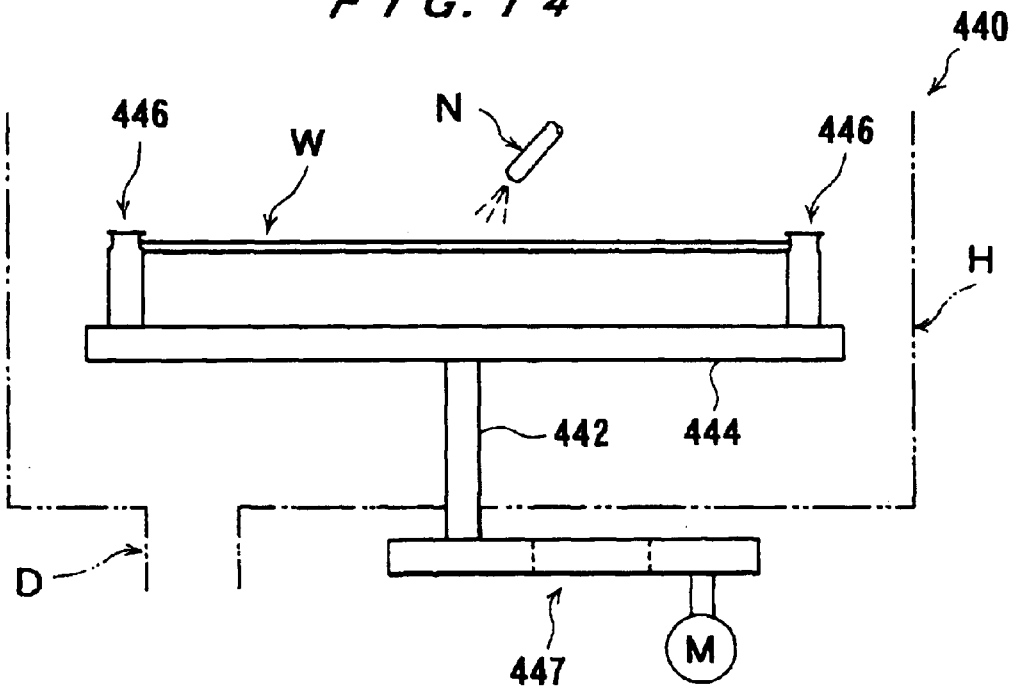
FIG. 14 is a side view of a rotatable holding device for use in the cleaning/drying section and in the bevel-etching/chemical cleaning.
Figure 15:
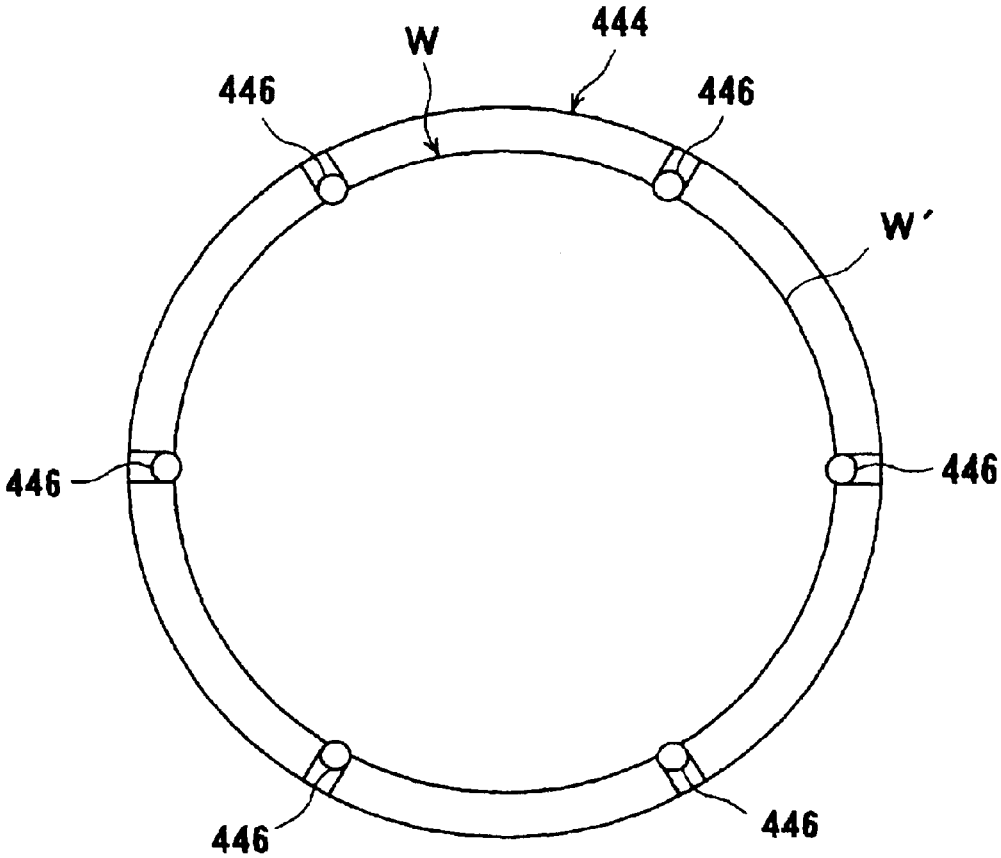
FIG. 15 is a plane view of FIG. 14.

FIGS. 14 through 17 show a rotatable holding device 440 particularly suited for use in the cleaning/drying section 12 and in the bevel-etching/chemical cleaning section 16. The rotatable holding device 440 is for rotating the substrate W while holding it horizontally, and comprises a disk-shaped rotatable member 444 that is set horizontally and rotated by a rotatable drive shaft 442, and a plurality of holding members 446 for holding substrate W above the rotatable member 444. The holding members 446 are mounted on the peripheral portion of the rotatable member 444 and arranged along a circle with the rotatable drive shaft 442 as a center, with each two adjacent members being spaced at a predetermined distance (60° in the embodiment of FIG. 15). The holding members 446 engages the periphery W' of the substrate W, thereby holding the substrate W horizontally. In FIG. 14, reference numeral 447 denotes a belt driving device for connecting the rotatable drive shaft 442 to a motor M for driving, and H denotes a housing for accommodating the rotatable holding device 440, that is adapted to prevent a cleaning liquid or the like supplied to the substrate W from scattering all around and correct the scattered liquid which is discharged through a discharge pipe D.

Figure 16:
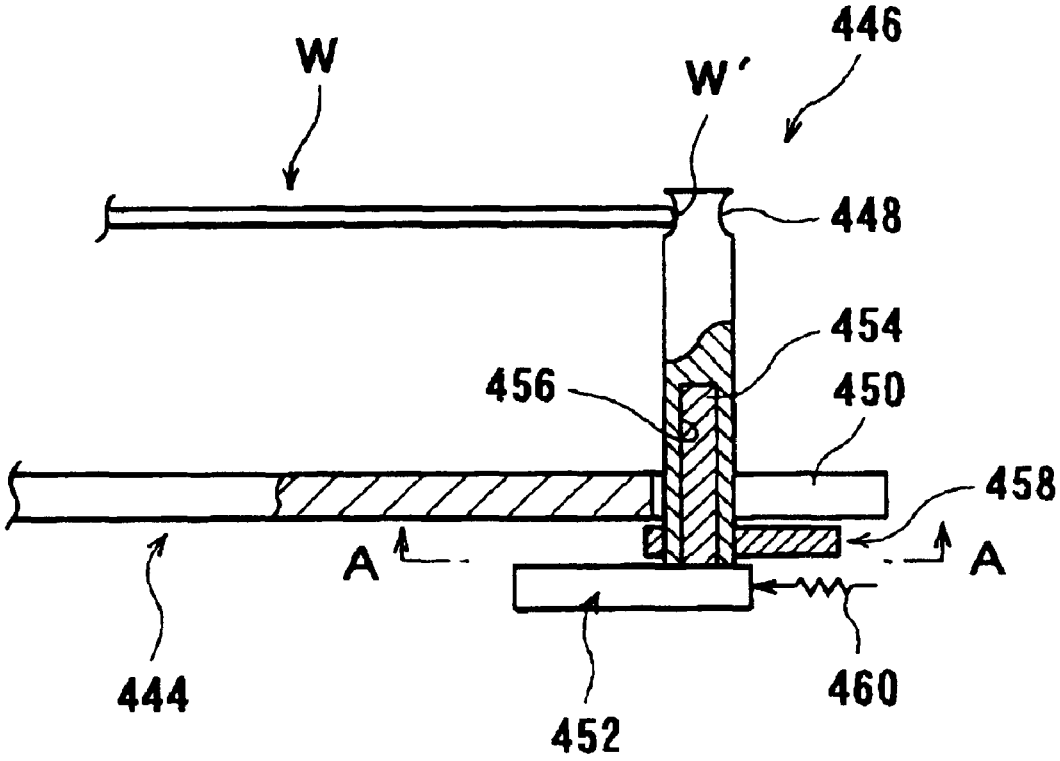
FIG. 16 is a cross-sectional view showing the details of a holding member in the rotatable holding device shown in FIG. 14.

FIG. 16 shows the details of each holding member 446. The holding member 446 is substantially columnar, and has near its top an engaging surface 444 formed an annular groove form. The engaging surface 444 is adapted to make a friction engagement with the periphery W' of the substrate W. The holding member 446 vertically penetrates a slot 450, which is formed in the peripheral portion of the rotatable member 444 and extends in the radial direction thereof, and is rotatable mounted at its lower part, which extends under the rotatable member 444, on a holding plate 452 that is located beneath the rotatable member 444 and is so constructed that it is allowed to rotate together with the rotatable member 444. The holding member 446 is held on the holding plate 452 in such a manner that it is allowed to rotatable about its own axis. Thus, the holding plate 452 has, mounted thereon, a small-diameter shaft 454 extending vertically upward, whereas in the inside of the holding member 446, a hole 456 is formed that extends upward from the bottom of the holding member 446. The hole 456 is moveable fitted with the small-diameter shaft 454, so that the holding member 446 can rotatable about the small-diameter shaft 454 as a center.

Figure 17:
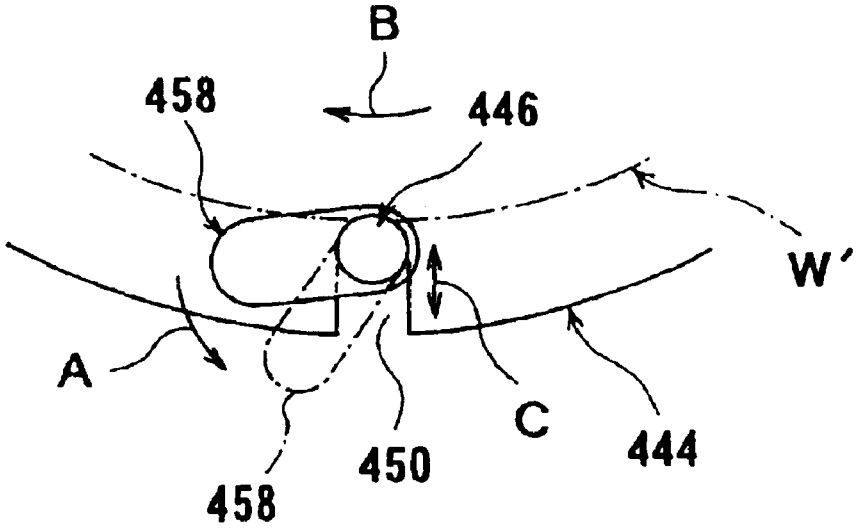
FIG. 17 is a diagram seeing along arrow line A—A of FIG. 16.

Further, a weight 458, extending horizontally, is mounted on the lower end of the holding member 446. When the rotatable member 444 rotates about its axis of rotation, i.e. the rotatable drive shaft 442, and the holding member 446 revolves around the shaft 442, the weight 458 is forced to move (swing) by the action of centrifugal force whereby the holding member 446 is allowed to swivel (rotate) about its own axis (i.e. the shaft 454). The position of the weight 458 shown by the solid line in FIG. 17 represents a home position, where the weight 458 is forced by pressure through an elastic means, not shown. When a certain centrifugal force is applied, the weight 458 is forced to move in the direction of arrow A towards the position shown by the chain line, whereby the substrate W is made to move in the direction of arrow B.

The holding plated 452 is supported in such a manner that it can move horizontally in the direction of arrow C, i.e. the radial direction of the rotatable member 444 by a link mechanism or the like, not shown, so that the holding member 446 can move along the slot 450 between an engaging/holding position (the position shown in FIG. 16) where the holding member 446 engages the periphery W' of the substrate W and a release position spaced radially outwardly from the engaging/holding position. Further, the holding plate 452 is pressed inwardly in the radial direction of the rotatable member 444 by a spring 460 so that the engaging surface 448 of the holding member 446 in the engaging/holding position elastically engages the periphery W' of the substrate W through the spring 460.

The operation of the rotatable holding device 440 for holding and rotating the substrate W will now be described. First, each holding member 446 is moved, against the pressure of the spring 460, outwardly in the radial direction of the rotatable member 444 to the release position. Thereafter, the substrate W is set horizontally above the rotatable member 444, and the holding member 446 is returned to the engaging/holding position to bring the engaging surface 448 into engagement with the periphery W' of the substrate W, thereby allowing the holding member 448 to elastically hold the substrate W.

When the rotatable member 444 is driven to rotate and the holding 446 revolves, a centrifugal force comes to act on the weight 458. The centrifugal force acting on the weight 458 is weak when the rotational speed of the rotatable member 444 is low, and so the weight 458 is kept motionless due to the pressure by the spring which forces the weight 458 in the home position. When the rotational speed of the rotational member 444 is higher than a particular value, the centrifugal force acting on the weight 458 exceeds the counter pressure of the spring and causes the weight 458 to swing, whereby the holding member 446 swings (rotates) about its own axis. Since the holding member 446 is in friction engagement with the periphery W' of the substrate W as described above, the swinging of the holding member 446 makes the substrate W rotate in the direction of arrow B shown in FIG. 17, thus shifting the engaging portion to the periphery W' of the substrate W.

According to the embodiment shown in FIGS. 16 and 17, the weight 458, whose center of gravity is eccentric to the central axis of the holding member 446, is mounted on the holding member 446. The use of such an eccentric weight 458, enables the holding member 446 to swing (rotate) about its own axis as it revolves. However, the mechanism for the swinging (rotation) of the holding member 446 is not limited thereto. Thus, for example, a link mechanism may be connected to the holding member 446, and the holding member 446 may be allowed to swing (rotate) through the action of the link mechanism.

The rotatable holding device 440, which has the above structural features and technical effects. When cleaning is performed to the substrate W while it is held and rotated by the rotatable holding device 440, for example, the peripheral portions of the substrate W in engagement with the holding members 446 can be shifted during the cleaning treatment, whereby a cleaning liquid can reach to the entire peripheral area of the substrate W, thus enabling a satisfactory cleaning treatment.

Though the rotatable holding device 440 can be applied to any cleaning device, it is most suitably employed in the bevel-etching/chemical cleaning device 16 shown in FIG. 1. The use of the rotatable holding device 440 in the bevel-etching/chemical cleaning device 16, while ensuring the holding of the substrate W, can shift the edge portion (the periphery W') of the substrate W in engagement with the holding member 446, whereby etching can be effected to every edge and bevel portion of the substrate W.

Figure 18A:
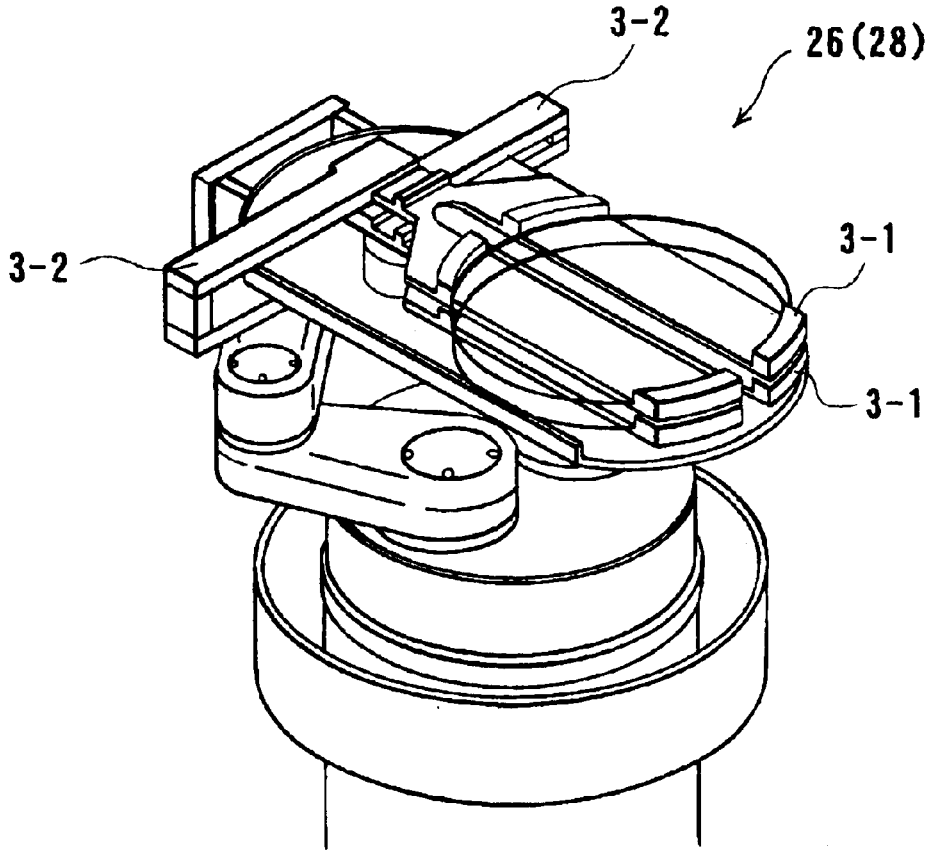
FIGS. 18A to 18C are views showing a transporting device.
Figure 18B:
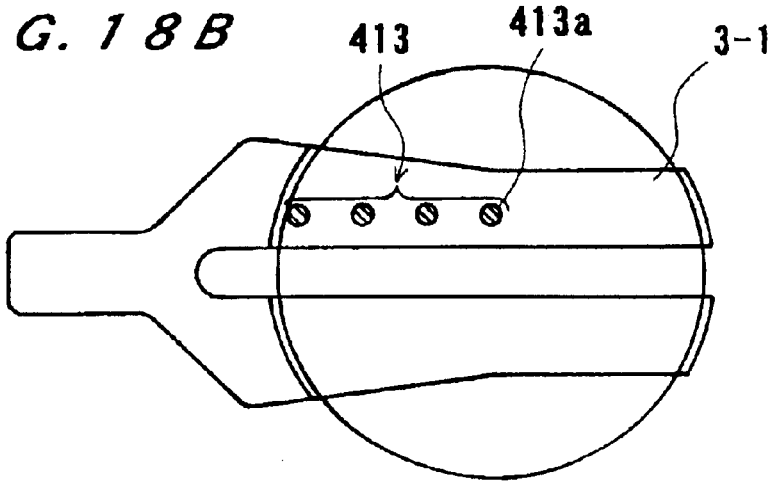
Figure 18C:
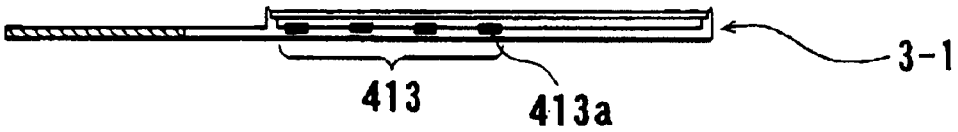

FIGS. 18A through 18C are views showing a constitution example of the transporting device 26 and the dry state film thickness measuring instrument 413 provided on the hand of the transporting device 26. FIG. 18A is a view showing the appearance of the transporting device 26, and FIGS. 18B and 18C are a plan view and a cross-sectional view of the robot hand, respectively. As illustrated, the transporting device 26 has two hands 3-1, 3-1 at upper and lower sides, and the hands 3-1, 3-1 are attached to front ends of arms 3-2, 3-2, respectively, so as to be swingably movable. The hands 3-1, 3-1 can scoop up the semiconductor substrate W (drop the semiconductor substrate W into the recesses) and transport it to a predetermined location.

A plurality of (four in the drawing) eddy current sensors 413*a* constituting the dry state film thickness measuring instrument 413 are provided in a recessed surface of the hand 3-1 for the semiconductor substrate W, and can measure the film thickness of the semiconductor substrate W placed thereon.

By thus providing the transporting device 26 with the dry-state film thickness measuring device 413, it becomes possible to measure the film thickness on the robot hands 3-1, 3-1. The results of film-thickness measurement may be stored as a record of the substrate W processing. Further, the measurement results may be relied on in deciding whether or not the substrate can be sent to the next step. It is possible to provide the dry-state film thickness measuring device 413 in the transporting device 28 which has a similar construction to that of the transporting device 26.

Figure 40A:
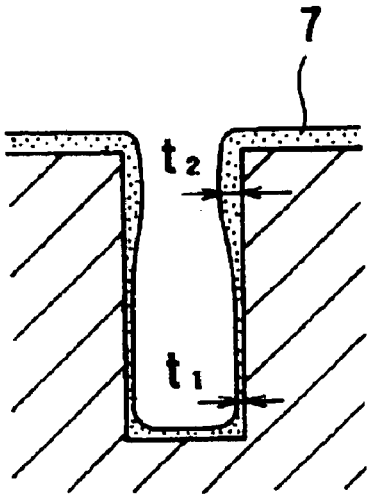
FIGS. 40A and 40B are cross-sectional views illustrating the state of a seed layer and a void which has been formed according to a conventional method.
Figure 40B:
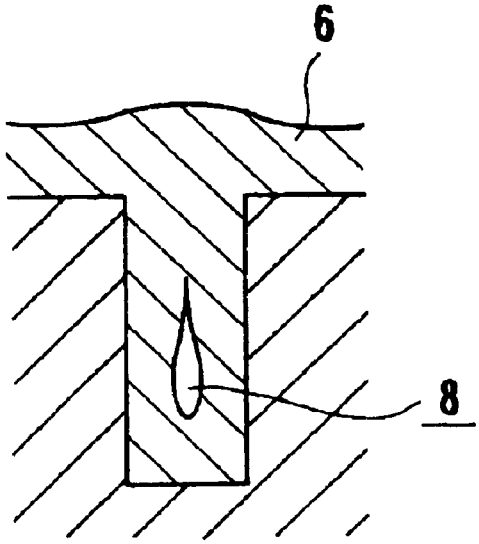

A plating method of the present invention will now be described by referring to FIG. 19. According to this embodiment, of the four plating sections 22 as shown in FIG. 1, one is employed as a first plating section 22*a* for a first-stage plating and the other three are employed as second plating sections 22*b* for second-stage plating. The first-stage plating in the first plating section 22*a* is to reinforce the thin portion in the seed layer 7 as shown in FIG. 40A so as to obtain a uniform thickness of seed layer 7, and the second-stage plating in the second plating sections 226 is to deposit copper onto the reinforced seed layer for filling with copper.

In the first plating section 22*a*, a plating liquid (first plating liquid) is used, as the plating liquid 45 (see FIG. 3), which contains divalent copper ions, a complexing agent and a pH adjusting agent, and does not contain any alkali metal nor any cyanide, and which has an excellent uniform electrodeposition property, e.g. a plating liquid consisting of copper pyrophosphate, pyrophosphoric acid and choline. The first plating liquid is maintained within a pH range of 7–14, preferably at a pH of about 9, by the addition of the pH adjusting agent such as cholin. This avoids a case where the complex fails to effectively combine with copper and forms an incomplete complex when the pH is too low, or a case where a variant form of complex is formed to produce a sediment when the pH is too high. The pH adjusting agent is not always necessary. The divalent copper ions are produced by the dissolution of a copper salt such as copper pyrophosphate, copper sulfate, copper acetate, copper chloride, EDTA-Cu, copper carbonate, copper nitrate, or copper sulfamate.

In the second plating section 22*b*, a copper sulfate plating liquid (second plating liquid) containing copper sulfate and sulfuric acid, and having an excellent leveling property is used as the plating liquid 45 (see FIG. 3).

Figure 39A:
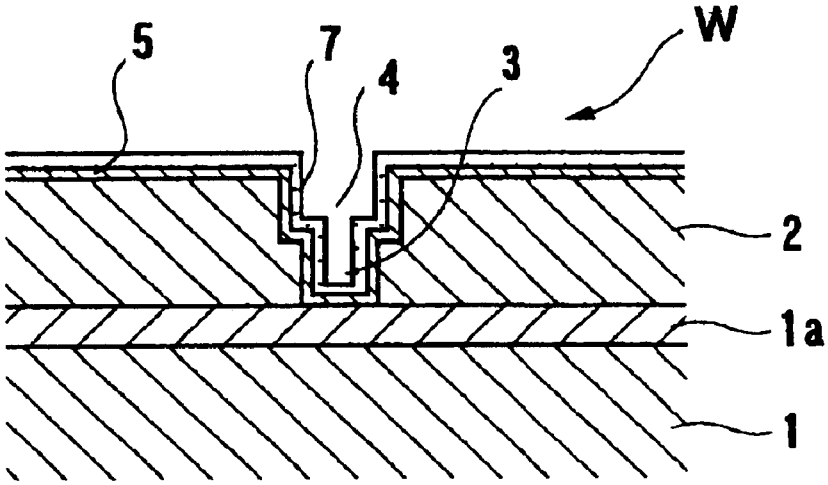
FIGS. 39A through 39C are diagrams illustrating, in a sequence of process steps, the formation of copper interconnects through copper plating.

First, the substrate W having a seed layer 7 (see FIG. 39A) as an outer layer is taken one by one from the loading/unloading section 10 by the first transporting device 24, and is transported, via the first substrate stage 14 and the second substrate stage 18, to the first plating section 22*a* (step 1).

Figure 20:
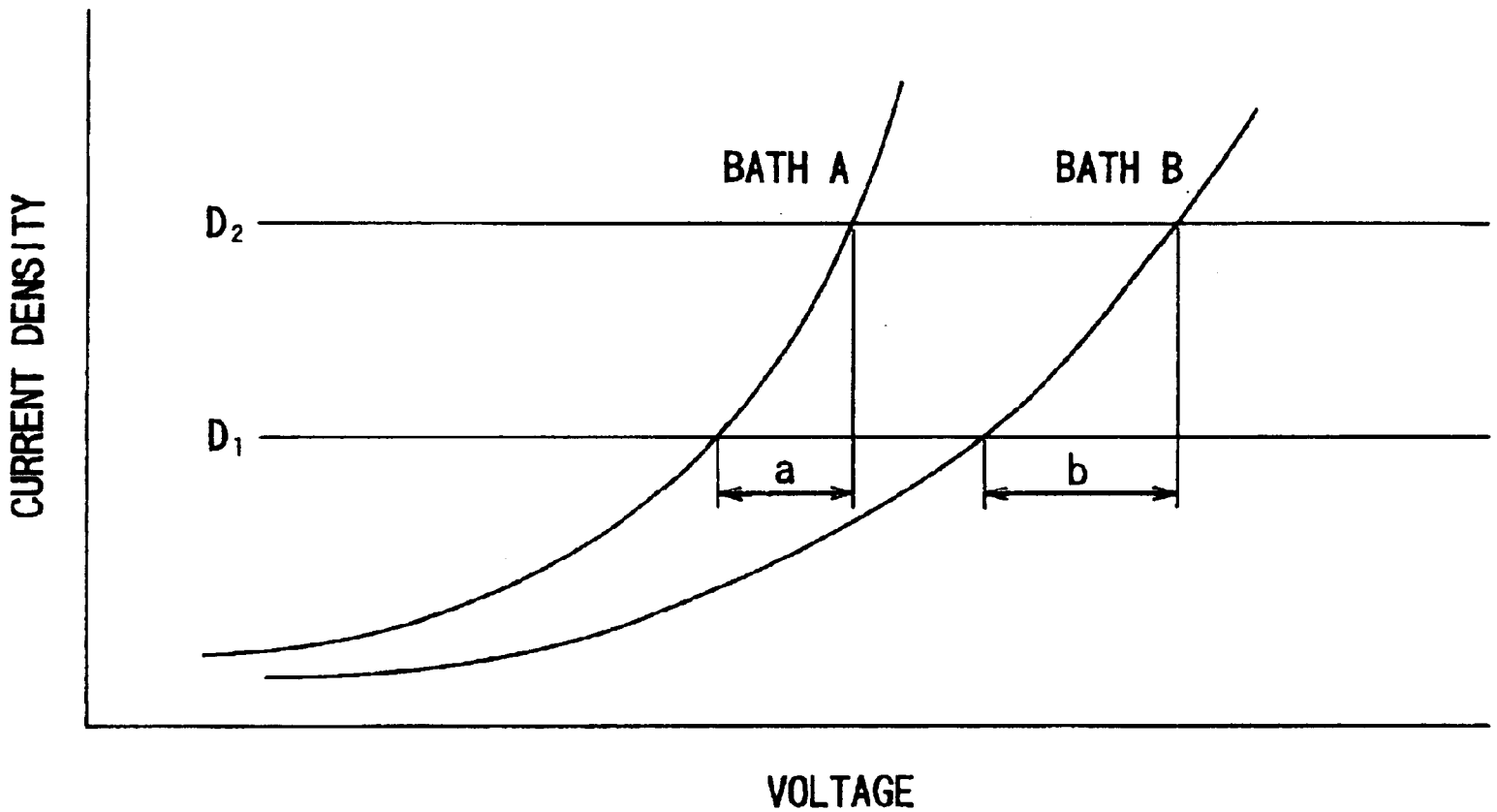
FIG. 20 is a graph showing the relationship between the voltage and the current density in two different copper-plating liquids having different polarizations.

Next, the first-stage plating is carried out in the first plating section 22*a*, using the first plating liquid, thereby reinforcing and completing the thin portion of the seed layer 7 (step 2). The first plating liquid used in the first plating section 22*a*, e.g. a plating liquid comprising copper pyrophosphate as a base, and a complexing agent such as pyrophosphoric acid, has a higher polarization than a usual copper sulfate plating liquid (second plating liquid). "High polarization" herein means that the ratio of the degree of change in voltage to the degree of change in current density is high, that is, the degree of change in current density is relative to a fluctuation of potential is low. Referring to the cathode polarization curves shown in FIG. 20, for example, the ratio $b/(D_2-D_1)$ for the bath B is higher than the ratio $a/(D_2-D_1)$ for the bath A, indicating that the bath B has a higher polarization than bath A. Thus, the plating liquid having a high polarization such as the bath B, when used in the plating of the substrate having a seed layer 7 in which a difference in film thickness exists, which produces a potential difference upon supply of electric current, can make the change in current density small. This makes it possible to raise the deposition potential and improve uniform electrodeposition property, whereby it becomes possible to deposit a plating even on the thin portion of the seed layer, which has been difficult with a usual copper sulfate plating liquid.

The complex itself and the pH adjusting agent is free from an alkali metal. Deterioration of the semiconductor properties cause by the inclusion of an alkali metal in the film can therefore be avoided.

Direct current, pulse, PR pulse, etc. may be employed as a power source. Of these, pulse and PR pulse are preferred. The use of such a power source can improve the diffusion of copper ions to thereby further improve the uniform electrodeposition property, can flow a larger electric current than direct current to thereby make the deposited copper film denser, and can shorten the plating time.

When a direct current power source is employed, an applicable current density is in the range of 0.01 $A/dm^2$–30 $A/dm^2$, preferably 0.1 $A/dm^2$–3 $A/dm^2$. In the case of a pulse power source, a current density of 0.01 $A/dm^2$–200 $A/dm^2$ is applicable. The above ranges of current density can prevent the lowering of productivity, and can prevent the occurrence of "burnt deposit". The temperature of the copper-plating liquid may be in the range of 10° C.–80° C., preferably about 25° C. When the liquid temperature is too low, the deposition efficiency is low and the physical properties of the plating become poor. When the liquid temperature is too high, the stability (uniformity) of the plating liquid is lowered, making its management difficult.

After the completion of the first-stage plating, the substrate W is, according to necessity, transported to the washing section 20 for washing by water (step 3), and is then transported to one of the second plating sections 22*b*.

Next, the second-stage plating is performed onto the surface of the substrate W in the second plating section 22*b*, using a copper sulfate plating liquid (second plating liquid) having an excellent leveling property, which has a composition of a high copper sulfate concentrate and a low sulfuric acid concentration, e.g. a composition of 100–300 g/l of copper sulfate and 10–100 g/l of sulfuric acid, and which further contains an additive for enhancing the leveling property, thereby effecting filling with copper (step 4). Since the seed layer 7 (see FIG. 39A and FIG. 40A) has been reinforced by the first-stage plating to become a complete layer without a thin portion, electric current flows evenly through the seed layer 7 in the second-stage plating, whereby the filling with copper can be completed without the formation of any voids.

For example, a nitrogen-containing organic compound may be used as an additive for enhancing the leveling property. Specific examples include phenatidine compounds; phthalocyanine compounds; polyalkylene imine, such as polyethylene imine and polybenzyl imine, or a derivative thereof; thiourea derivatives such as N-dye substituted compounds; safranine compounds such as phenosafranine, safranine azonaphthol, diethyl safranine azophenal and dimethyl safranine dimethyl aniline; polyepichlorohydrin or its derivative; phenyl thiazonium compounds such as thioflanin; and amides such as acrylamide, propylamide and polyacrylamide.

The "leveling property" herein refers to a property of giving a flat plating surface. The use of the plating liquid having an excellent leveling property can retard the growth of plating at the inlet of a fine recess. This makes it possible to fully fill the fine recesses with copper uniformly without formation of any void, and further flatten the plating surface.

The polarization range (deposition potential of copper) of the first plating liquid may be about −0.2 V or lower, preferably from about −1.5 V to about −0.2 V when an Ag—AgCl electrode is used, and the polarization range (deposition potential of copper) of the second plating liquid may be from about 0.1 V to about −0.1 V when an Ag—AgCl electrode is used.

The inside of a contact hole, especially the side wall on the lower side of a contact hole, generally has a low conductivity (high resistance, i.e. high deposition potential) because of the thin thickness of the seed layer, and therefore a copper plating is hard to deposit thereon with the use of a plating liquid having a low polarization. By using as the first plating liquid, a plating liquid which has a high polarization and which allows copper deposition only when a high voltage is applied, copper film can be deposited evenly on the entire wall of the surface of the seed layer having different thickness and deposition potential.

After the completion of the second-stage plating, the substrate W is, according to necessity, transported to the washing section 20 for washing by water (step 5). Thereafter, the substrate W is transported to the bevel-etching/chemical cleaning section 16 where the substrate W is cleaned by using a chemical liquid, and a thin copper film, etc. formed on the bevel portion of the substrate W is etched away (step 6). The substrate is then transported to the cleaning/drying section 12 for cleaning and drying (step 7). Thereafter, the substrate is returned to the cassette of the loading/unloading section 10 by the first transporting device 24 (step 8).

A process of annealing a substrate W may be performed between the Step 7 and the Step 8. When a substrate W is annealed at 200–500° C., preferably about 400° C., the electric characteristics of copper film formed on the substrate W can be improved. For example, if the bevel-etching/chemical cleaning section 16 has a supplementary function of a cleaning and drying unit, then an annealing section (annealing unit) may be provided instead of the cleaning/drying section 12.

Figure 21:
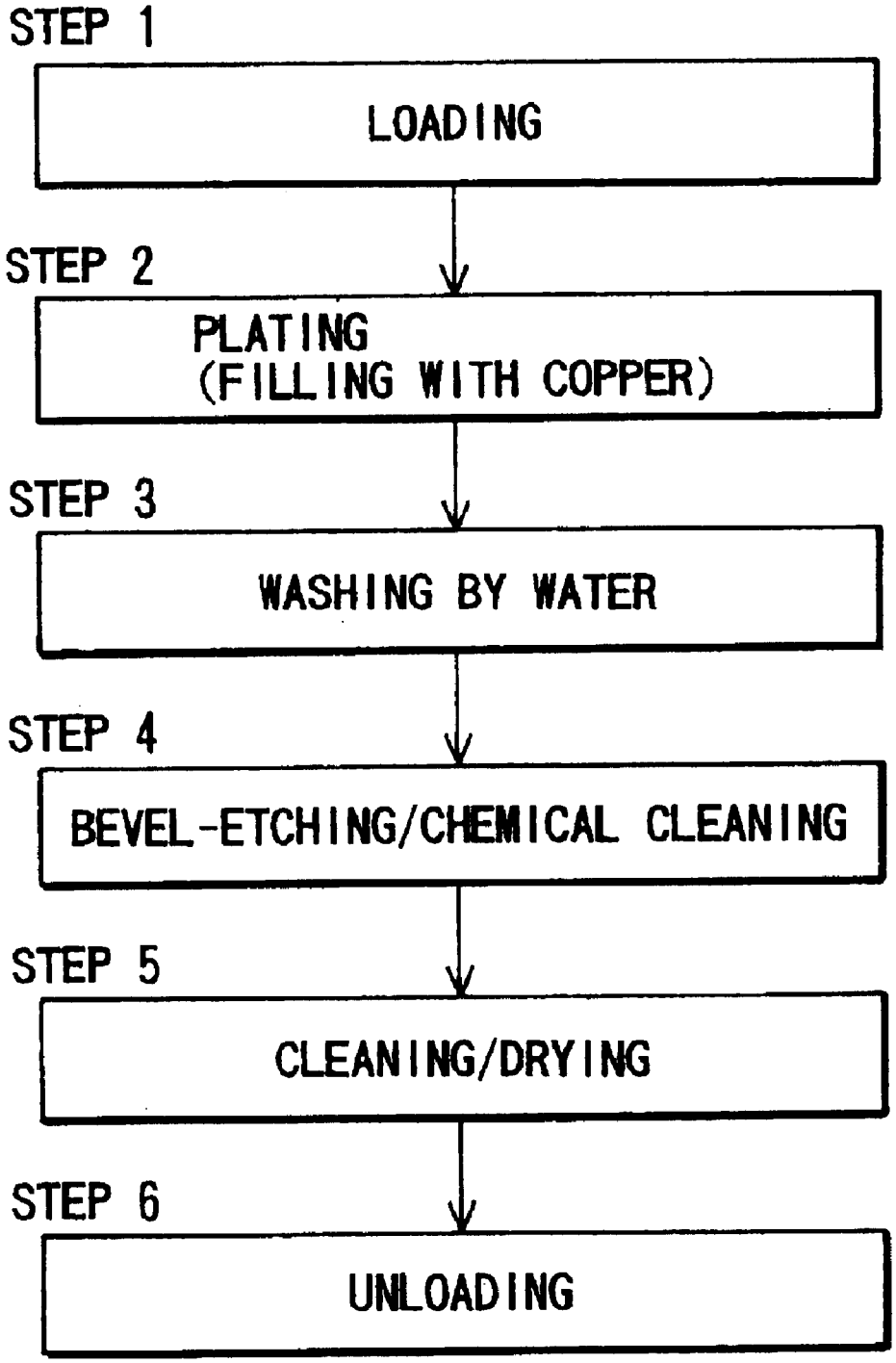
FIG. 21 is a flow diagram showing the flow of process steps according to another embodiment of the plating method of the present invention.

Another embodiment of the plating method of the present invention will be described below, by referring to FIG. 21. According to this embodiment, all of the four plating sections 22 shown in FIG. 1 are used for filling with copper. The reinforcement of the thin portion of a seed layer, carried out in the above described embodiment, is not carried out in this embodiment.

In the plating section 22, a plating liquid is used as the copper-plating liquid 45 (see FIG. 3) which contains divalent copper ions, a complexing agent and a pH adjusting agent, and further contains a thiazole additives, for example, for enhancing the copper-filling property. The other features of the plating liquid are substantially the same as the copper-plating liquid (the first plating liquid) to be used in the first plating section 22*a* according to the first embodiment of the present invention.

First, the substrate W having a seed layer 7 (see FIG. 39A) as an outer layer is taken one by one from the loading/unloading section 10 by the first transporting device 24, and is transported, via the first substrate stage 14 and the second substrate stage 18, to one of the plating sections 22 (step 1).

Next, plating is performed in the plating section 22 using the above plating liquid, thereby effecting filling with copper (step 2). The plating liquid used in this plating has the same high polarization as the first plating liquid to be used in the first plating section 22*a* according to the first embodiment of the present invention. Due to the high polarization, the plating liquid can raise the deposition potential and improve uniform electrodeposition property, whereby it becomes possible to deposit copper even on the thin portion of the seed layer, which has been difficult with a usual copper sulfate plating liquid. Further, the plating liquid can grow the plating so as to effect complete filling with copper into the fine recesses in the substrate without formation of any void. The plating conditions are substantially the same as in the first-plating according to the first embodiment of the present invention.

After the completion of plating, the substrate W is, according to necessity, transported to the washing section 20 for washing by water (step 3). Thereafter, the substrate W is transported to the bevel-etching/chemical cleaning section 16 where the substrate W is cleaned by using a chemical liquid, and a thin copper film, etc. formed on the bevel portion of the substrate W is etched away (step 4). The substrate is then transported to the cleaning/drying section 12 for cleaning and drying (step 5). Thereafter, the substrate is returned to the cassette of the loading/unloading section 10 by the first transporting device 24 (step 6).

Figure 19:
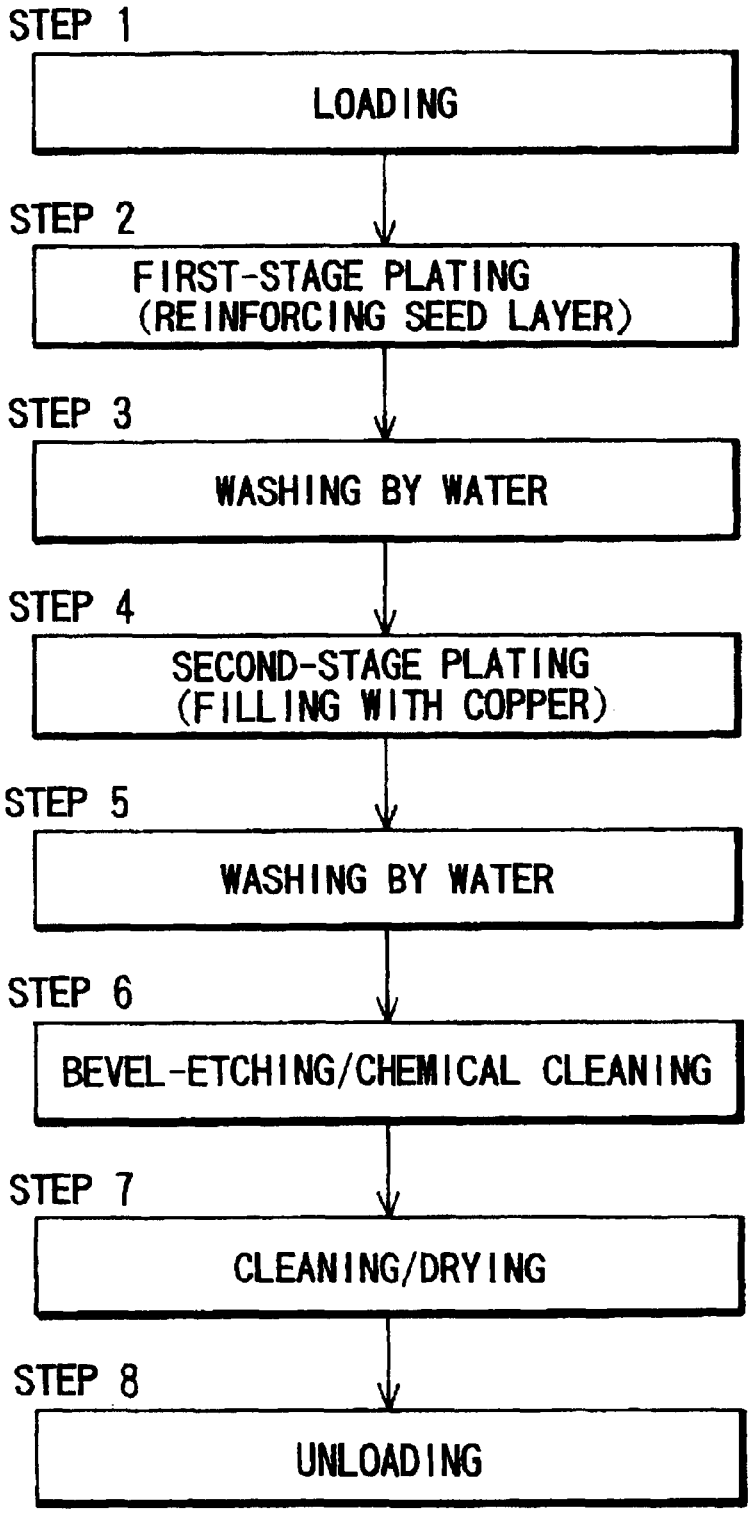
FIG. 19 is a flow diagram showing the flow of process steps according to an embodiment of the plating method of the present invention.

Annealing process may be carried out between cleaning and drying process (step 5) and unloading process (step 6) shown in FIG. 19.

Figure 22:
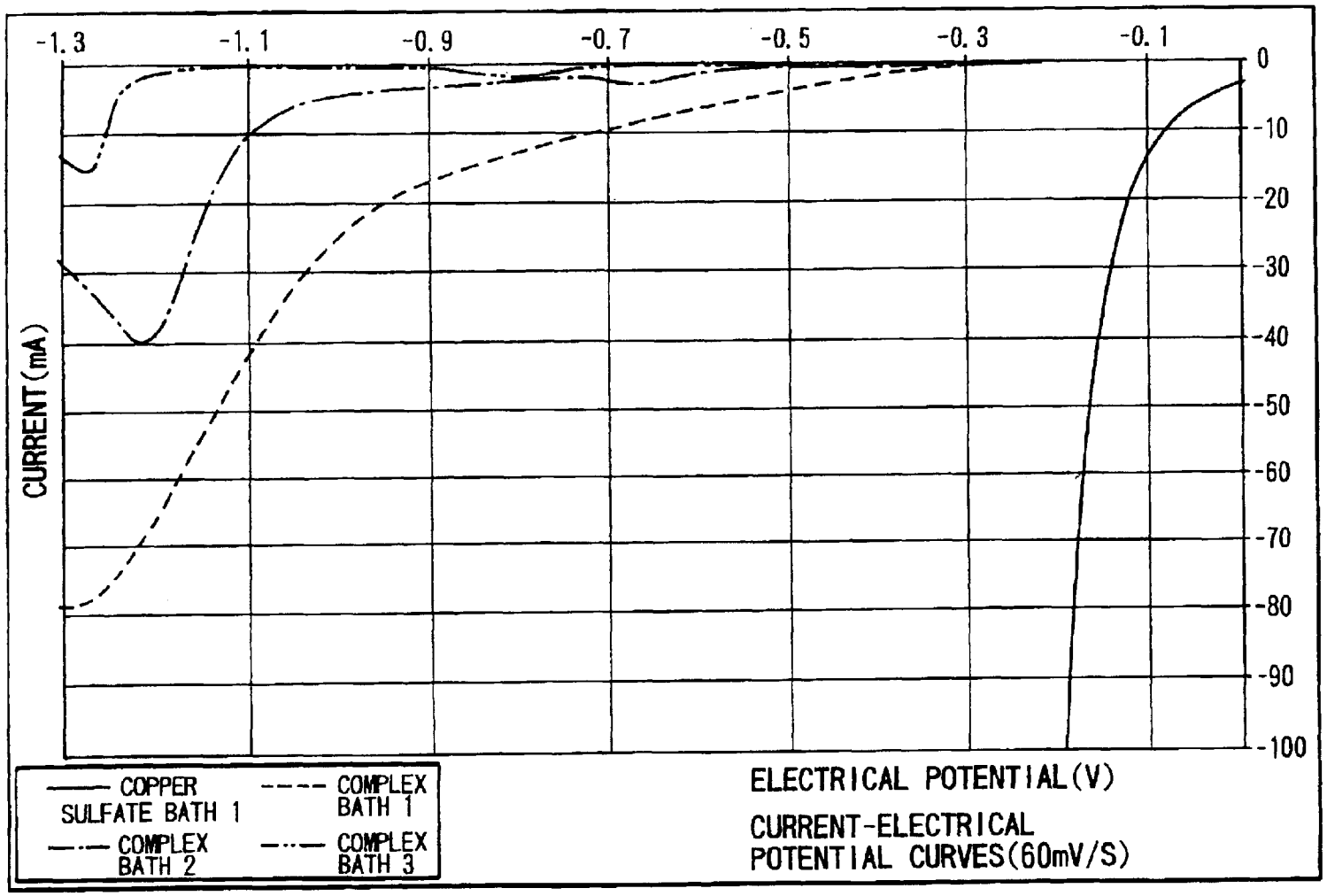
FIG. 22 is a graph showing current-electrical potential curves for the complex baths 1–3 and the copper sulfate bath 1 used in the working examples.

The present invention will now be illustrated by the following working examples. First, copper-plating liquids having the complex bath compositions 1–4 shown in Table 1 and copper-plating liquids having the copper sulfate bath compositions 1 and 2 shown in Table 2 were prepared. FIG. 22 shows current-electrical potential curves for the complex baths 1–3 and the copper sulfate bath 1. As can be seen from FIG. 22, each of the complex baths 1–3 have a higher polarization than the copper sulfate bath 1.

TABLE 1

| | A | B | C | D | E | F |
|---|---|---|---|---|---|---|
| Complex bath composition 1 | 20 | 60 | 0 | 0 | 200 | 0 |
| Complex bath composition 2 | 40 | 120 | 0 | 0 | 400 | 5 |
| Complex bath composition 3 | 0 | 0 | 10 | 30 | 0 | 0 |
| Complex bath composition 4 | 0 | 0 | 20 | 50 | 0 | 5 |

Note:
A: Copper pyrophosphate (g/L)
B: Pyrophosphoric aid (g/L)
C: Copper sulfate (g/L)
D: EDTA-4H (g/L)
E: Cholin (ml/L)
F: Organic additive (ml/L)

TABLE 2

| | A | B | C | D |
|---|---|---|---|---|
| Copper sulfate composition 1 | 200 | 50 | 0.2 | 5 |
| Copper sulfate composition 2 | 70 | 185 | 0.2 | 5 |

Note:
A: Copper sulfate (g/L)
B: Sulfuric acid (ml/L)
C: Hydrochloric acid (ml/L)
D: Organic additive (ml/L)

EXAMPLE 1

By using the copper-plating liquid having the complex bath composition 1 as the copper-plating liquid to be used in the first plating section 22*a* according to the first embodiment of the present invention, a first-stage plating (reinforcement of seed layer) was performed at a current density of 0.5 A/dm$^2$ for 25 seconds. Thereafter, by using the copper-plating liquid having the copper sulfate bath composition 1 as the copper-plating liquid for the second plating section 22*b*, a second-stage plating (filling with copper) was performed at a current density of 2.5 A/dm$^2$ for 2 minutes.

EXAMPLE 2

By using the copper-plating liquid having the complex bath composition 2 as the copper-plating liquid to be used in the plating section 22 according to the second embodiment of the present invention, plating (filling with copper) was performed at a current density of 1 A/dm$^2$ for 5 minutes.

EXAMPLE 3

By using the copper-plating liquid having the complex bath composition 3 as the copper-plating liquid to be used in the first plating section 22*a* according to the first embodiment of the present invention, a first-stage plating (reinforcement of seed layer) was performed at a current density of 0.5 A/dm$^2$ for 25 seconds. Thereafter, by using the copper-plating liquid having the copper sulfate bath composition 1 as the copper-plating liquid for the second plating section 22*b*, a second-stage plating (filling with copper) was performed at a current density of 2.5 A/dm$^2$ for 2 minutes.

EXAMPLE 4

By using the copper-plating liquid having the complex bath composition 4 as the copper-plating liquid to be used in the plating section 22 according to the second embodiment of the present invention, plating (filling with copper) was performed at a current density of 1 A/dm$^2$ for 5 minutes.

COMPARATIVE EXAMPLE 1

By using the copper-plating liquid having the copper sulfate bath composition 1, plating (filling with copper) was performed at a current density of 2.5 A/dm$^2$ for 2 minutes.

COMPARATIVE EXAMPLE 2

By using the copper-plating liquid having the copper sulfate bath composition 2, plating (filling with copper) was performed at a current density of 2.5 A/dm$^2$ for 2 minutes.

Figures 23A, 23B, 23C:
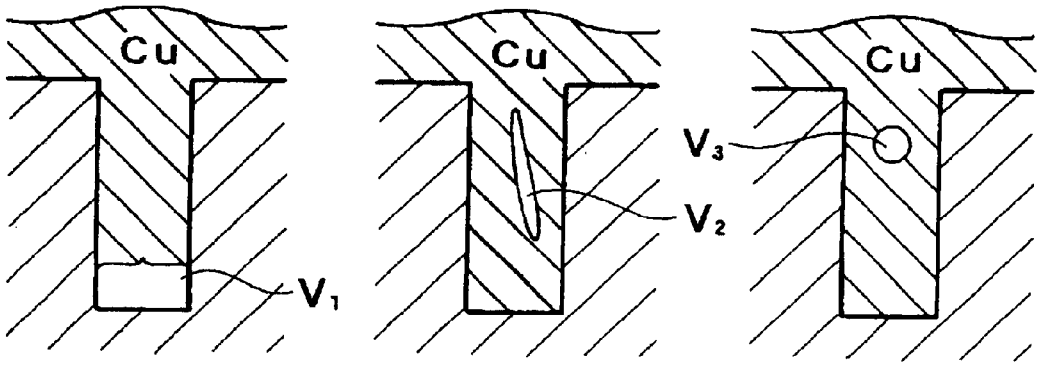
FIGS. 23A through 23C are diagrams schematically showing the respective states of poor eletrodeposition, seam void, and particulate void, as observed under SEM.

With respect to the copper platings obtained in the above Examples 1–4 and Comparative Examples 1 and 2, the state of copper plating filled with a fine recess was observed under SEM to examine the presence or absence of defects. The results are shown in Table 3 below. In Table 3, "poor electrodeposition" indicates such a state of plating as shown in FIG. 23A: no deposition of copper at the bottom of the recess, thus forming void $V_1$; "seam void" indicates the formation in the copper of a seam-like void $V_2$ as shown in FIG. 23B; and "particulate void" indicates the formation in the copper of a particulate void $V_3$ as shown in FIG. 23C.

TABLE 3

| Example No. | Poor electrodeposition | Seam void | Particulate void |
|---|---|---|---|
| Example 1 | None | None | None |
| Example 2 | None | None | None |
| Example 3 | None | None | None |

TABLE 3-continued

| Example No. | Poor electrodeposition | Seam void | Particulate void |
|---|---|---|---|
| Example 4 | None | None | None |
| Comp.Example 1 | None | Found | Found |
| Comp.Example 2 | Found | Found | Found |

The data in Table 3 demonstrates that, in Example 1–4, the filling with copper was completely effected without suffering from "poor electrodeposition" and formation of voids.

Next, copper-plating liquids having the complex bath compositions 1–4 shown in Table 4 and copper-plating liquids having the copper sulfate bath compositions 1 and 2 shown in Table 5 were prepared. By using these plating liquids, plating treatments were performed in the same manner as in Examples 1–4 and Comparative Examples 1 and 2. The results were almost the same as in the preceding examples.

TABLE 4

| | A | B | C | D | E |
|---|---|---|---|---|---|
| Complex bath composition 1 | 13 | 45 | 130 | 0 | 0 |
| Complex bath composition 2 | 26 | 98 | 260 | | 5 |
| Complex bath composition 3 | 13 | 45 | 0 | 160 | 0 |
| Complex bath composition 4 | 26 | 98 | | 320 | 5 |

Note:
A: Copper pyrophosphate (g/L)
B: Pyrophosphoric acid (g/L)
C: Cholin (ml/L)
D: TMAH (tetramethyl ammonium hydroxide) (ml/L)
E: Organic additive (ml/L)

TABLE 5

| | A | B | C | D |
|---|---|---|---|---|
| Copper sulfate composition 1 | 200 | 50 | 0.135 | 5 |
| Copper sulfate composition 2 | 70 | 185 | 0.135 | 5 |

Note:
A: Copper sulfate (g/L)
B: Sulfuric acid (ml/L)
C: Hydrochloric acid (ml/L)
D: Organic additive (ml/L)

As described hereinabove, according to the present invention, the inclusion of a complexing agent in the copper-plating liquid can enhance the polarization as the plating bath. This enables reinforcement of the thin portion of a seed layer and uniform filling with copper into the depths of fine recesses, such as trenches and holes, having a high aspect ratio. Further, the deposited plating is dense, and is freed from microvoids formation therein. Furthermore, the copper-plating liquid of the present invention, which does not contain any alkali metal nor cyanide, does not cause deterioration of a semiconductor which would otherwise be caused by electromigration due to the presence of an alkali metal and, in addition, does meet the demand for avoiding the use of a cyanide.

Figure 24:
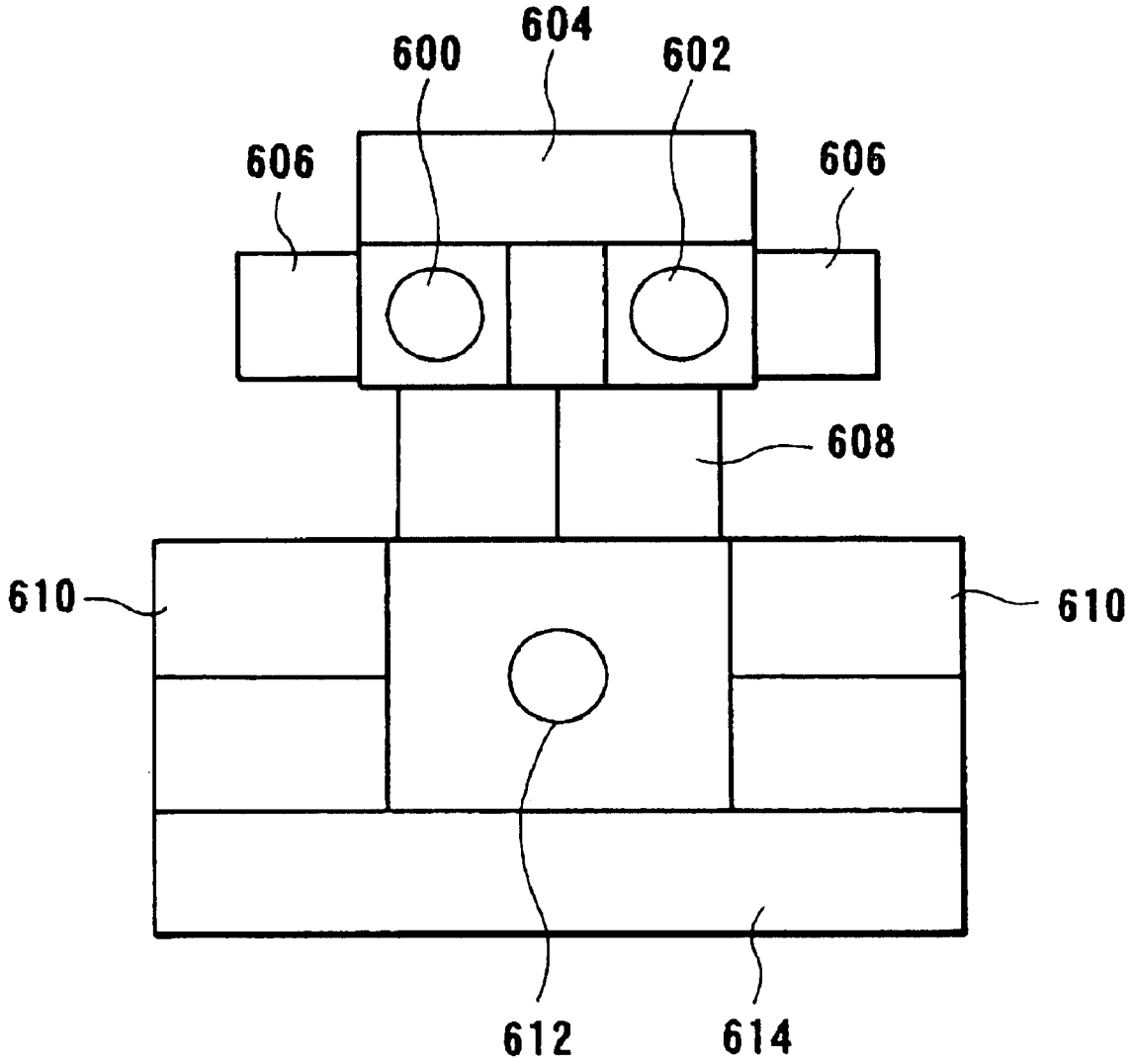
FIG. 24 is a plan view showing a layout of a plating apparatus according to another embodiment of the present invention.

FIG. 24 is a plane view of another embodiment of a plating apparatus in accordance with the present invention. The plating apparatus comprises a loading/unloading section 604, two annealing sections 606 and washing sections 608. The sections are disposed around a first transporting device 600 and a second transporting device 602. The apparatus is also provided with a plating liquid supplying system 614 for supplying a plating liquid to each plating sections 610.

When two-stage plating which consists of reinforcing a seed layer and filling with copper, as shown in FIG. 19, is carried out by this plating apparatus, at least one of the four plating sections 610 is used as a first plating section using the first plating liquid having the same composition described above, and others are used as second plating sections using the first plating liquid having the same composition described above.

Figure 25A:
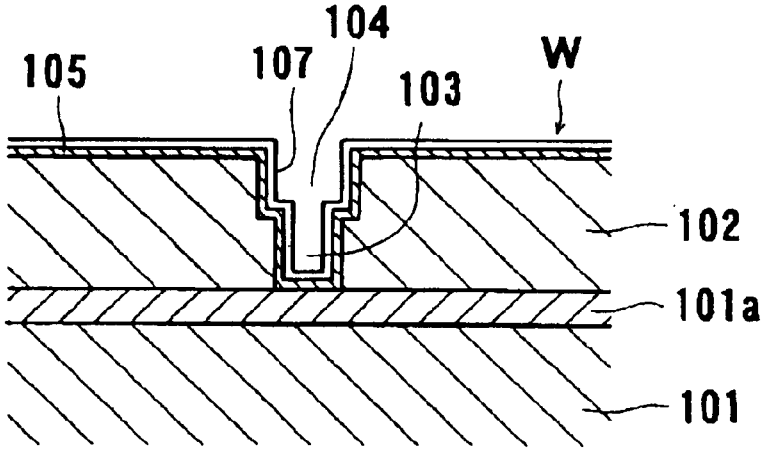
FIGS. 25A through 25C are diagram illustrating another plating steps.
Figure 25B:
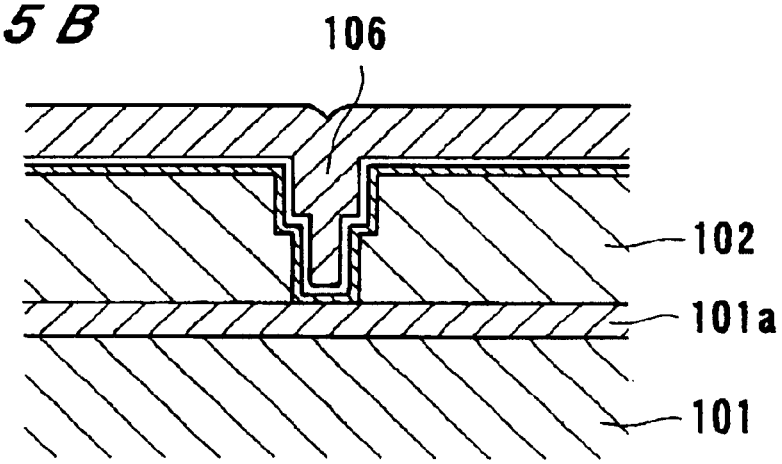
Figure 25C:
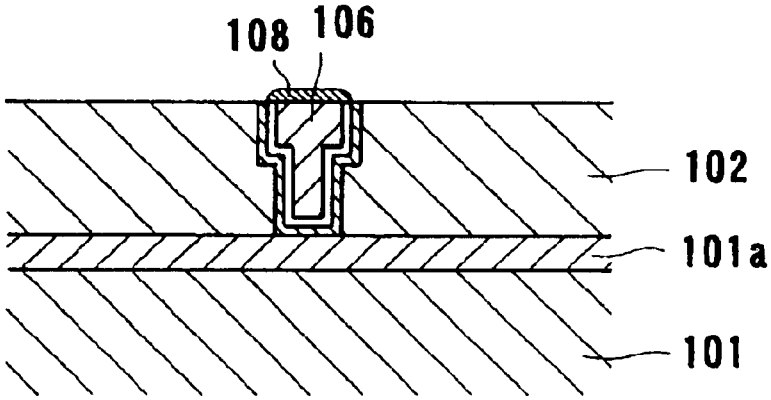

FIGS. 25A through 25C illustrate, in a sequence of process steps, an example for forming interconnects made of copper by plating a surface of a substrate, thereafter forming a protective film on the interconnects selectively by electroless plating for protecting the interconnects.

In the semiconductor substrate W, as shown in FIG. 25A, an insulating film 102 comprising $SiO_2$ is deposited on a conductive layer 101*a* of a substrate 100 on which semiconductor devices are formed, a contact hole 103 and a trench 4 for an interconnect are formed by lithography and etching technology, a barrier layer 105 comprising TiN or the like is formed thereon, and a seed layer 107 is further formed thereon. The seed layer 107 may be formed beforehand by sputtering, and a reinforcing seed layer for reinforcing the seed layer 107 may be formed thereon. As shown in FIG. 25B, copper plating is applied onto the surface of the semiconductor substrate W to fill copper into the contact hole 103 and the trench 104 of the semiconductor substrate W and deposit a copper film 106 on the insulating film 102. Thereafter, the copper film 106 on the insulating film 102 is removed by chemical mechanical polishing (CMP) to make the surface of the copper film 106, filled into the contact hole 103 and the trench 104 for an interconnect, flush with the surface of the insulating film 102, as shown in FIG. 25C. An interconnect protective film 108 is formed on the exposed metal surface.

Figure 26:
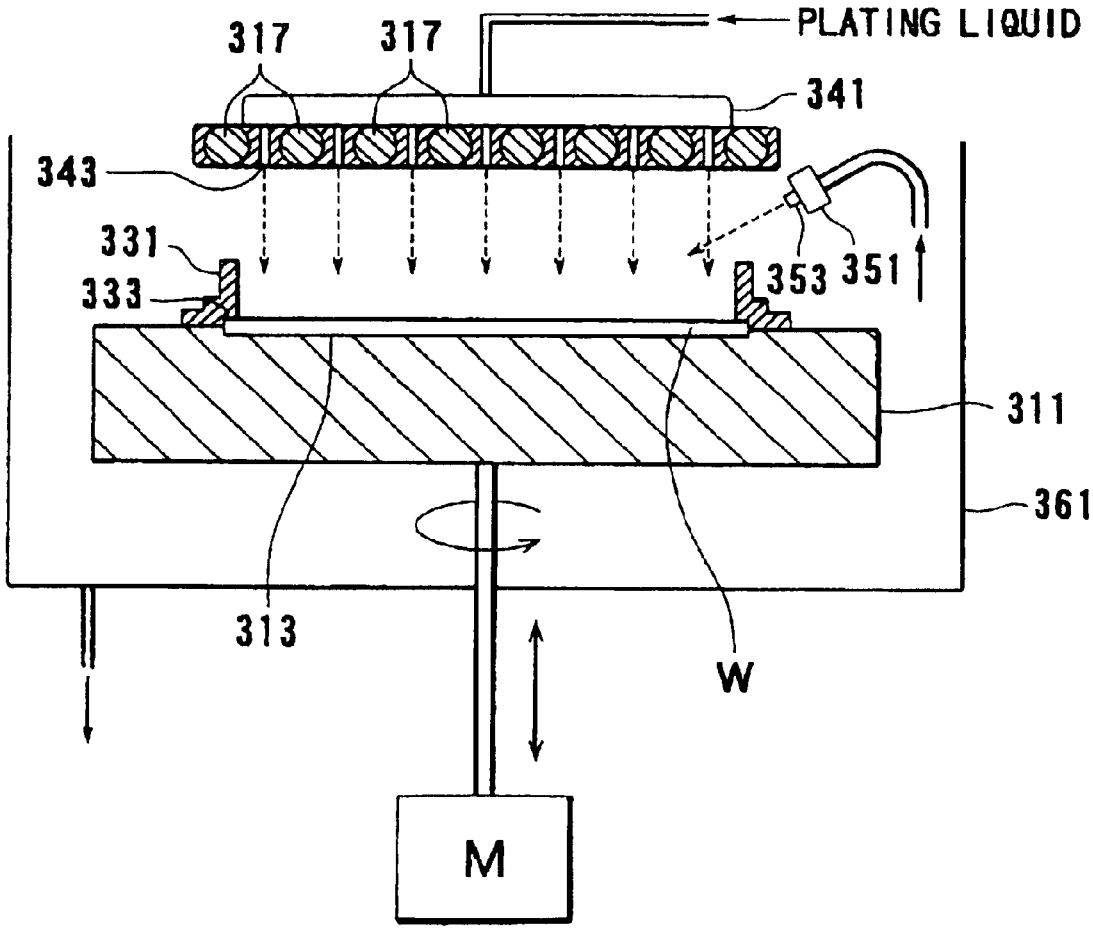
FIG. 26 is a view showing a schematic constitution of a electroless plating apparatus.

FIG. 26 is a schematic constitution drawing of the electroless plating apparatus. As shown in FIG. 26, this electroless plating apparatus comprises holding means 311 for holding a semiconductor substrate W to be plated on its upper surface, a dam member 331 for contacting a peripheral edge portion of a surface to be plated (upper surface) of the semiconductor substrate W held by the holding means 311 to seal the peripheral edge portion, and a shower head 341 for supplying a plating liquid to the surface, to be plated, of the semiconductor substrate W having the peripheral edge portion sealed with the dam member 331. The electroless plating apparatus further comprises cleaning liquid supply means 351 disposed near an upper outer periphery of the holding means 311 for supplying a cleaning liquid to the surface, to be plated, of the semiconductor substrate W, a recovery vessel 361 for recovering a cleaning liquid or the like (plating waste liquid) discharged, a plating liquid recovery nozzle (not shown) for sucking in and recovering the plating liquid held on the semiconductor substrate W, and a motor (rotational drive means) M for rotationally driving the holding means 311.

Lamp heaters 317 are disposed above the holding means 311, and the lamp heaters 317 and a shower head 341 are integrated. For example, a plurality of ring-shaped lamp heaters 317 having different radii are provided concentrically, and many nozzles 343 of the shower head 341 are open in a ring form from the gaps between the lamp heaters 317. The lamp heaters 317 may be composed of a single spiral lamp heater, or may be composed of other lamp heaters of various structures and arrangements.

The holding means 311 has a substrate placing portion 313 on its upper surface for placing and holding the semiconductor substrate W. The substrate placing portion 313 is adapted to place and fix the semiconductor substrate W. Specifically, the substrate placing portion 313 has a vacuum attracting mechanism (not shown) for attracting the semiconductor substrate W to a backside thereof by vacuum suction. This holding means 311 is adapted to be rotated by the motor M and is movable vertically by raising and lowering means (not shown). The dam member 331 is tubular, has a seal portion 333 provided in a lower portion thereof for sealing the outer peripheral edge of the semiconductor substrate W, and is installed so as not to move vertically from the illustrated position.

The shower head 341 is of a structure having many nozzles 343 provided at the front end for scattering the supplied plating liquid in a shower form and supplying it substantially uniformly to the surface, to be plated, of the semiconductor substrate W. The cleaning liquid supply means 351 has a structure for ejecting a cleaning liquid from a nozzle 353. The plating liquid recovery nozzle is adapted to be movable upward and downward and swingable, and the front end of the plating liquid recovery nozzle is adapted to be lowered inwardly of the dam member 331 to suck in the plating liquid on the semiconductor substrate W.

Next, the operation of the electroless plating apparatus will be described. First, the holding means 311 is lowered from the illustrated state to provide a gap of a predetermined dimension between the holding means 311 and the dam member 331, and the semiconductor substrate W is placed on and fixed to the substrate placing portion 313. An 8 inch wafer, for example, is used as the semiconductor substrate W.

Then, the holding means 311 is raised to bring its upper surface into contact with the lower surface of the dam member 331 as illustrated, and the outer periphery of the semiconductor substrate W is sealed with the seal portion 333 of the dam member 331. At this time, the surface of the semiconductor substrate W is in an open state.

Then, the semiconductor substrate W itself is directly heated by the lamp heaters 317 to render the temperature of the semiconductor substrate W, for example, 70° C. (maintained until termination of plating). Then, the plating liquid heated, for example, to 50° C. is ejected from the shower head 341 to pour the plating liquid over substantially the entire surface of the semiconductor substrate W. Since the surface of the semiconductor substrate W is surrounded by the dame member 331, the poured plating liquid is all held on the surface of the semiconductor substrate W. The amount of the supplied plating liquid may be a small amount which will become a 1 mm thickness (about 30 ml) on the surface of the semiconductor substrate W. The depth of the plating liquid held on the surface to be plated may be 10 mm or less, and may be even 1 mm as in this embodiment. If a small amount of the supplied plating liquid is sufficient as described above, the heating apparatus for heating the plating liquid may be of a small size. In this embodiment, the temperature of the semiconductor substrate W is raised to 70° C., and the temperature of the plating liquid is raised to 50° C. by heating. Thus, the surface, to be plated, of the semiconductor substrate W becomes, for example, 60° C., and hence a temperature optimal for a plating reaction can be achieved. If the semiconductor substrate W itself is adapted to be heated as described above, the temperature of the plating liquid requiring a great electric power consumption for heating need not be raised so high. This is preferred, because the electric power consumption can be decreased, and a change in the property of the plating liquid can be prevented. The electric power consumption for heating of the semiconductor substrate W itself may be small, and the amount of the plating liquid stored on the semiconductor substrate W is also small. Thus, heat retention of the semiconductor substrate W by the lamp heaters 317 can be performed easily, and the capacity of the lamp heaters 317 may be small, and the apparatus can be made compact. If means for directly cooling the semiconductor substrate W itself is used, switching between heating and cooling may be performed during plating to change the plating conditions. Since the plating liquid held on the semiconductor substrate is in a small amount, temperature control can be performed with good sensitivity.

The semiconductor substrate W is instantaneously rotated by the motor M to perform uniform liquid wetting of the surface to be plated, and then plating of the surface to be plated is performed in such a state that the semiconductor substrate W is in a stationary state. Specifically, the semiconductor substrate W is rotated at 100 rpm or less for only 1 second to uniformly wet the surface, to be plated, of the semiconductor substrate W with the plating liquid. Then, the semiconductor substrate W is kept stationary, and electroless plating is performed for 1 minute. The instantaneous rotating time is 10 seconds or less at the longest.

After completion of the plating treatment, the front end of the plating liquid recovery nozzle is lowered to an area near the inside of the dam member 331 on the peripheral edge portion of the semiconductor substrate W to suck in the plating liquid. At this time, if the semiconductor substrate W is rotated at a rotational speed of, for example, 100 rpm or less, the plating liquid remaining on the semiconductor substrate W can be gathered in the portion of the dam member 331 on the peripheral edge portion of the semiconductor substrate W under centrifugal force, so that recovery of the plating liquid can be performed with a good efficiency and a high recovery rate. The holding means 311 is lowered to separate the semiconductor substrate W from the dam member 331. The semiconductor substrate W is started to be rotated, and the cleaning liquid (ultrapure water) is jetted at the plated surface of the semiconductor substrate W from the nozzle 353 of the cleaning liquid supply means 351 to cool the plated surface, and simultaneously perform dilution and cleaning, thereby stopping the electroless plating reaction. At this time, the cleaning liquid jetted from the nozzle 353 may be supplied to the dam member 331 to perform cleaning of the dam member 331 at the same time. The plating waste liquid at this time is recovered into the recovery vessel 361 and discarded.

The plating liquid once used is not reused, but thrown away. As described above, the amount of the plating liquid used in this apparatus can be made very small, compared with that in the prior art. Thus, the amount of the plating liquid which is discarded is small, even without reuse. In some cases, the plating liquid recovery nozzle 365 may not be installed, and the plating liquid which has been used may be recovered as a plating waste liquid into the recovery vessel 361, together with the cleaning liquid.

Then, the semiconductor substrate W is rotated at a high speed by the motor M for spin-drying, and then the semiconductor substrate W is removed from the holding means 311.

Figure 27:
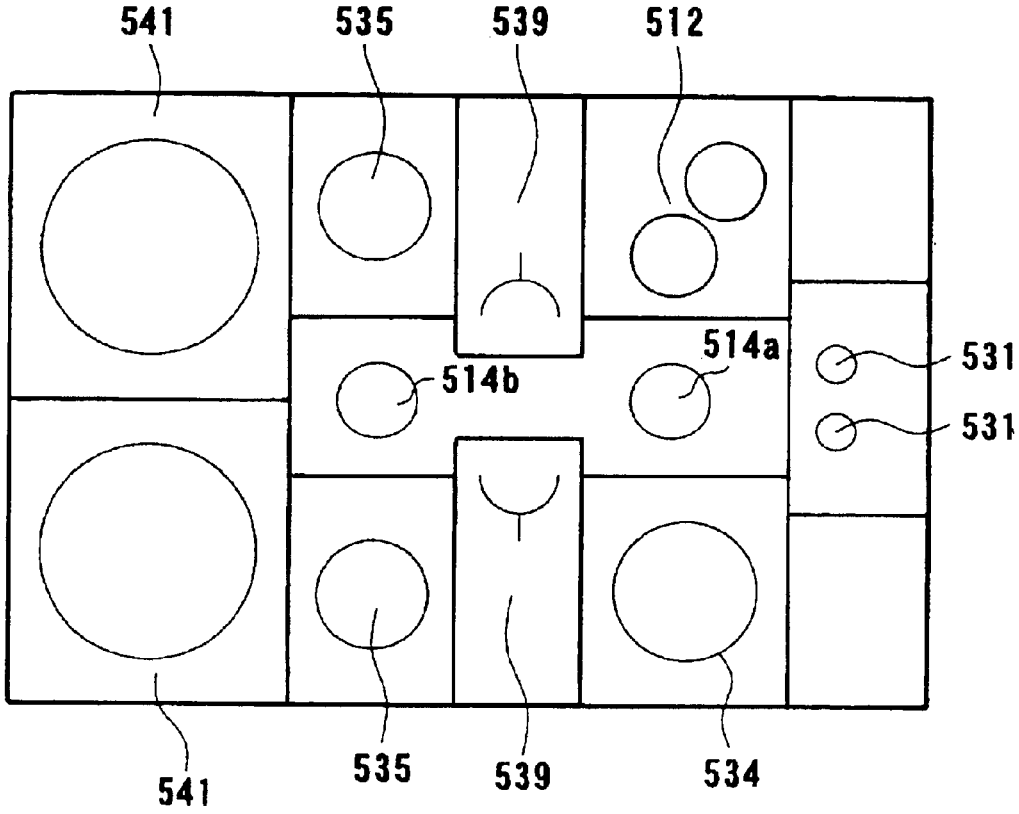
FIG. 27 is a plan view showing a layout of a plating apparatus according to still another embodiment of the present invention.

FIG. 27 is a plan view showing another embodiment of a plating apparatus which includes polishing units integrally so that a surface of a substrate can be polished immediately after plating. This plating apparatus comprises substrate cassettes 531, 531 for loading and unloading, plating section 512, cleaning sections 535, 535 for cleaning substrates, two transporting devices 514*a*, 514*b*, reversing machines 539, 539, and polishing units (substrate processing modules) 541, 541, and spin dryer 534.

The flow of a substrate W is, for example, as follows: First, the transporting device 514*a* withdraws the substrate W before treatment from one of the substrate cassettes 531 for loading. After plating treatment is performed by the plating section 512, the transporting device 514*a* transfers the substrate W to one of the reversing machines 539, which directs its treated surface downward. Then, the substrate W is transferred to the other transporting device 514*b*. The transporting device 514*b* transfers the substrate W to one of the polishing units 541 in which predetermined polishing is performed. The substrate W after polishing is withdrawn by the transporting device 514*b*, and cleaned by one of the cleaning sections 535. Then, the substrate W is transferred to the other polishing unit 541 where it is polished again, and the substrate W is transported by the transporting device 514*b* to the other cleaning section 535 where it is cleaned. The substrate W after cleaning is transported by the transporting device 514*b* to the other reversing machine 539 where its treated surface is turned over to face upward. Then, the substrate W is transported by the transporting device 514*a* to the spin dryer 534 in which spin-drying is carried out, and the substrate W is accommodated again by the transporting device 514*a* in the substrate cassette 531 for unloading.

Figure 28:
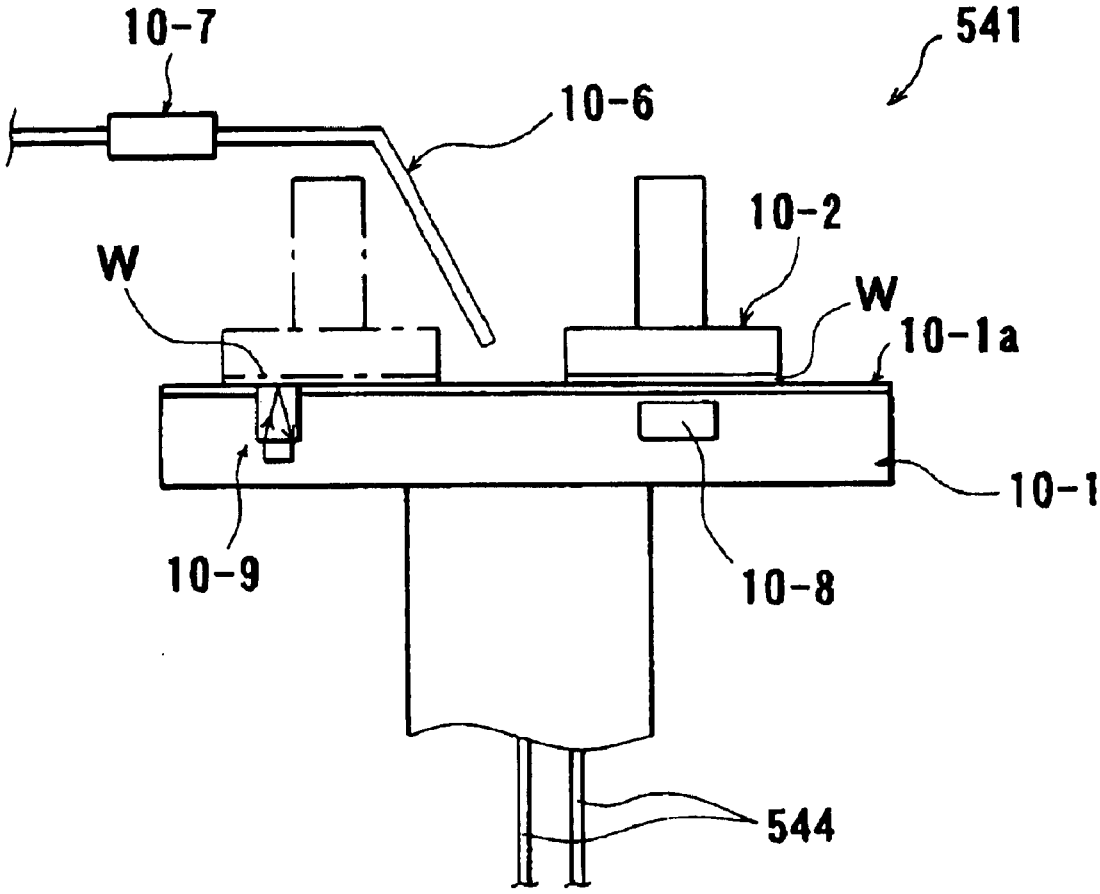
FIG. 28 is a view showing a schematic constitution of a polishing unit.
Figure 39B:
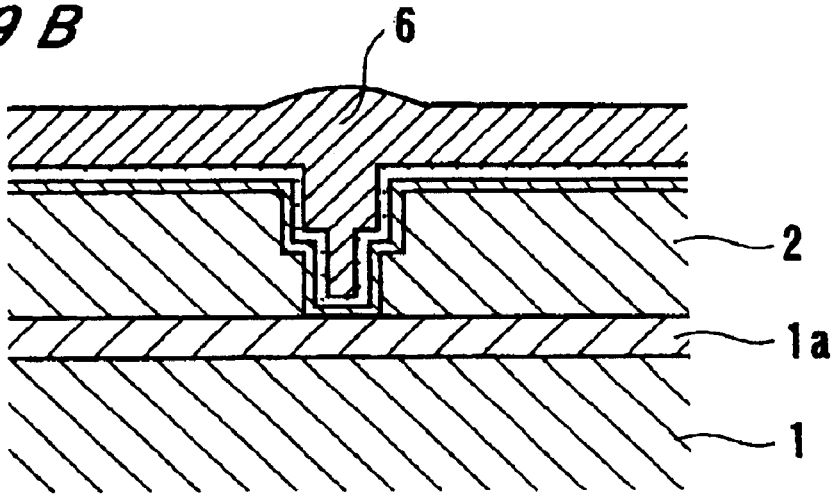
Figure 39C:
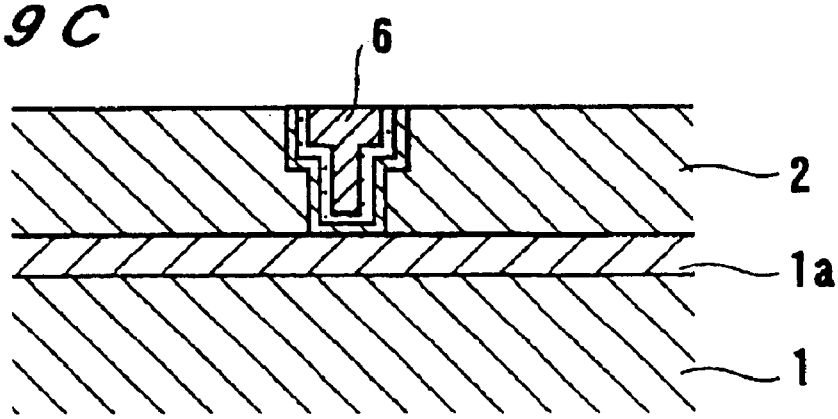

FIG. 28 shows an embodiment of the polishing unit 541 of this type. As shown in FIG. 28, the top ring 10-2 attracts the semiconductor substrate w by suction, and brings the surface of the plated copper film 6 (see FIG. 39B) of the semiconductor substrate W into contact with a polishing surface 10-1*a* of the polishing table 10-1 under pressure to perform a polishing. With the polishing, the plated copper film 6 is basically polished. The polishing surface 10-1*a* of the polishing table 10-1 is composed of foamed polyurethane such as IC1000, or a material having abrasive grains fixed thereto or impregnated therein. Upon relative movements of the polishing surface 10-1*a* and the semiconductor substrate W, the plated copper film 6 is polished.

Silica, alumina, ceria, or the like is used as abrasive grains for performing polishing of the plated copper film 6, or as a slurry ejected from a slurry nozzle 10-6. A mainly acidic material for oxidizing Cu, such as hydrogen peroxide, is used as an oxidizing agent. A temperature controlled fluid piping 544 for passing a liquid whose temperature is adjusted to a predetermined value is connected to the interior of the polishing table 10-1 in order to maintain the temperature of the polishing table 10-1 at a predetermined value. A temperature regulator 10-7 is provided on the slurry nozzle 10-6 in order to maintain the temperature of the slurry at a predetermined value. Water or the like used for dressing is also controlled in temperature, although this is not shown. In this manner, temperature of the polishing table 10-1, the temperature of the slurry, and the temperature of water or the like used for dressing are maintained at predetermined values, whereby the chemical reaction rate is kept constant. Particularly, for the polishing table 10-1, ceramics with high thermal conductivity, such as alumina or SiC, are used.

An eddy current film thickness measuring instrument 10-8 or an optical film thickness measuring instrument 10-9 provided in the polishing table 10-1 is used for detection of an end point of the polishing. Film thickness measurement of the plated copper film 6, or surface detection of the barrier layer 5 (see FIG. 39A) is performed, and when the film thickness of the plated Cu film 6 reaches zero or when the surface of the barrier layer 5 is detected, polishing (primary polishing) is judged to have reached its end point.

Figure 29:
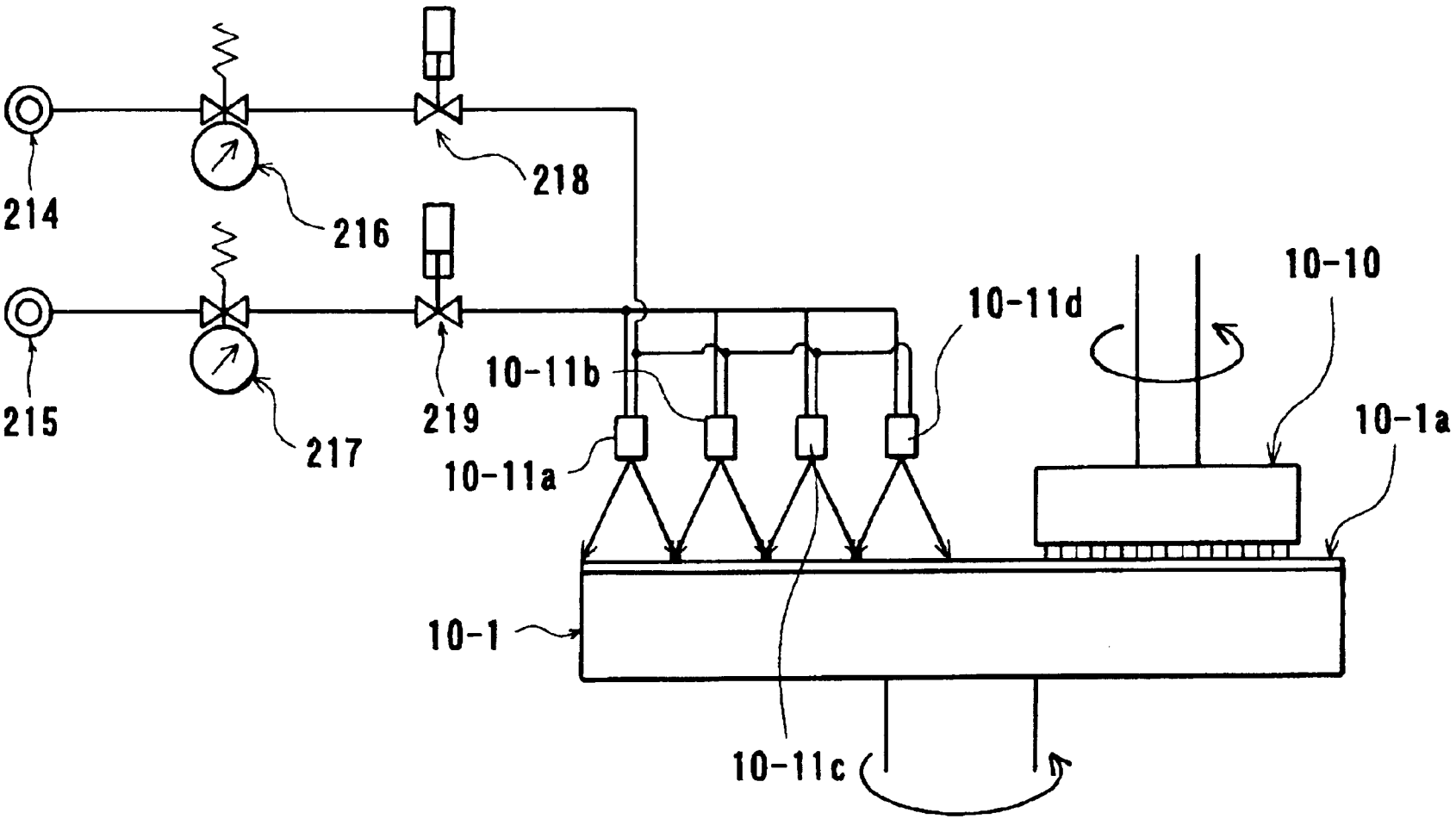
FIG. 29 is a view showing a schematic constitution of a cleaning mechanism for cleaning the polishing table.

FIG. 29 is a view showing the constitution of a cleaning mechanism for cleaning the polishing surface 10-1*a* of the polishing table 10-1. As illustrated, a plurality of (four in the drawing) mixing nozzles 10-11*a* to 10-11*d* for mixing pure water and a nitrogen gas and ejecting the mixture are disposed above the polishing table 10-1. Each of the mixing nozzles 10-11*a* to 10-11*d* is supplied with a nitrogen gas whose pressure has been controlled by a regulator 216 from a nitrogen gas supply source 214 through an air operator valve 218, and is also supplied with pure water whose pressure has been controlled by a regulator 217 from a pure water supply source 215 through an air operator valve 219.

The mixed gas and liquid undergo changes in parameters, such as the pressure and temperature of the liquid and/or gas and the nozzle shape, by the nozzles. The liquid to be supplied is transformed by nozzle jetting as follows: ① formation of liquid fine particles, ② formation of solid fine particles upon solidification of the liquid, ③ gasification of the liquid upon evaporation (hereinafter, ①, ②, ③ are called atomization). A mixture of a liquid-based component and a gas component is jetted, with predetermined directional properties, toward the polishing surface on the polishing table 10-1.

When the polishing surface 10-1*a* is to be regenerated (dressed) upon relative movements of the polishing surface 10-1*a* and the dresser 10-10, a mixed fluid of pure water and a nitrogen gas is ejected from the mixing nozzles 10-11*a* to 11-11*d* toward the polishing surface 10-1*a* to clean it. The pressure of the nitrogen gas and the pressure of pure water can be set independently. In the present embodiment, manually driven regulators are used along with a pure water line and a nitrogen line, but regulators whose setting pressures can be changed based on external signals may be used. As a result of cleaning of the polishing surface 10-1*a* using the above-described cleaning mechanism, the slurry remaining on the polishing surface 10-1*a* in the polishing step could be removed by performing cleaning for 5 to 20 seconds.

Figure 30:
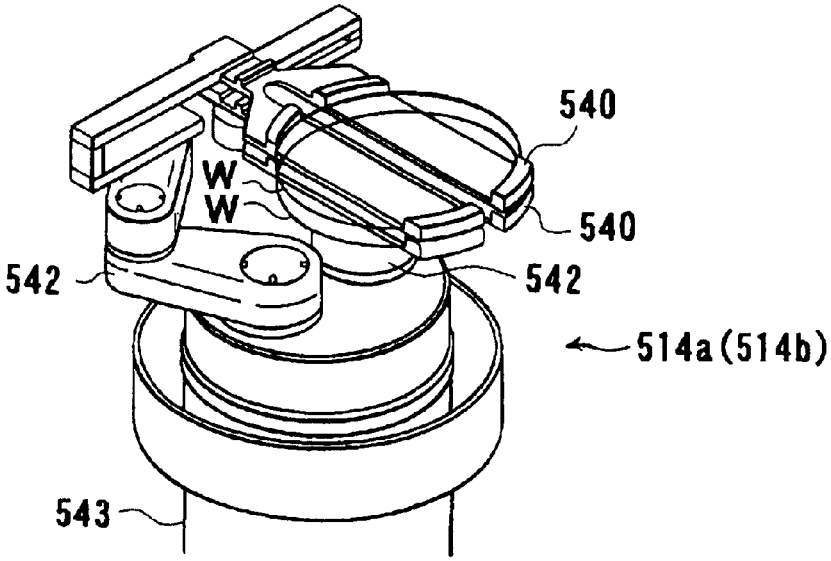
FIG. 30 is a perspective view showing a transporting device.
Figure 31A:
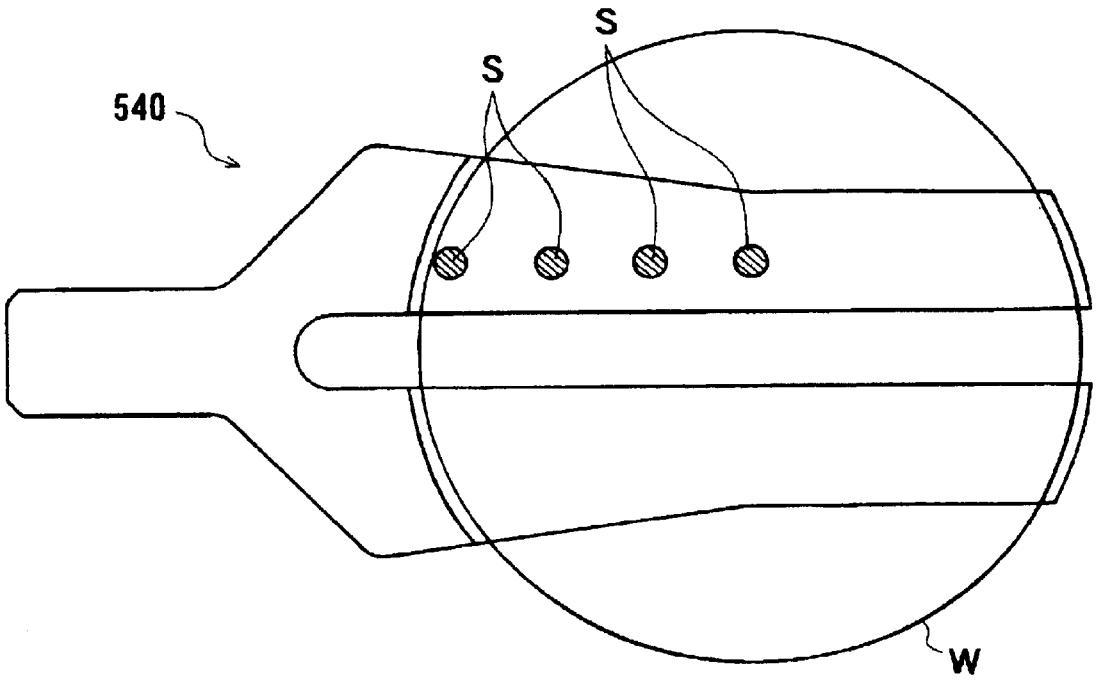
FIGS. 31A and 31B are views showing a robot hand attached to the transporting device.
Figure 31B:
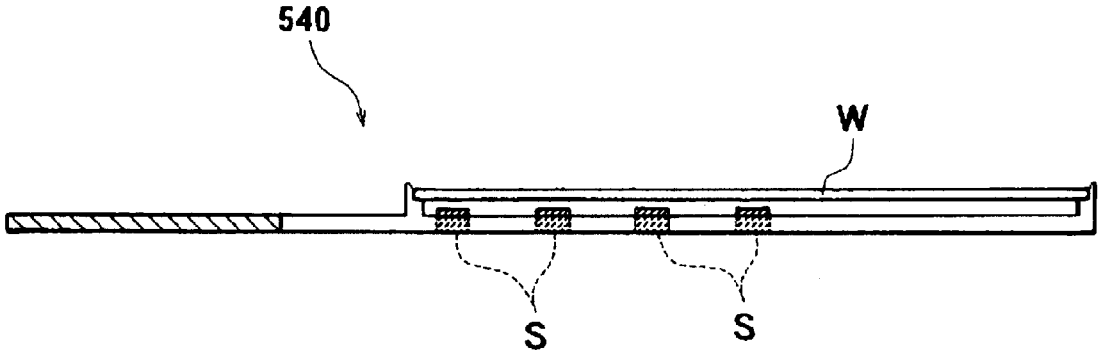

FIG. 30 is a perspective view showing the transporting device 514*a* (514*b*). FIGS. 31A and 31B are views showing a robot hand 540 attached to the transporting device 514*a* (514*b*), and FIG. 31A is a plan view and FIG. 31B is a side sectional view.

The transporting device 514*a* (514*b*) is constituted by attaching the robot hands 540, 540 to the respective front ends of two arms 542, 542 mounted on an upper portion of a robot body 543. The two robot hands 540, 540 are arranged so as to be placed vertically one above the other via a predetermined gap. The arms 542 expand and contract to enable a substrate W placed on the robot hand 540 to be transported in a before and after direction. Also, the robot body 543 rotates and/or moves to permit transportation of the substrate W in an arbitrary direction.

As shown in FIGS. 31A and 31B, four film thickness sensors S are directly attached, in a buried state, to the robot hand 540. Any film thickness sensor S may be used, if it can measure the film thickness. Preferably, an eddy current sensor is used. The eddy current sensor generates eddy currents, and detects the frequencies or losses of electric currents which have passed through the substrate W and returned, thereby measuring the film thickness. The eddy current sensor is used in a non-contact manner. An optical sensor is also preferred as the film thickness sensor S. The optical sensor irradiates a sample with light, and can directly measure film thickness based on information on reflected light. The optical sensor is capable of measuring film thickness of not only a metal film, but also an insulating film such as an oxide film. The positions of installation of the film thickness sensors S are not limited to the illustrated positions, and the film thickness sensor S is attached in an arbitrary number at a location there measurement is to be made. The robot hand 540 is available as a dry hand handling a dry substrate W, or as a wet hand handling a wet substrate W. The film thickness sensor S can be attached to either hand. When the transporting device 514*a* (514*b*) is used in a plating section, however, there is need to measure the film thickness of the substrate W in such a state that only the seed layer is initially provided. Thus, it is necessary to measure the film thickness of the substrate W, initially in a dry state, which is placed in the substrate cassettes 510, 510 (see FIG. 27). Hence, it is desirable to attach the film thickness sensor S to the dry hand.

Signals detected by the film thickness sensors S are sent to an arithmetic unit where an arithmetic operation, such as calculation of a difference between the film thickness of the substrate W before treatment and the film thickness of the substrate W after treatment, is performed and the film thickness is outputted onto a predetermined display or the like. Any arithmetic method may be used, if it can measure the film thickness appropriately.

According to the present embodiment, since the film thickness can be measured while the robot hand 540 is transporting the substrate W, there is no need to provide a film thickness measuring step separately during the substrate treatment process, and the throughput is not decreased. Since the film thickness sensors S are attached to the robot hand 540, a space saving can be actualized.

Figure 32A:
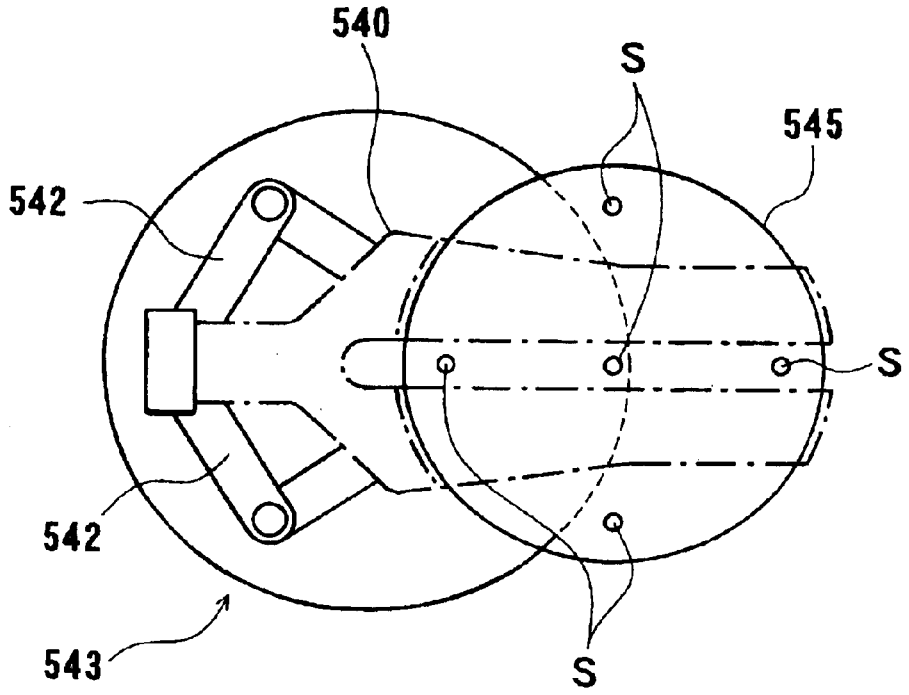
FIGS. 32A and 32B are views showing another transporting device.
Figure 32B:
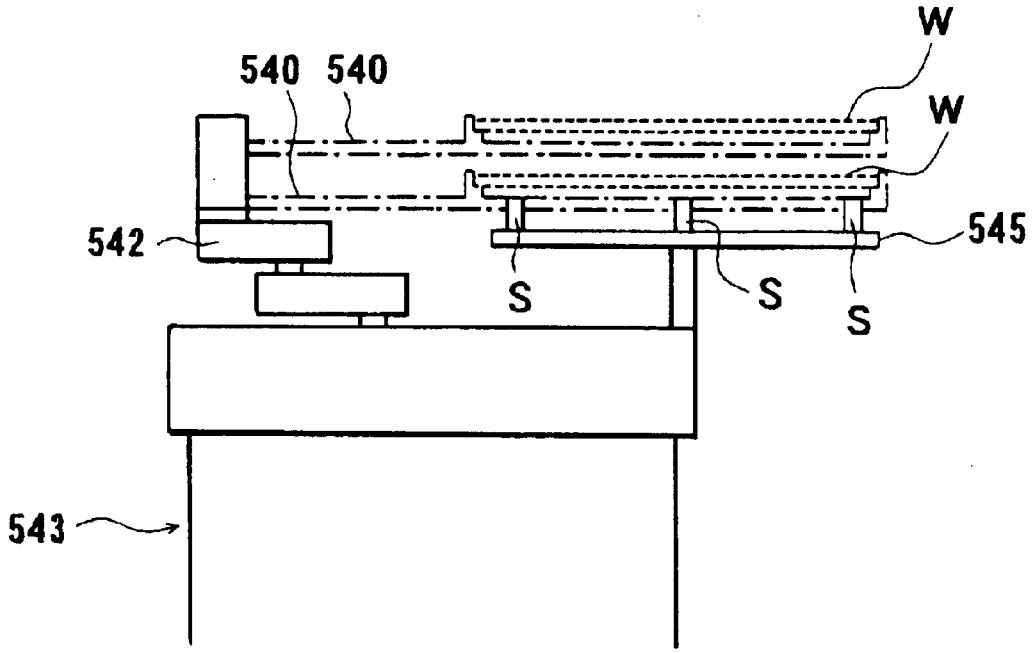

FIGS. 32A and 32B are views showing another embodiment of the transporting devices 514*a* (514*b*). FIG. 32A is a schematic plan view, while FIG. 32B is a schematic side view. As shown in FIGS. 32A and 32B, according to this embodiment, five film thickness sensors S are attached to the robot body 543, and positioned below the robot hand 540. That is, a disk-shaped mounting plate 545 of substantially the same size as the substrate W is located below the robot hand 540, and the five film thickness sensors S are attached onto the mounting plate 545. The mounting plate 545 is fixed to the robot body 543, but may be fixed to other members.

Each of the film thickness sensors S is attached at position where the film thickness sensor S do not overlap with the robot hand 540 as illustrated, whereby the film thickness can be measured in a wide area of the entire substrate W. The present embodiment can also achieve a space saving, and can perform measurement in a very short time. By stopping the substrate W above the mounting plate 545, measurement of the film thickness at fixed points of the substrate W can be made. If the substrate W on the robot hand 540 is caused to pass over the mounting plate 545 without stopping, measurement during scanning becomes possible. Since the film thickness sensors S are integral with the robot body 543, stable detection can be performed. If the mounting plate 545 is fixed to other members in place of the robot body 543, it becomes possible to adjust the distance between the substrate W and the sensors by arbitrarily varying the height of the robot hand.

The construction in which signals after detection are sent to the arithmetic unit to measure the film thickness is the same as in the embodiment shown in FIGS. 31A and 31B. However, in the case of measurement simultaneous with scanning, the points of measurement change with the passage of time, so that it is preferred to perform computations by the method of moving averages and calculate the film thickness.

Figure 33A:
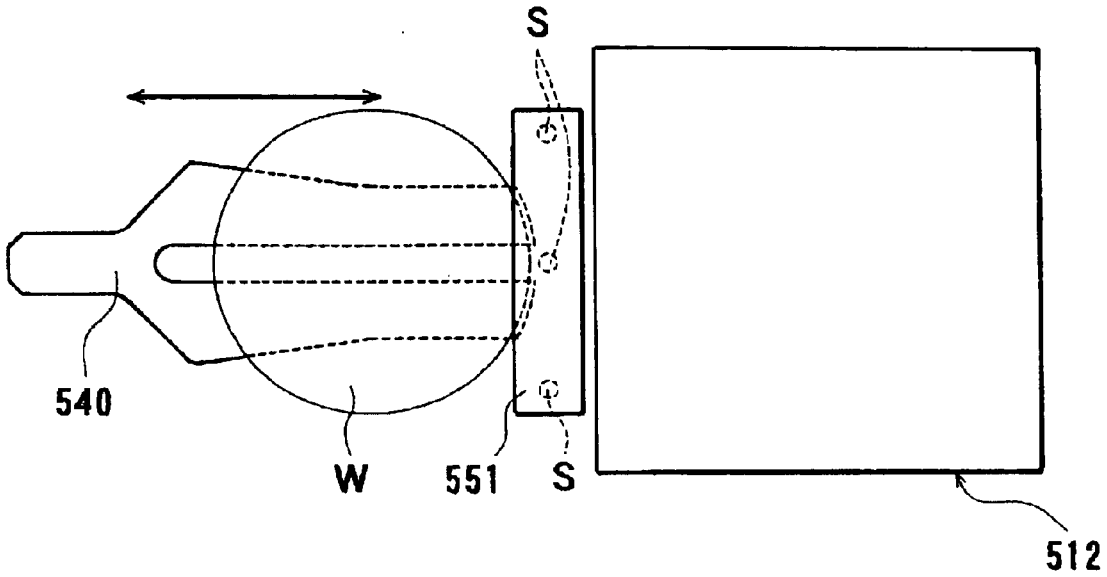
FIGS. 33A and 33B are views showing another film thickness measurement.
Figure 33B:
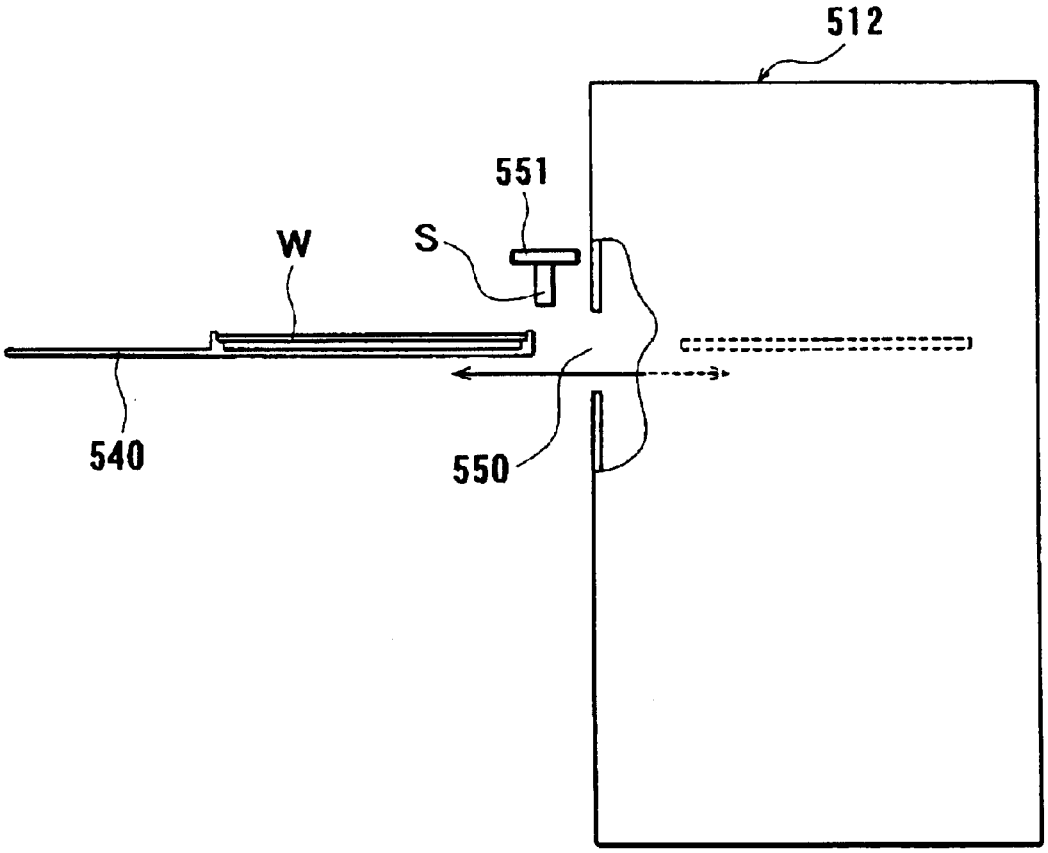

FIGS. 33A and 33B are views showing another embodiment of the film thickness measurement. FIG. 33A is a schematic plan view, and FIG. 33B is a schematic side view. In the embodiment shown in FIGS. 33A and 33B, three film thickness sensors S are provided on an upper portion of an exit and entrance portion 550 of the plating section 512 shown in FIG. 27. That is, a rectangular mounting plate 551 is disposed above the exit and entrance portion 550, and the three film thickness sensors S are attached in series to a lower surface of the mounting plate 551. The mounting plate 551 may be fixed to the plating section 512, or may be fixed to the robot body 543 of the transporting device 514*a* (514*b*), or may be fixed to other members.

According to such a constitution, the film thickness sensors S scan the substrate W when the substrate W is carried into and withdrawn from the plating section 512. This is suitable for scan measurement. By providing in series of the film thickness sensors S as in this embodiment, arbitrary points on the substrate W can be measured by scanning. By arbitrarily varying the height of the robot hand, it becomes possible to adjust the distance between the substrate W and the sensors.

Signals detected by the film thickness sensors S are computed by an arithmetic unit. In the case of scan measurement, it is desirable to perform computation by the method of moving averages.

The film thickness sensors S may be disposed near the exit and entrance, where the substrate W is introduced and withdrawn, of the polishing unit 541 shown in FIG. 27. When the substrate W is carried into the polishing unit 541, the surface, to be treated, of the substrate W faces downward. Thus, it is preferred to dispose the film thickness sensors S on a lower side of the location of the polishing unit 541 where the substrate W is carried in (of course, even when the film thickness sensors S are installed on the upper side of such location, measurement of the film thickness is possible, but installation on the lower side results in a higher accuracy). After polishing is completed, the treated surface of the substrate W is in a wet state. The use of film thickness sensors capable of measurement even in a wet condition makes it possible to measure the film thickness by the same method as in the plating section 512.

Figure 34:
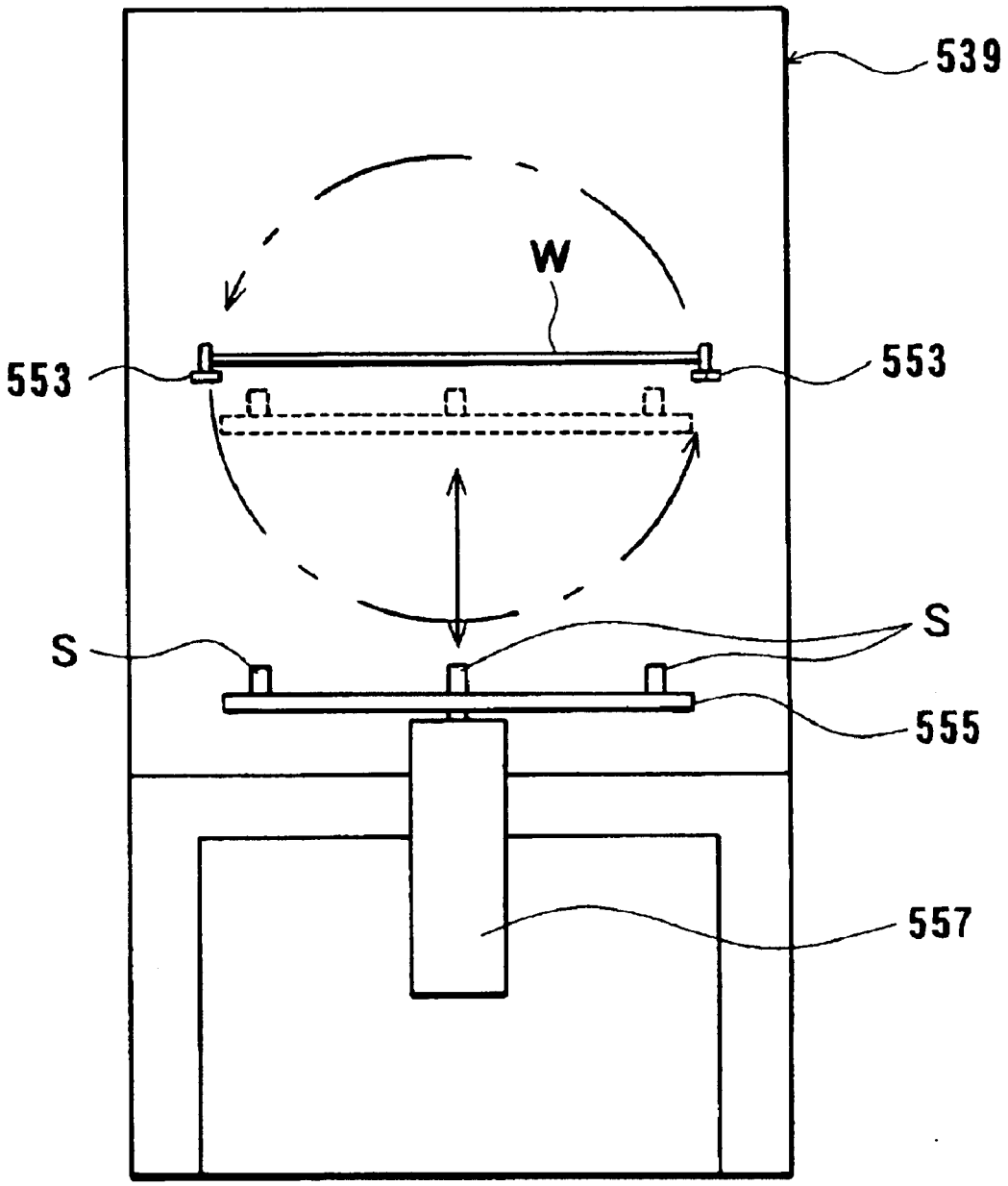
FIG. 34 is a schematic front view of the neighborhood of a reversing machine.
Figure 35:
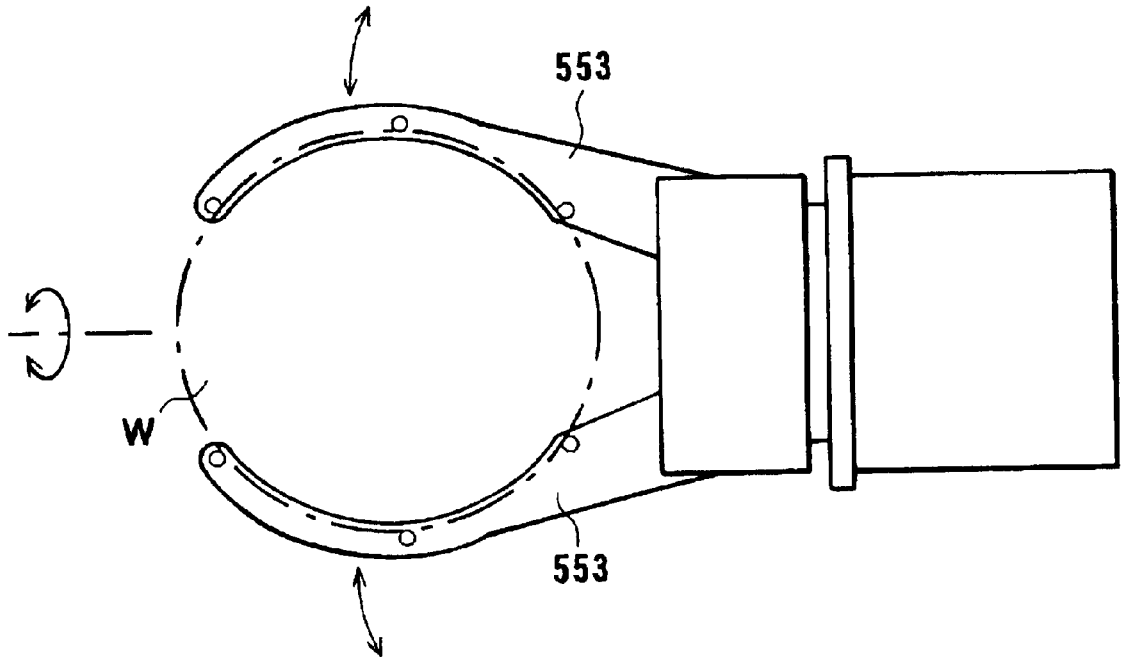
FIG. 35 is a plan view of a reversing arm portion.

FIG. 34 is a schematic front view of a reversing machine 539 and its surroundings. FIG. 35 is a plan view of reversing arm 553, 553 portions. As shown in FIGS. 34 and 35, the reversing arms 553, 553 put a substrate W therebetween and hold its outer periphery from right and left sides, and rotate the substrate W through 180°, thereby turning the substrate over. A circular mounting base 555 is provided immediately below the reversing arms 553, 553, and a plurality of film thickness sensors S are provided on the mounting base 555. The mounting base 555 is adapted to be movable upward and downward by a drive mechanism 557.

During reversing of the substrate W, the mounting base 555 waits at a position, indicated by solid lines, below the substrate W. Before or after reversing, the mounting base 555 is raised to a position indicated by dotted lines to bring the film thickness sensors S close to the substrate W gripped by the reversing arms 553, 553, thereby measuring the film thickness.

According to the present embodiment, since there is no restriction such as the arms 542 of the transporting device 514*a* (514*b*), shown in FIG. 30, the film thickness sensors S can be installed at arbitrary positions on the mounting base 555. Further, the mounting base 555 is adapted to be movable upward and downward, so that the distance between the substrate W and the sensors can be adjusted at the time of measurement. It is also possible to mount plural types of sensors suitable for the purpose of detection, and change the distance between the substrate W and the sensors each time measurements are made by the respective sensors. However, the mounting base 555 moves upward and downward, thus requiring certain measuring time.

Figure 36:
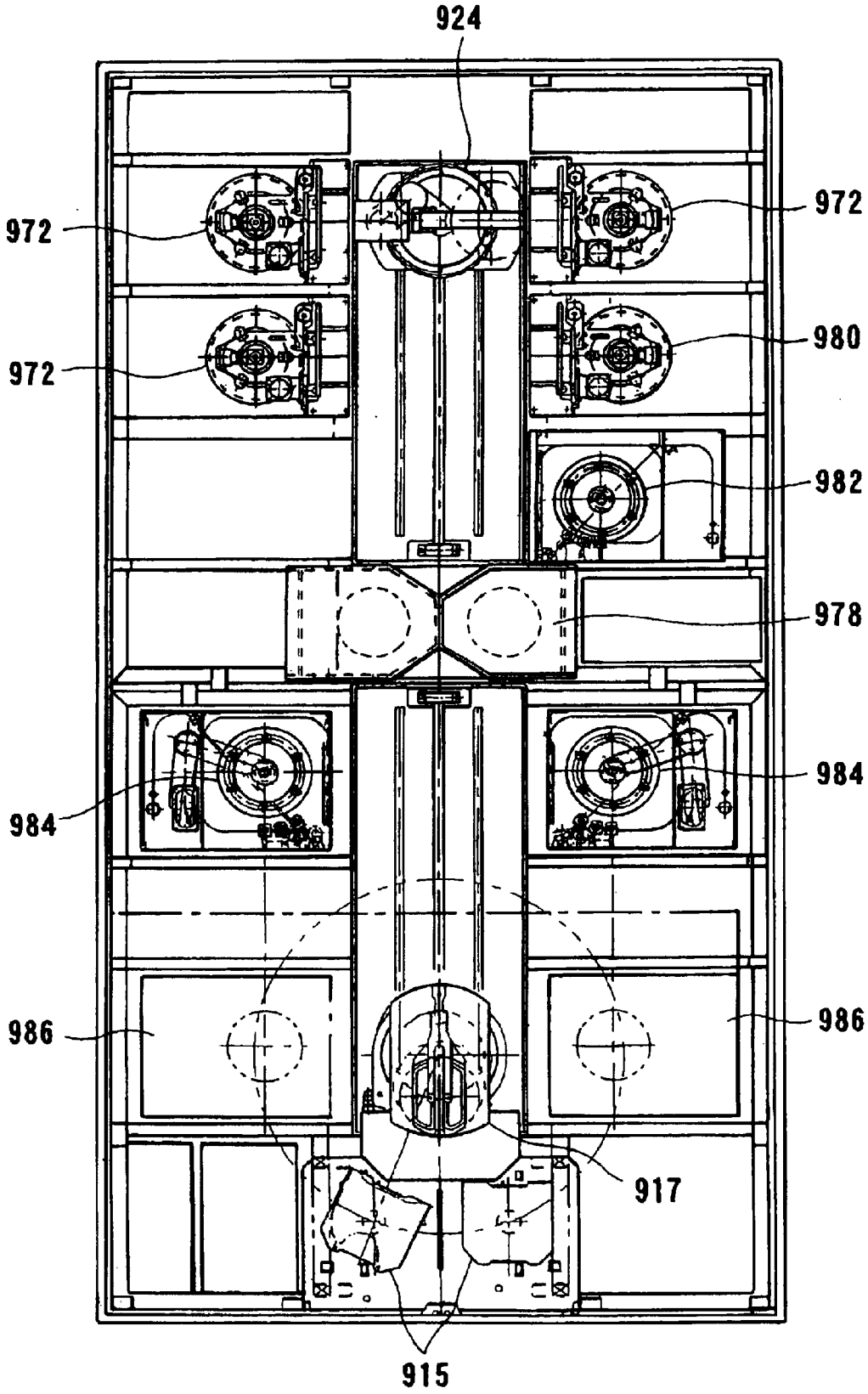
FIG. 36 is a plan view showing a layout of a plating apparatus according to still another embodiment of the present invention.

FIG. 36 is a plan view of yet another embodiment of plating apparatus in accordance with the present invention. The plating apparatus comprises a loading/unloading section 915, each pair of annealing sections 986, bevel-etching/chemical cleaning sections 984 and substrate stages 978, a washing section 982 provided with a mechanism for reversing substrate through 180°, a first plating section 980 for performing a first-stage plating (reinforcement of seed layer) as shown in FIG. 19, and three second plating sections 972 for performing a second-stage plating (filling with copper) as shown in FIG. 19. The apparatus is also provided with a moveable first transporting device 917 for transporting a substrate between the loading/unloading section 915, the annealing sections 986, the bevel-etching/chemical cleaning sections 984 and the substrate stages 978, and a movable second transporting device 924 for transporting the substrate between the substrate stages 978, the washing section 982, the first plating section 980 and the second plating sections 972.

According to this embodiment, the substrate W having a seed layer 7 (see FIG. 39A) as an outer layer is first taken one by one from the loading/unloading section 915 by the first transporting device 917, and is transported, via the substrate stage 978, to the first plating section 980.

Next, the first-stage plating of the surface of the substrate is performed in the first plating section 980, using a first plating liquid, thereby reinforcing and completing the thin portion of the seed layer 7. The first plating liquid used in the first plating section, e.g. a plating liquid comprising copper pyrophosphate as a base, and an complexing agent such as pyrophosphoric acid, has a higher polarization than a usual copper sulfate plating liquid, described above.

After the completion of the first-stage plating, the substrate W is, according to necessity, transported to the washing section 982 for washing by water, and is then transported to one of the second plating sections 972.

Next, the second-stage plating is performed onto the surface of the substrate W in the second plating section 972 using a second plating liquid, thereby filling with copper. Since the seed layer 7 (see FIG. 39A and FIG. 40A) has been reinforced by the first-stage plating to become a complete layer without a thin portion, electric current flows evenly through the seed layer 7 in the second-stage plating, whereby filling with copper can be completed without the formation of any voids. The second plating liquid, e.g. having a composition of low sulfuric acid concentration, has an excellent leveling property, described above.

After the completion of the second-stage plating, the substrate W is, according to necessity, transported to the washing section 982 for washing by water. Thereafter, the substrate W is transported to the bevel-etching/chemical cleaning section 984 where the substrate W is cleaned by using a chemical liquid, and a thin copper film, etc. formed on the bevel portion of the substrate W is etched away, and the substrate W is further rinsed by water and is then rotated at a high speed for spin-drying. The substrate is then transported to the annealing section 986 for annealing. Thereafter, the substrate is returned to cassette of the loading/unloading section 915 by the first transporting device 917.

Figure 37:
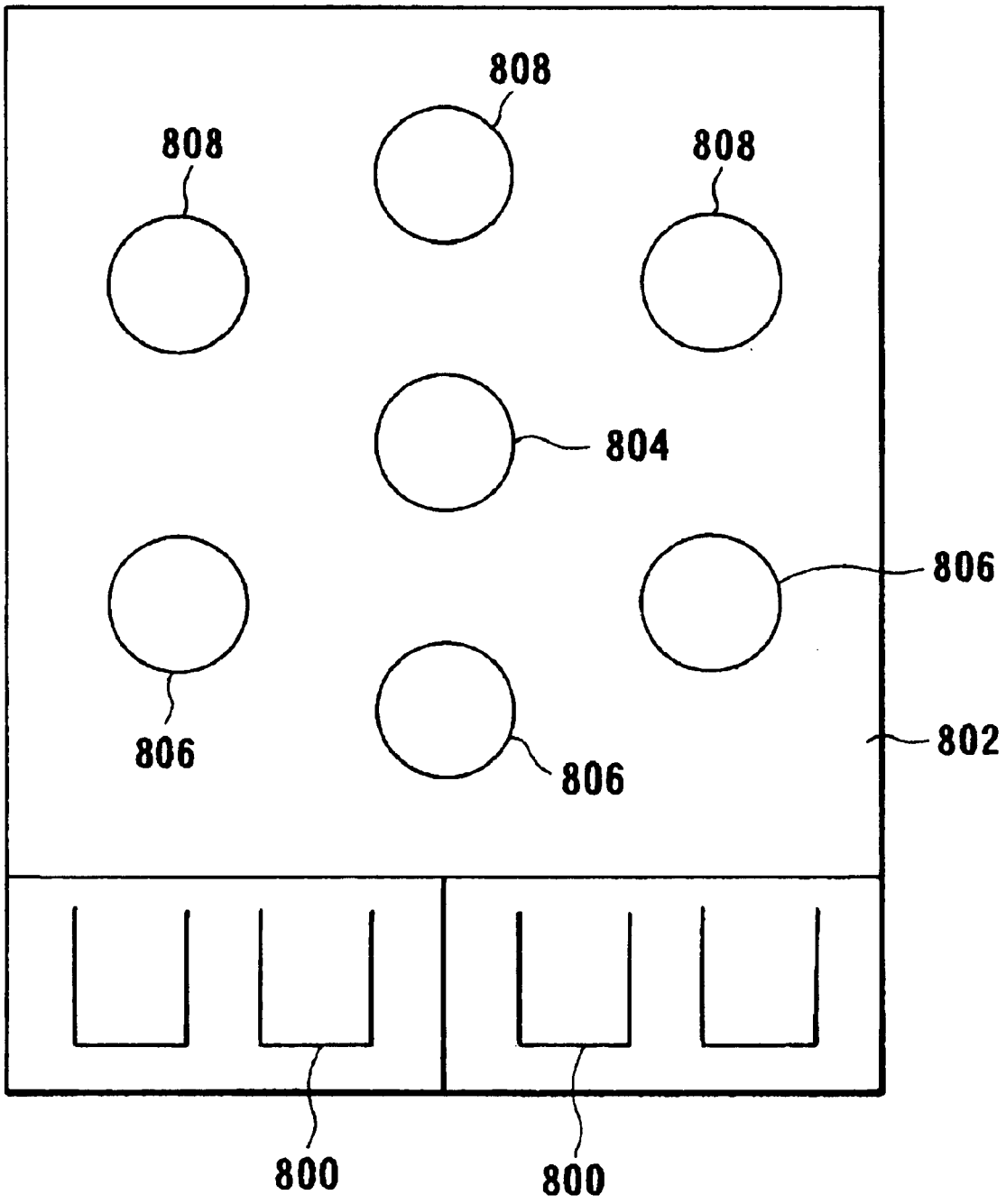
FIG. 37 is a plan view showing a layout of a plating apparatus according to still another embodiment of the present invention.

FIG 37 is a plan view of yet another embodiment of a plating apparatus in accordance with the present invention. The plating apparatus comprises loading/unloading sections 800 and a treatment section 802. Taking into consideration the throughput of semiconductor wafers, etc. a transporting device 804 is disposed in the center of the treatment section 802, and around the transporting device 804 are disposed a plurality of plating sections 806 and a plurality of cleaning/drying section (spinning-rinsing-drying unit) 808. In this embodiment, three plating sections 806 and three cleaning/drying sections 808 are disposed around one transporting device 804. Instead of the cleaning/drying sections 806, bevel-etching/chemical cleaning sections may be disposed. The plating section 808 may either be of the face-up type or of the face-down type.

Figure 38:
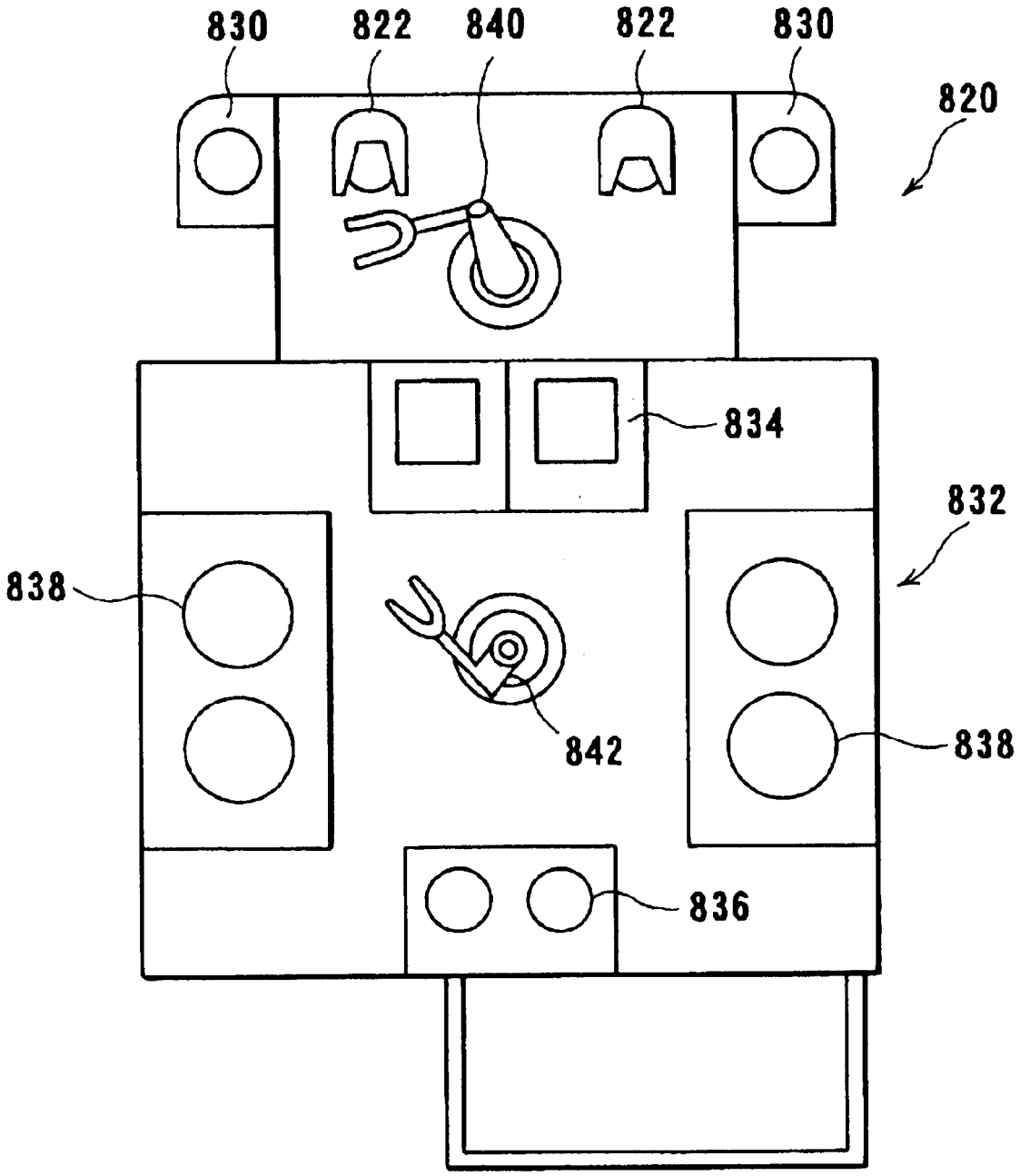
FIG. 38 is a plan view showing a layout of a plating apparatus according to still another embodiment of the present invention.

FIG. 38 is a plan view of yet another example of a plating apparatus in accordance with the present invention. The plating apparatus comprises a loading station 820 and a main frame 832. The loading station 820 includes two cassette tables for placing thereon substrate cassettes 822 that accommodate substrates such as semiconductor wafers, and annealing sections 830. The main frame 832 includes a pair of cleaning/drying sections 834, a pair of first plating sections 836 for performing the above described first-stage plating, and two pairs of second plating sections 838 for performing the above described second-stage plating.

Further, a first transporting device 840 is disposed in the loading station 820 for transporting the substrate between the substrate cassettes 822, the annealing sections 830 and the cleaning/drying sections 834; and a second transporting device 842 is disposed in the main frame 832 for transporting the substrate between cleaning/drying sections 834, the first plating sections 836 and the second plating sections 838.

Figure 41:
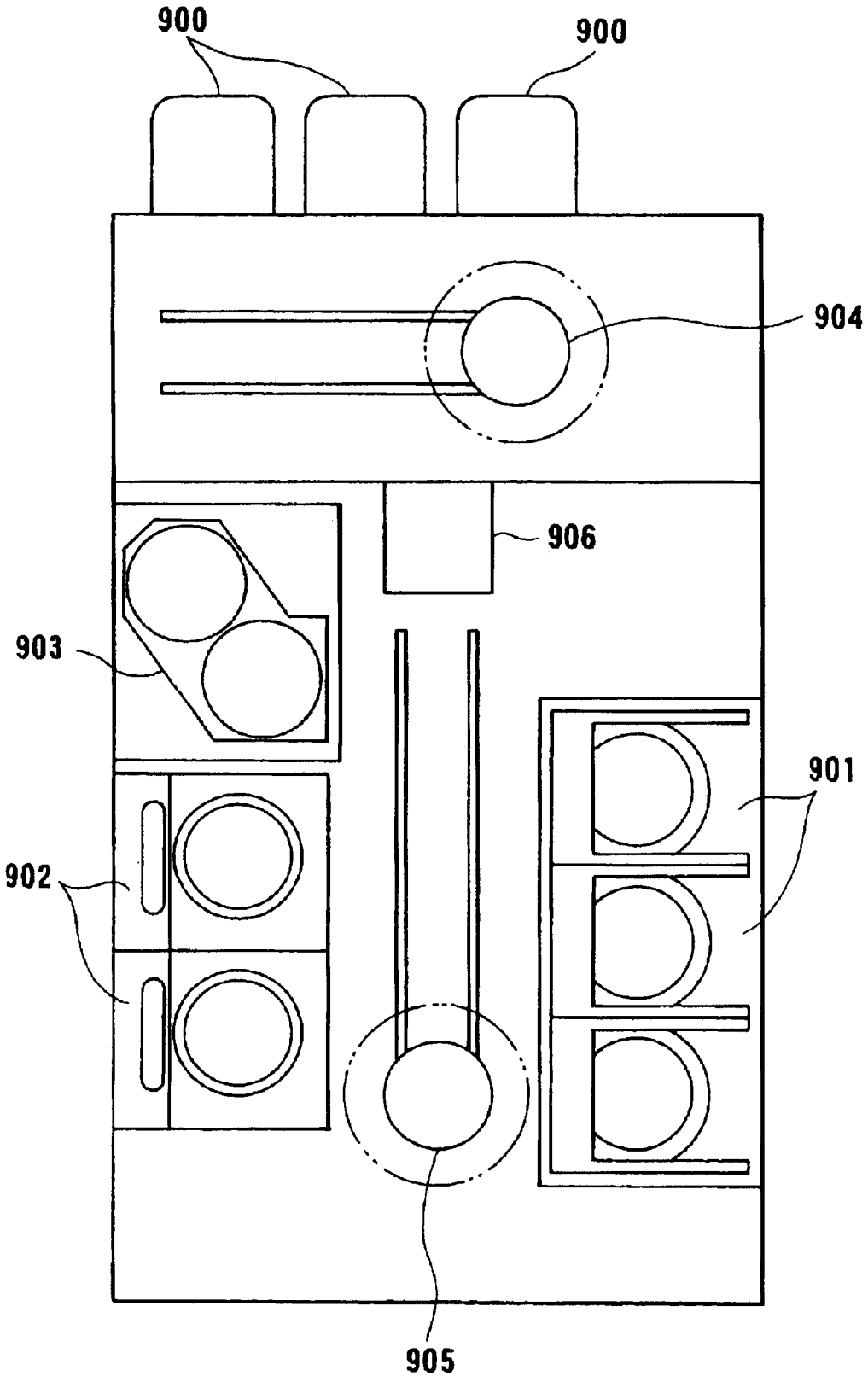
FIG. 41 is a plan view showing a layout of a plating apparatus according to still another embodiment of the present invention.

FIG. 41 is a plan view of yet another embodiment of plating apparatus in accordance with the present invention. The plating apparatus comprises loading/unloading sections 900, annealing section 903, two bevel-etching/chemical cleaning sections 902, substrate stage 906 and three plating sections 901. The apparatus is also provided with a first transporting device 904 for transporting a substrate between the loading/unloading sections 900 and the substrate stage 906, and a movable second transporting device 905 for transporting the substrate between the substrate stages 906, the annealing section 903, the bevel-etching/chemical cleaning sections 902 and the plating sections 901.

Figure 42:
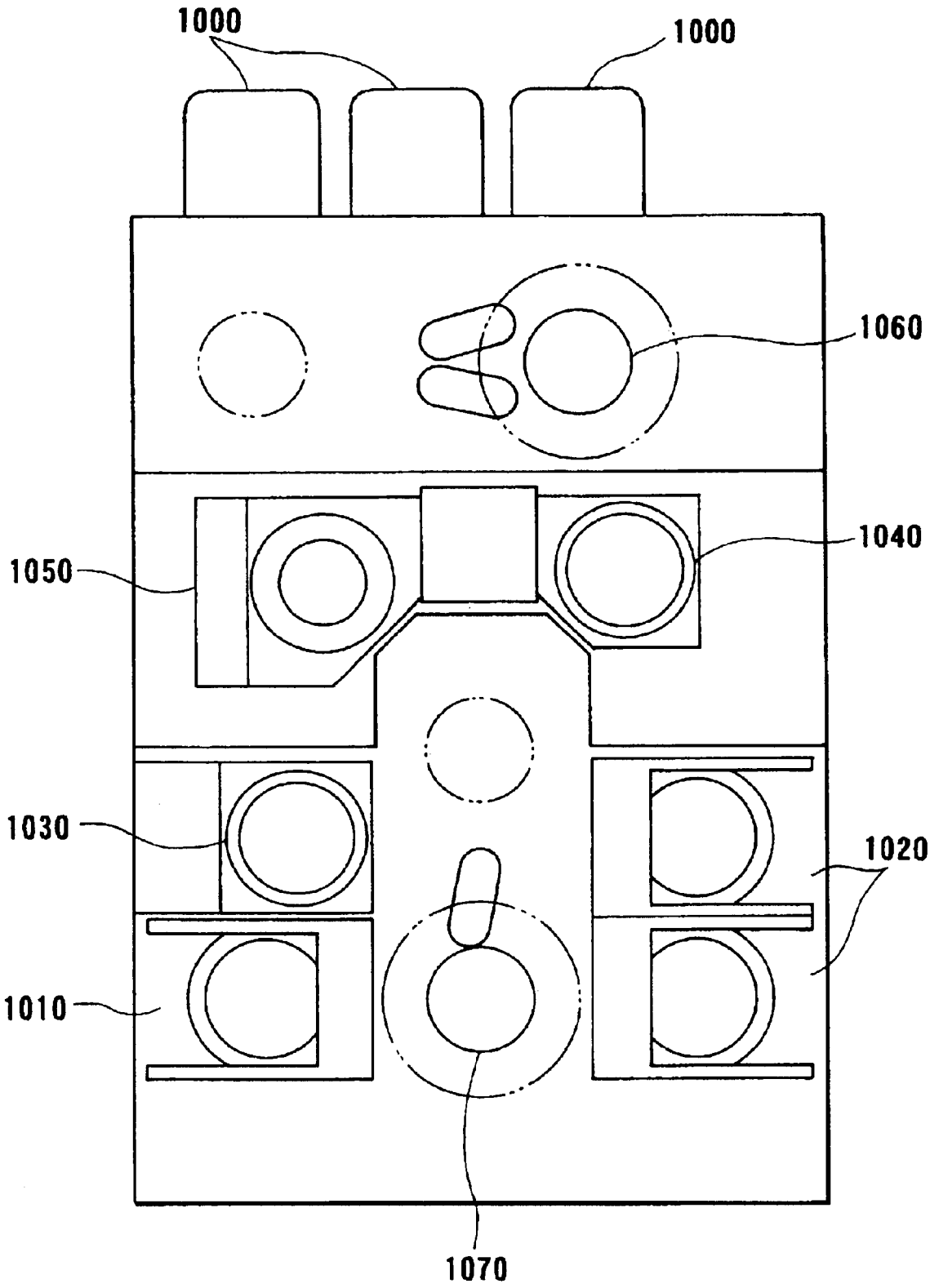
FIG. 42 is a plan view showing a layout of a plating apparatus according to still another embodiment of the present invention.

FIG. 42 is a plan view of yet another embodiment of plating apparatus in accordance with the present invention. The plating apparatus comprises loading/unloading sections 1000, bevel-etching/chemical cleaning section 1050, cleaning/drying section (spinning-rinsing-drying unit) 1040, first plating section 1010 for performing a first-stage plating (reinforcement of seed layer) as shown in FIG. 19, three second plating sections 1020 for performing a second-stage plating (filling with copper) as shown in FIG. 19, and washing section 1030 for washing the substrate between first-stage plating and second-stage plating. The apparatus is also provided with a first transporting device 1060 for transporting a substrate between the loading/unloading sections 1000, the bevel-etching/chemical cleaning section 1050 and the cleaning/drying section 1040, and a second transporting device 924 for transporting the substrate between the bevel-etching/chemical cleaning section 1050, the cleaning/drying section 1040, the first plating section 1010 and the second plating sections 1020.

Each of the plating sections 901 shown in FIG. 41 and the plating sections 1010 and 1020 shown in FIG. 42 may be used as the first-stage plating section or the second-stage plating section by using the first plating liquid or the second plating liquid described above for desire.

Although certain preferred embodiments of the present invention have been shown and described in detail, it should be understood that various changes and modifications may be made therein without departing from the scope of the appended claims.

What is claimed is:

1. A method for filling a metal into fine recesses in a surface of a substrate, comprising:

providing a substrate having fine recesses covered with a seed layer in a surface of the substrate;

reinforcing the seed layer by contacting the surface of the seed layer in a first plating liquid having ions of a metal and a complexing agent;

filling said fine recesses with the metal by electroplating a surface of the reinforced seed layer with contacting the substrate in a second plating liquid;

washing a surface of the metal on the substrate with water or washing liquid comprising water; and removing the metal on an edge portion of the substrate by supplying an etching liquid to a surface of the metal on the edge portion of the substrate;

wherein the first and the second plating liquids are free from an alkali metal and a cyanide, and the washing the surface of the metal is performed prior to the removing the metal on the edge portion of the substrate.

2. The method according to claim 1, wherein said first plating liquid has a higher polarization than said second plating liquid.

3. The method according to claim 1, wherein the reinforcing the seed layer is performed by electroplating a surface of the seed layer.

4. The method according to claim 3, wherein the reinforcing in the first plating liquid is performed at a first current density and the electroplating in the second plating liquid is performed at a second current density.

5. The method according to claim 4, wherein the second current density is higher than the first current density.

6. The method according to claim 1, further comprising measuring a film thickness of the metal on the substrate after the electroplating in the second plating liquid.

7. The method according to claim 1, further comprising annealing the substrate after removing the metal on the edge portion of the substrate.

8. The method according to claim 1, further comprising polishing the surface of the metal on the substrate to remove at least a portion of the metal except an interior of the recesses.

9. The method according to claim 8, further comprising forming a protective film on an exposed surface of the metal after the polishing.

10. The method according to claim 1, wherein the metal is copper.

11. The method according to claim 10, wherein the ions of the metal is divalent copper ions.

12. The method according to claim 11, wherein a concentration of the divalent copper ions is in a range of 0.1–100 g/l.

13. The method according to claim 1, wherein the first plating liquid further comprising a pH adjusting agent.

14. The method according to claim 13, wherein a pH of the first plating liquid is in a range of 7–14.

15. The method according to claim 1, wherein a concentration of the complexing agent is in a range of 0.1–500 g/l.

16. The method according to claim 1, wherein the complexing agent is selected from the group consisting of ethylenediamine tetracetic acid, ethylenediamine, N,N',N", N'-ethylene-di-nitro-tetrapropane-2-ol, pyrophosphoric acid, iminodiacetic acid, diethylenetriamine pentacetic acid, diethylenetriamine, triethylenetetramine, tetraethylenepentamine, diaminobutane, hydroxyethyl ethylenediamine, ethylenediamine tetrapropionic acid, ethylenediamine tetramethylene phosphonic acid, diethylenetriamine tetramethylene phosphonic acid, and diethylenetriamine pentamethylene phosphonic acid.

17. The method according to claim 1, wherein the first plating liquid further comprising at least one additive selected from the group consisting of organic acids, amines, glycerin, gelatin, heavy metal ions, thiazoles, triazoles, thiadiazoles, imidazoles, pyrimidines, sulfonic acids, and glutamic acids.

18. The method according to claim 4, wherein the first current is a direct current and a current density of the first current is in a range of 0.01 $A/dm^2$–30 $A/dm^2$.

19. The method according to claim 18, wherein the current density is in a range of 0.1 $A/dm^2$–3 $A/dm^2$.

20. The method according to claim 4, wherein the first current is a pulse current and a current density of the first current is in a range of 0.1 $A/dm^2$–200 $A/dm^2$.

21. The method according to claim 1, wherein a temperature of the first plating liquid is in a range of 10° C.–80° C.

22. The method according to claim 10, wherein the second plating liquid has a composition of copper sulfate in a range of 100–300 g/l and sulfuric acid in a range of 10–100 g/l.

23. The method according to claim 22, wherein the second plating liquid further comprising an additive for enhancing a leveling property.

24. The method according to claim 1, further comprising measuring a film thickness of the seed layer on the substrate prior to the electroplating in the first plating liquid.

25. The method according to claim 1, wherein the electroplating a surface of the seed layer by contacting the surface of the seed layer in the first plating liquid is performed while the substrate is rotating.

26. The method according to claim 1, wherein electroplating a surface of the reinforced seed layer by contacting the substrate in a second plating liquid is performed when the substrate is rotating.

27. A method for filling a metal into fine recesses in a surface of a substrate, comprising:

providing a substrate having fine recesses covered with a seed layer in a surface of the substrate;

electroplating a surface of the seed layer by contacting the surface of the seed layer in a plating liquid having ions of a metal and free from an alkali metal and a cyanide to form a metal layer on the seed layer;

washing a surface of the metal layer on the substrate with water or a washing liquid comprising water, and removing the metal layer on an edge portion of the substrate by supplying an etching liquid to a surface of the metal layer on the edge portion of the substrate;

wherein the washing of the surface of the metal layer is performed prior to the removing the metal on the edge portion of the substrate.

28. The method according to claim 27, wherein the electroplating the substrate of the seed layer comprises a first-stage plating and a second-stage plating, wherein the first-stage plating is performed at a first current density, and then the second-stage plating is performed at a second current density.

29. The method according to claim 28, wherein the second current density is higher than the first current density.

30. The method according to claim 27, further comprising measuring a film thickness of the metal layer on the substrate after the electroplating.

31. The method according to claim 27, further comprising annealing the substrate after removing the metal layer on the edge portion of the substrate.

32. The method according to claim 27, further comprising polishing the surface of the metal layer on the substrate to remove at least a portion of the metal except an interior of the recesses.

33. The method according to claim 32, further comprising forming a protective film on an exposed surface of the metal after the polishing.

34. The method according to claim 27, wherein the metal is copper.

35. The method according to claim 27, wherein the ions of the metal is divalent copper ions.

36. The method according to claim 35, wherein a concentration of the divalent copper ions is in a range of 0.1–100 g/l.

37. The method according to claim 28, wherein the first current is a direct current and a current density of the first current is in a range of 0.01 $A/dm^2$–30 $A/dm^2$.

38. The method according to claim 37, wherein the current density is in a range of 0.1 $A/dm^2$–3 $A/dm^2$.

39. The method according to claim 28, wherein the first current is a pulse current and a current density of the first current is in a range of 0.01 $A/dm^2$–200 $A/dm^2$.

40. The method according to claim 27, wherein the plating liquid has a composition of copper sulfate in a range of 100–300 g/l, and a composition of sulfuric acid in a range of 10–100 g/l.

41. The method according to claim 27, wherein the plating liquid further comprising an additive for enhancing a leveling property.

42. The method according to claim 27, further comprising measuring a film thickness of the seed layer on the substrate prior to the electroplating in the plating liquid.

43. The method according to claim 27, wherein the electroplating the surface of the seed layer by contacting the surface of the seed layer in the plating liquid is performed when the substrate is rotating.

44. An apparatus for filling fine recesses covered with a seed layer in a surface of the substrate, comprising:

a plating unit for forming a plated metal in the fine recesses covered with the seed layer in the surface of the substrate by contacting the surface of the seed layer in a plating liquid having ions of a metal and free from an alkali metal and a cyanide;

a film thickness measuring instrument for measuring a thickness of the plated metal; and a downflow clean air generation mechanism for generating a downflow clean air supplied from a ceiling to position around the film thickness measuring instrument and the plating unit.

45. The apparatus according to claim 44, further comprising:

a plating liquid regulating tank for supplying the plating liquid to the plating unit, and a plating liquid analyzing unit for sampling the plating liquid and analyzing the sample liquid.

46. The apparatus according to claim 44, further comprising a bevel-etching unit for removing the plated metal on the edge portion of the substrate by supplying an etching liquid to the surface of the metal on the edge portion of the substrate.

47. The apparatus according to claim 44, further comprising an annealing unit for annealing the substrate.

48. The apparatus according to claim 44, comprising a polishing unit for polishing a surface of the plated metal on the substrate.

49. The apparatus according to claim 48, further comprising means for forming a protective film on an exposed surface of the plated metal after the polishing.

50. A copper-plating liquid free from an alkali metal and a cyanide, comprising:

divalent copper ions;

a complexing agent; and choline or tetramethyl ammonium hydroxide as a pH adjusting agent.

51. The copper-plating liquid according to claim 50, wherein a concentration of said divalent copper ions is in the range of 0.1–100 g/l.

52. The copper-plating liquid according to claim 50, wherein a concentration of said complexing agent is in the range of 0.1–500 g/l.

53. The copper-plating liquid according to claim 50, wherein a pH of the copper-plating liquid is in the range of 7–14.

54. The copper-plating liquid according to claim 50, further comprising at least one additive selected from the group consisting of organic acids, amines, glycerin, gelatin, heavy metal ions, thiazoles, triazoles, thiadiazoles, imidazoles, pyrimidines, sulfonic acids, and glutamic acids.

55. The copper-plating liquid according to claim 50, wherein said complexing agent is selected from the group consisting of ethylenediamine tetracetic acid, ethylenediamine, N,N',N",N'"-ethylene-di-nitro-tetrapropane-2-ol, pyrophosphoric acid, iminodiacetic acid, diethylenetriamine pentacetic acid, diethylenetriamine, triethylenetetramine, tetraethylenepentamine, diaminobutane, hydroxyethyl ethylenediamine, ethylenediamine tetrapropionic acid, ethylenediamine tetramethylene phosphonic acid, diethylenetriamine tetramethylene phosphonic acid, and diethylenetriamine pentamethylene phosphonic acid.

56. The method according to claim 1 where the washing liquid is water.

57. The method according to claim 27 where the washing liquid consists essentially of water.

* * * * *